US006824964B1

(12) United States Patent
Ishizaka et al.

(10) Patent No.: US 6,824,964 B1
(45) Date of Patent: Nov. 30, 2004

(54) IMAGE FORMING METHOD

(75) Inventors: Tatsuya Ishizaka, Kanagawa (JP); Terukazu Yanagi, Kanagawa (JP); Atsushi Kato, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/424,766

(22) Filed: Apr. 29, 2003

(30) Foreign Application Priority Data

Apr. 30, 2002 (JP) ..... 2002-128755
Apr. 30, 2002 (JP) ..... 2002-128756

(51) Int. Cl.[7] ..... G03C 7/30; G03C 1/775

(52) U.S. Cl. ..... 430/376; 430/403; 430/523; 430/527

(58) Field of Search ..... 430/376, 403, 430/523, 527

(56) References Cited

U.S. PATENT DOCUMENTS

| | | | | | |
|---|---|---|---|---|---|
| 4,464,462 | A | * | 8/1984 | Sugimoto et al. | 430/512 |
| 5,360,707 | A | * | 11/1994 | Kato et al. | 430/538 |
| 5,452,045 | A | * | 9/1995 | Koboshi et al. | 396/626 |
| 6,030,742 | A | * | 2/2000 | Bourdelais et al. | 430/201 |
| 6,287,754 | B1 | | 9/2001 | Melpolder et al. | |
| 2002/0164550 | A1 | | 11/2002 | Yoshida | |

FOREIGN PATENT DOCUMENTS

| | | | |
|---|---|---|---|
| JP | 2000-10206 | A | 1/2000 |
| JP | 2002-258451 | A | 9/2002 |
| JP | 2002-372767 | A | 12/2002 |

* cited by examiner

*Primary Examiner*—Hoa Van Le
(74) *Attorney, Agent, or Firm*—Sughrue Mion, PLLC

(57) ABSTRACT

The invention provides an image forming method in which a silver halide color photosensitive material has a back layer on an opposite side to the silver halide emulsion layers. The back layer contains colloidal silica and has a surface resistance of $1.0\times10^{14}\Omega$ or less on the surface of the back layer, or a charge leak time of 200 seconds or less on the surface of the back layer, and an image forming method in which a silver halide color photosensitive material comprises at least one selected from fluorine type surfactants represented by general formulae (I), (II), (III) or (IV), the color development is executed with a replenishing amount of the color developer of 20 to 60 ml per 1 $m^2$ of the photosensitive material, and the bleach-fixing is executed with a replenishing amount of the bleach-fixing solution of 20 to 50 ml per 1 $m^2$ of it:

General formula (I)

General formula (II)

General formula (III)

General formula (IV)

$[Rf^D-(L^D)_{nD}]_{mD}-W$

7 Claims, No Drawings

IMAGE FORMING METHOD

BACKGROUND OF THE INVENTION

1. Field of the Invention

The present invention relates to an image forming method utilizing a silver halide color photosensitive material, and more specifically to an image forming method capable, in a low replenishment processing of a silver halide color photosensitive material, of suppressing a deterioration of a stain (sheet edge stain) on an end cut face (edge face) after the processing and improving stacking property of processed sheets, and an image forming method with reduced failure in the transporting of the silver halide color photosensitive material.

2. Description of the Related Art

In recent photoprocessing service industry, a color print system for obtaining a color print from a color negative film, a color reversal photosensitive material, a digital camera etc. has become popular not only in processing laboratories specialized in development and printing but also in ordinary photo shops. Exposure method in such color print system is principally divided into so-called analog exposure system in which an exposure is made by a light transmitted through a translucent photosensitive material such as a color negative film or a color reversal photosensitive material, and so-called digital exposure system in which digital information of an image stored in a memory device such as a semiconductor memory or information obtained by digitizing the image of the aforementioned translucent photosensitive material is printed as image information to form a color print for example with a semiconductor laser.

In such color print system, the photosensitive material is wound in a roll, then set in a magazine, mounted in the system and pulled out of the magazine for transporting. The photosensitive material, or so-called color photographic paper, has usually been transported by so-called roll transport in which the material is subjected to an exposure and a developing process in an uncut state and is finally cut into an individual print. However in order to clarify the boundary of each print, a shot information has to be formed and such portion is inevitably wasted. Therefore, there is commercialized a color print system employing a transporting method in which the photosensitive material is cut into a sheet of individual print, and then subjected to an exposure and a development process. Such transporting method employs a transporting system with paired transporting rollers and a transporting system with a conveyor belt to avoid an unevenness in a scanning exposure, after which the photosensitive material is supplied to developers. Such color print system, being utilized in processing laboratories and photo shops, is operated under various environments which are in fact different among these laboratories and photo shops and vary depending on the time in a day or the season. Particularly in winter, the color print system is often used in a dry environment, which often leads to troubles resulting from electrostatic charging of the color prints, such as a static mark, a transporting failure or a stacking failure. In particular, a stacking failure is encountered in a step of stacking and grouping the prints, obtained after the processing, into a unit of each color negative film or each digital information of a customer, and requires a manual resorting operation. Also in comparison with the aforementioned roll transport system, the sheet transport system used in the color print system tends to cause a transporting failure by electrostatic charging at the transfer of the photosensitive material from the paired transporting rollers to the conveyor belt.

On the other hand, certain color print systems employ a low replenishment processing of the photosensitive material, in order to alleviate the environmental burden and to reduce costs for recovery and treatment of the used solutions. In such low replenishment processing, components discharged from the silver halide photosensitive material to the developers are accumulated therein in larger amounts, and, for example an increased halogen accumulation leads to drawbacks such as a slower proceeding of image development, an aggravation of so-called edge stain, which is a brown stain caused by intrusion of the developers into an end cut face (edge face) of a laminated paper of polyethylene resin layers of a substrate (usually called color print material), and a deterioration of the solution stability. The edge stain becomes aggravated with time in a case that the photographic print is stored in a high temperature and/or high humidity condition. It is therefore desired, by the market of the color print laboratories, to provide a processing method capable of avoiding the edge stain, in the low replenishment processing for the aforementioned purposes.

The present invention is to solve the aforementioned drawbacks in the related technology, and to attain the followings. An object of the present invention is to provide an image forming method capable of suppressing a transporting failure in a silver halide color photosensitive material, and an image forming method capable, in a low replenishment processing of the silver halide color photosensitive material, of suppressing aggravation of a stain (edge stain) of an end cut face (edge face) after the processing and improving stacking property.

SUMMARY OF THE INVENTION

As a result of intensive investigations on failures encountered in an image forming method executed utilizing transportation with a paired transport rollers and/or a belt conveyor, the present inventors have found it possible, by introducing colloidal silica in a rear surface side (back layer) of the photosensitive material and by maintaining a surface resistance of $1.0\times10^{14}\Omega$ or less and/or a charge leak time of 200 seconds or less on the rear surface (surface of back layer) of the photosensitive material, to reduce a surface contact area with the paired transporting rollers and/or the belt conveyor, and to quickly eliminate the charge caused by peeling, thereby suppressing the transporting failure caused by charging. Also the paired transporting rollers are usually formed by hard rubber rollers or metal rollers having a high dimensional stability and the photosensitive material tends to be charged when it is brought into contact with such rollers and is peeled off therefrom, but it is found that inclusion of a specific fluorine type surfactant in the rear surface side of the photosensitive material reduces such charging tendency and the transporting failure, whereby the present invention has been made. Furthermore, as a result of intensive investigations, the present inventors have found that, in a development process with low replenishment amounts of a color developer and a desilvering bleach-fixing solution, use of a specific fluorine type surfactant in the silver halide color photosensitive material surprisingly suppresses aggravation of the edge stain of the photosensitive material and improves the stacking property of the photosensitive material after the processing, thereby reaching the present invention.

In the first aspect, the invention provides an image forming method (J) comprising the steps of:

cutting a silver halide color photosensitive material, which has, on a reflective substrate, photographic layers comprising at least one of each of a blue light-sensitive silver halide emulsion layer containing a yellow dye forming coupler, a green light-sensitive silver halide emulsion layer containing a magenta dye forming coupler, a red light-sensitive silver halide emulsion layer containing a cyan dye forming coupler, and a non-photosensitive hydrophilic colloid layer, into sheet form;

subjecting the sheet to imagewise exposure under transportation with at least one of paired transporting rollers and a belt conveyor; and applying development processing that includes color development, bleach-fixing, and rinsing, to the sheet wherein said silver halide color photosensitive material comprises a back layer on a side of the reflective substrate opposite to the silver halide emulsion layers, said back layer contains colloidal silica, and a surface of said back layer has a surface resistance of $1.0\times10^{14}\Omega$ or less.

In the second aspect, the invention provides an image forming method (K) comprising the steps of:

cutting a silver halide color photosensitive material, which has, on a reflective substrate, photographic layers comprising at least one of each of a blue light-sensitive silver halide emulsion layer containing a yellow dye forming coupler, a green light-sensitive silver halide emulsion layer containing a magenta dye forming coupler, a red light-sensitive silver halide emulsion layer containing a cyan dye forming coupler, and a non-photosensitive hydrophilic colloid layer, into sheet form;

subjecting the sheet to imagewise exposure under transportation with at least one of paired transporting rollers and a belt conveyor; and applying development processing that includes color development, bleach-fixing, and rinsing, to the sheet wherein said silver halide color photosensitive material comprises a back layer on a side of the reflective substrate opposite to the silver halide emulsion layers, said back layer contains colloidal silica, and a surface of said back layer has a charge leak time of 200 seconds or less.

In the third aspect, the invention provides the image forming method (J), wherein said colloidal silica has an average particle diameter of 5 to 100 nm.

In the fourth aspect, the invention provides the image forming method (K), wherein said colloidal silica has an average particle diameter of 5 to 100 nm.

In the fifth aspect, the invention provides the image forming method (J), wherein said colloidal silica has a pH value of 2.5 to 12.

In the sixth aspect, the invention provides the image forming method (K), wherein said colloidal silica has a pH value of 2.5 to 12.

In the seventh aspect, the invention provides the image forming method (J), wherein a surface of said colloidal silica is coated with alumina.

In the eighth aspect, the invention provides the image forming method (K), wherein a surface of said colloidal silica is coated with alumina.

In the ninth aspect, the invention provides the image forming method (J), wherein said back layer includes at least one of a water-soluble polymer compound having a carboxyl group or a sulfonic group, a metal salt thereof and an aqueous dispersion of a hydrophilic organic polymer having at least one of a carboxyl group, a sulfonic group, a phosphoric acid group, an acyl group, and a hydroxyl group.

In the tenth aspect, the invention provides the image forming method (K), wherein said back layer includes at least one of a water-soluble polymer compound having a carboxyl group or a sulfonic group, a metal salt thereof and an aqueous dispersion of a hydrophilic organic polymer having at least one of a carboxyl group, a sulfonic group, a phosphoric acid group, an acyl group, and a hydroxyl group.

In the eleventh aspect, the invention provides an image forming method (L) comprising the steps of:

subjecting a silver halide color photosensitive material, which has, on a reflective substrate, photographic layers comprising at least one each of a blue light-sensitive silver halide emulsion layer containing a yellow dye forming coupler, a green light-sensitive silver halide emulsion layer containing a magenta dye forming coupler, a red light-sensitive silver halide emulsion layer containing a cyan dye forming coupler, and a non-photosensitive hydrophilic colloid layer, to an imagewise exposure; and applying development processing that includes color development, bleach-fixing and rinsing, to the silver halide color photosensitive material, wherein said silver halide color photosensitive material comprises at least one selected from fluorine type surfactants represented by the following general formulae (I), (II), (III) and (IV);

said color development is executed with a replenishing amount of a color development solution of 20 to 60 ml per 1 $m^2$ of said silver halide color photosensitive material; and said bleach-fixing step is executed with a replenishing amount of a bleach-fixing solution of 20 to 50 ml per 1 $m^2$ of said silver halide color photosensitive material General formula (I)

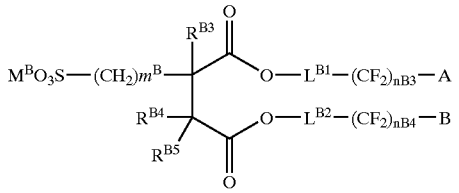

General formula (II)

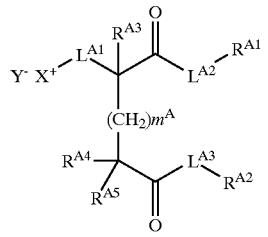

General formula (III)

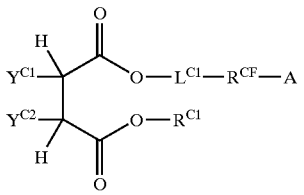

General formula (IV)

$$[Rf^D-(L^D)_{nD}]_{mD}-W$$

wherein in general formula (I), $R^{B3}$, $R^{B4}$ and $R^{B5}$ each independently represent a hydrogen atom or a substituent group; A and B each independently represent a fluorine atom or a hydrogen atom; $n^{B3}$ and $n^{B4}$ each independently represent an integer from 4 to 8; $L^{B1}$ and $L^{B2}$ each independently represent a substituted or unsubstituted alkylene group, a substituted or unsubstituted alkenyloxy group, or a divalent connecting group formed by a combination thereof; $m^B$ represents 0 or 1; and M represents a cation;

in general formula (II) $R^{A1}$ and $R^{A2}$ each independently represent a substituted or unsubstituted alkyl group; at least one of $R^{A1}$ and $R^{A2}$ represents an alkyl group substituted with a fluorine atom; $R^{A3}$, $R^{A4}$ and $R^{A5}$ each independently represent a hydrogen atom or a substituent group; $L^{A1}$, $L^{A2}$ and $L^{A3}$ each independently represent a single bond or a divalent connecting group; $X^+$ represents a cationic substituent; $Y^-$ represents a counter anion which may be omitted in a case in which a charge in the molecule becomes 0; and $m^A$ represents 0 or 1;

in general formula (III), $R^{C1}$ represents a substituted or unsubstituted alkyl group; $R^{CF}$ represents a perfluoroalkylene group; A represents a hydrogen atom or a fluorine atom; $L^{C1}$ represents a substituted or unsubstituted alkylene group, a substituted or unsubstituted alkyleneoxy group, or a divalent connecting group formed by a combination thereof; one of $Y^{C1}$ and $Y^{C2}$ represents a hydrogen atom and the other represents —$L^{C2}$—$SO_3M$; and M represents a cation; and in general formula (IV), $Rf^D$ represents a perfluoroalkyl group; $L^D$ represents an alkylene group; W represents a group having an anionic, cationic, betainic or nonionic polar group necessary for providing a surface-active property; $n^D$ represents 0 or 1; and $m^D$ represents an integer from 1 to 3.

In the twelfth aspect, the invention provides the image forming method (L), wherein said silver halide color photosensitive material comprises a fluorine type surfactant represented by general formula (I).

In the thirteenth aspect, the invention provides the image forming method (L), wherein the non-photosensitive hydrophilic colloid layer constituting an outermost layer of said silver halide color photosensitive material comprises at least one of the fluorine type surfactants represented by general formulae (I) to (IV).

In the fourteenth aspect, the invention provides the image forming method (L), wherein said silver halide color photosensitive material further comprises, as an outermost layer thereof, another non-photosensitive hydrophilic colloid layer which includes at least one selected from the fluorinated surfactants represented by general formulae (I) to (IV).

In the fifteenth aspect, the invention provides the image forming method (L), wherein the fluorinated surfactant represented by general formulae (I) to (IV) is added to said silver halide color photosensitive material in an amount of $1\times10^{-5}$ to 1 g/m$^2$.

In the sixteenth aspect, the invention provides the image forming method (J), wherein said back layer includes at least one selected from fluorine type surfactants represented by the general formulae (I) to (IV), and said colloidal silica In the seventeenth aspect, the invention provides the image forming method (K), wherein said back layer includes at least one selected from fluorine type surfactants represented by the general formulae (I) to (IV), and said colloidal silica In the eighteenth aspect, the invention provides the image forming method (J), wherein said back layer includes a fluorine type surfactant represented by the general formula (I), and said colloidal silica In the nineteenth aspect, the invention provides the image forming method (K), wherein said back layer includes a fluorine type surfactant represented by the general formula (I), and said colloidal silica

DESCRIPTION OF THE PREFERRED EMBODIMENTS

In the following there will be given a detailed explanation on the present invention.

In the image forming method of the present invention, a silver halide color photosensitive material is subjected to an imagewise exposure, and then to a development process to form an image.

At first the silver halide color photosensitive material is subjected to an imagewise exposure according to image information, and, for such exposure, there is advantageously employed a digital scanning exposure method employing a monochromatic high-density light of a gas laser, a light emitting diode, a semiconductor laser, or a second harmonic generator (SHG) light source constituted by a combination of a semiconductor laser or a solid-state laser employing a semiconductor laser as an exciting light source and a non-linear optical crystal. For realizing a compact and inexpensive system, it is preferred to employ a second harmonic generator (SHG) light source constituted by a combination of a semiconductor laser or a solid-state laser employing a semiconductor laser as an exciting light source and a non-linear optical crystal. For designing an apparatus which is particularly compact and inexpensive, and has a long service life and a high stability, use of a semiconductor laser is preferred, and it is preferred to use a semiconductor laser for at least one of the exposure light sources.

In case of employing such scanning exposure light source, a wavelength of maximum spectral sensitivity of the photosensitive material can be arbitrarily selected according to the wavelength of the scanning exposure light source to be employed. In an SHG light source formed by combining a solid-state laser employing a semiconductor laser as an exciting light source or a semiconductor laser and a non-linear optical crystal, there can be obtained a blue light or a green light by dividing the oscillation wavelength of the laser into a half. Therefore, the photosensitive material can be provided with spectral sensitivity maxima in ordinary three wavelength regions of blue, green and red. An exposure time per pixel in such scanning exposure, defined by a time required for a pixel size with a pixel density of 400 dpi, is preferably $10^{-3}$ sec or less, more preferably $10^{-4}$ sec or less and further preferably $10^{-6}$ sec or less.

As specific examples of the semiconductor laser light source, there can be advantageously employed a blue light-emitting semiconductor laser having a wavelength of 430 to 450 nm (announced by Nichia Corporation at the 48th (Applied Physics United Symposium (JSAP annual meeting), March 2001), a blue light-emitting laser having a wavelength of about 470 nm, obtained by a wavelength conversion of a light of a semiconductor laser (oscillation wavelength: about 940 nm) with a $LiNbO_3$ SHG crystal having a waveguide-shaped inverted domain structure, a green light-emitting laser having a wavelength of about 530 nm, obtained by a wavelength conversion of a light of a semiconductor laser (oscillation wavelength: about 1060 nm) with a $LiNbO_3$ SHG crystal having a waveguide-shaped inverted domain structure, a red light-emitting semiconductor laser having a wavelength of about 685 nm (Hitachi type No. HL6738MG) and a red light-emitting semiconductor laser having a wavelength of about 650 nm (Hitachi type No. HL6501MG).

In particular, it is preferred to execute imagewise exposure with a coherent light of a blue light-emitting laser having an oscillation wavelength of 430 to 460 nm, and, among the blue light-emitting lasers, it is particularly preferred to employ a blue light-emitting semiconductor laser.

However the scanning exposure system utilizing such light sources is not restrictive, and there may also be utilized an exposure system employed in an ordinary negative film printer or a scanning exposure system employing a cathode ray tube (CRT). A cathode ray tube exposure apparatus is simple, compact and inexpensive in comparison with an apparatus utilizing lasers. Also adjustments of optical axis and colors are easy. The cathode ray tube employed for image exposure utilizes light-emitting materials which emit lights in the necessary spectral regions. For example there is employed any of a red light-emitting material, a green light-emitting material and a blue light-emitting material, or a mixture of two or more thereof. The spectral regions are not limited to red, green and blue mentioned above but there may also be employed a fluorescent substance emitting light in yellow, orange, purple or in infrared region. There is often employed a cathode ray tube which emits white light by mixing these light emitting materials.

In case the photosensitive material has plural photosensitive layers having different spectral sensitivity distributions and the cathode ray tube has fluorescent substances emitting lights in plural spectral regions, it is possible to expose plural colors at a time, by entering image signals of plural colors to the cathode ray tube thereby emitting plural colors therefrom. It is also possible to adopt an exposure method of entering image signals of respective colors in succession to emit lights of respective colors in succession and executing an exposure with the light through a filter which cuts off the other colors (frame-sequential exposure). In general, such frame-sequential exposure method is preferable for attaining a higher image quality since a cathode ray tube having a higher resolution can be employed.

The silver halide color photosensitive material, thus subjected to the imagewise exposure, is subjected to a development process. The development process includes a color developing step employing a color developer, a bleach-fixing step employing a bleach-fixing solution and a rinsing step (water-rinsing and/or stabilizing step) employing a rinsing solution (rinsing water and/or stabilizing solution), and the silver halide color photosensitive material is developed by immersions in the developers in succession. The development process is not limited to that described above, but auxiliary steps such as an interim rinsing step and a neutralizing step may be inserted between the steps. The bleach-fixing step is executed either by a single step employing a bleach-fixing solution, or by two steps, namely a bleaching step and a fixing step respectively employing a bleaching solution and a fixing solution.

These solutions for the development process are usually used while replenished, and the amount of replenishment can be 20 to 60 ml per 1 $m^2$ of the photosensitive material, for the color developer and 20 to 50 ml for the bleach-fixing solution, and it is preferably 20 to 50 ml for the color developer and 25 to 45 ml (more preferably 25 to 40 ml) for the bleach-fixing solution. Also the amount of replenishment for the rinsing solution (rinsing water and/or stabilizing solution) is preferably 50 to 1000 ml as the entire rinsing solutions, and the replenishment may be done according to the area of the silver halide color photosensitive material subjected to the development process.

A color developing time (time of the color developing step) is preferably 45 seconds or less, more preferably 30 seconds or less, further preferably 28 seconds or less, particularly preferably 25 seconds to 6 seconds and most preferably 20 seconds to 6 seconds. Similarly, a bleach-fixing time (time of the bleach-fixing step) is preferably 45 seconds or less, more preferably 30 seconds or less, further preferably 25 to 6 seconds, and particularly preferably 20 to 6 seconds. Also a rinsing (water rinsing or stabilizing) time (time of the rinsing step) is preferably 90 seconds or less, more preferably 30 seconds or less and further preferably 30 to 6 seconds.

The color developing time means a time from the entry of the photosensitive material into the color developer to the entry into the bleach-fixing solution in the next step. For example, in case of processing with an automatic processor, the color developing time means a sum of a time in which the photosensitive material is immersed in the color developer (so-called in-liquid time) and a time in which the photosensitive material is transported, after leaving the color developer, in the air (so-called in-air time) toward the bleach-fixing solution of the next process step. Similarly, a bleach-fixing time means a time from the entry of the photosensitive material into the bleach-fixing solution to the entry to a next rinsing or stabilizing bath. Also a rinsing (water rinsing or stabilizing) time means a time in which the photosensitive material remains in the liquid (so-called in-liquid time) after the entry into the rinsing solution (rinsing water or stabilizing solution) toward a drying step.

Also the amount of the rinsing solution can be selected within a wide range, according to characteristics (depending on the used materials such as couplers) of the photosensitive material, a purpose of use thereof, a temperature of the rinsing solution (rinsing water), a number of the rinsing solutions (number of rinsing tanks) and other various conditions. Among these, a relationship between the number of the rinsing solutions (rinsing tanks) and the solution amount in a multi-stage countercurrent system can be determined by a method described in Journal of the Society of Motion Picture and Television Engineers, 64, pp.248–253(May 1955). In general, the number of steps in the multi-stage countercurrent system is preferably 3 to 15, particularly preferably 3 to 10.

The multi-stage countercurrent system can significantly reduce the amount of the rinsing solution, but an increased residence time of the water in the tanks stimulates proliferation of bacteria and results in a drawback that a generated floating substance is deposited on the photosensitive material, so that there is preferably employed a rinsing solution containing an antibacterial agent or an antimold agent to be explained later.

Then, after the development process, the silver halide color photosensitive material is subjected to a post process such as a drying step. In the drying step, it is possible to expedite the drying by removing water with a squeeze roller or a cloth immediately after the development process (rinsing step), in view of decreasing the water intake into the image film of the silver halide color photosensitive material. It is also possible, while being self evident, to expedite the drying by elevating the temperature or increasing the drying air by modifying the shape of an air blowing nozzle. The drying may also be expedited, as described in Japanese Patent Application Laid-Open (JP-A) No. 3-157650, by adjusting a blowing angle of drying air to the photosensitive material or a method of removing discharged air.

An image is thus formed on the silver halide color photosensitive material.

In the image forming method of the present invention, the aforementioned exposure and development processes are executed after cutting the silver halide photosensitive material into a sheet, while being transported by paired transporting rollers and/or a belt conveyor. Details of a technology for transporting a sheet-shaped photosensitive material are disclosed for example in JP-A Nos. 11-218856, 2000-10206 and 2002-3002, and the present invention can be executed according to such technology. Specifically, the photosensitive material is set, in a state wound in a roll, in a magazine, and each magazine is respectively loaded in a color print system. The color paper is drawn out of the magazine, then cut into a desired length by a cutter, transported by paired transport rollers, exposed in a scanning exposure apparatus utilizing a light beam (for example of a semiconductor laser), further transported by two pairs of conveyor belts and supplied to the developers. The paired transport rollers are generally formed by hard rubber rollers or metal rollers having a satisfactory dimensional stability.

In the following there will be explained other preferred embodiments of the image forming method of the present invention.

The image forming method of the present invention can be advantageously employed in combination with exposure and development systems described in the following known references. Examples of the development system include an automatic printing and developing system described in JP-A No. 10-333253, a photosensitive material transporting apparatus described in JP-A No. 2000-10206, a recording system including an image reading apparatus described in JP-A No. 11-215312, an exposure system based on a color image recording method described in JP-A Nos. 11-88619 and 10-202950, a digital photo print system including a remote diagnosis method described in JP-A No. 10-210206, and a photo print system including an image recording apparatus described in U.S. Pat. No. 6,297,873B1.

Also the scanning exposure method is described in detail in patent references shown in the following Table 1.

At the imagewise exposure, it is preferred to employ a band stop filter described in U.S. Pat. No. 4,880,726. Such method eliminates color mixing and significantly improves color reproducibility.

It is also possible to provide a copy inhibiting property by pre-exposing yellow microdot patterns prior to the exposure of the image information, as described in EP0789270A1 and EP0789480A1.

For the development process, there can be advantageously employed processing materials and processing methods, described in JP-A No.2-207250, page 26, lower right column, line 1 to page 34, upper right column, line 9, and in JP-A No. 4-97355, page 5, upper left column, line 17 to page 18, lower right column, line 20. Also as a preservative to be used in the developer, there can be advantageously employed compounds described in the patent references shown in the following Table 1.

As a representative example, the color development process can be executed by employing a Minilab PP350 manufactured by Fuji Photo Film Co., Ltd. and a CP48S chemical as the processing agent, and conducting an imagewise exposure to the photosensitive material from a negative film of an average density and a continuous processing until the amount of a replenisher for the color developer becomes twice of the capacity of a color developing tank.

As the processing chemical, there may also be employed CP47L manufactured by Fuji Photo Film Co., Ltd.

Also as the methods for development process, in addition to wet methods such as a known method of development with a developer containing an alkaline agent and a developing agent, or a method of development with an activator solution such as an alkaline solution not containing the developing agent, there may also be employed a thermal development method which does not employ developers. In particular, the activator method, not containing the developing agent in the developer, is easy in the management and handling of the developers and is preferred in environmental consideration, as the burden in the disposal of the used solutions is reduced.

In the activator method, for a developing agent or a precursor thereof to be included in the photosensitive material, there is preferred a hydrazine compound described for example in JP-A Nos. 8-234388, 9-152686, 9-152693, 9-211814 and 9-160193.

There is also advantageously employed a development method utilizing an image amplifying process (image intensifying process) with hydrogen peroxide, while reducing a coated amount of silver in the photosensitive material. In particular, it is preferred to apply this method in the activator method. More specifically, an image forming method utilizing an activator solution containing hydrogen peroxide, as described in JP-A Nos. 8-297354 and 9-152695, can be preferably employed.

In the following there will be explained a silver halide color photosensitive material (hereinafter simply called photosensitive material) to be applied to the image forming method of the present invention.

The photosensitive material has, on a reflective substrate, photographic layers including at least one each of a blue light-sensitive silver halide emulsion layer containing a yellow dye-forming coupler, a green light-sensitive silver halide emulsion layer containing a magenta dye-forming coupler, a red light-sensitive silver halide emulsion layer containing a cyan dye-forming coupler, and a non-photosensitive hydrophilic colloid layer. The silver halide emulsion layer containing the yellow dye-forming coupler functions as a yellow color developing layer, the silver halide emulsion layer containing the magenta dye-forming coupler functions as a magenta color developing layer, and the silver halide emulsion layer containing the cyan dye-forming coupler functions as a cyan color developing layer. The silver halide emulsions respectively contained in the yellow color developing layer, the magenta color developing layer and the cyan color developing layer preferably and respectively have photosensitivity to the lights having wavelength within respectively different wavelength regions (for example lights of blue, green and red color regions).

In addition to the yellow color developing layer, the magenta color developing layer and the cyan color developing layer, the photosensitive material may have, if desirable, an antihalation layer, an intermediate layer and a colored layer as the non-photosensitive hydrophilic colloid layer to be explained later.

In the course of transportation by the paired transport rollers and/or the belt conveyor as explained in the foregoing, the photosensitive material is very easily charged by coming into contact and being peeled off from the paired transport rollers and/or the belt conveyor, and often results in a transport failure by an electrostatic force. Therefore, in a first embodiment of the invention, for the purpose of reducing a contact area with an article coming into contact at the transportation, reducing the amount of the generated charge and promptly eliminating the charge, the photosensitive material is provided with a back layer, comprising colloidal silica, on a side of the reflective substrate opposite to the silver halide emulsion layers, and a surface (back surface) of such back layer is given a surface resistance of $1.0\times10^{14}\Omega$ or less and/or a charge leak time of 200 seconds or less.

The colloidal silica has an average particle size preferably of 5 to 100 nm, more preferably 10 to 80 nm. The colloidal silica may have a surface coating for example of alumina. Also the colloidal silica is used at a pH within a range from 2.5 to 12. For such colloidal silica, there can be advantageously employed a commercially available silica sol suspension such as Ludox HS or Ludox AS (duPont de Nemeurs) or Snotex 0, Snotex C or Snotex 20 (Nissan Chemical Industries).

The photosensitive material has a surface resistance on the surface of the back layer (back surface) of $1.0\times10^{14}\Omega$ or less but it is preferably $5.0\times10^{13}\Omega$, and the charge leak time on the surface of the back layer (back surface) is 200 seconds or less, but it is preferably 100 seconds or less.

The surface resistance of the back surface is defined by preparing a sample of a length of 10 cm and a width of 6 mm, and, after sufficient humidity assimilation under conditions of 25° C. and 10%RH, and measuring the surface resistance using a Digital High Megohm Meter TR86 11A, manufactured by Takeda Riken Ltd. under the same conditions and under a voltage application of 250 V.

Also the measuring method for the charge leak time of the back surface is defined as a method of executing sufficient humidity assimilation of a silver halide photosensitive material, previously cut into a size of 4×5 cm, under conditions of 25° C. and 10%RH, then applying a voltage of +100 V on the back surface with a Static Honestmeter Type H-0110 under same conditions and measuring a time of attenuation to +75 V with a surface potentiometer TREC Model 360.

For maintaining the charge leak time and/or the surface resistance of the back surface within the aforementioned ranges, there can be advantageously employed a method of introducing, in the back layer in a regulated amount, a water-soluble polymer compound having a carboxyl group or a sulfone group, a metal salt thereof, and/or aqueous dispersion of a hydrophilic organic polymer having a carboxyl group, a sulfone group, a phosphoric acid group, an acyl group or a hydroxyl group.

As the water-soluble polymer compound having a carboxyl group, a copolymer of an unsaturated copolymerizable monomer such as an ethylenic unsaturated monomer having 4 or more carbon atoms such as α-olefin or alkyl vinyl ether having 4 or more carbon atoms, or styrene, and maleic anhydride. And a salt thereof can be obtained by hydrolysis thereof with an alkali such as sodium hydroxide or potassium hydroxide.

The copolymer of the unsaturated copolymerizable monomer with 4 or more carbon atoms and maleic anhydride preferably has a molecular weight of 2000 to 150000, and specific examples include reaction products obtained by hydrolysis of a copolymer of isobutylene, 1-pentene, butyl vinyl ether or styrene and maleic anhydride with an alkali such as sodium hydroxide or potassium hydroxide. In addition, there may also be employed a copolymer of styrene and itaconic acid or crotonic acid, a copolymer of methyl acrylate and citraconic acid or a metal salt thereof.

The water-soluble polymer compound having sulfone group preferably has a molecular weight of 5000 to 1000000, and specific examples include polyethylene sulfonic acid, polyvinylbenzyl sulfonic acid and a sodium or potassium salt thereof. Examples of such metal salt include sodium polyacrylate, and sodium polystyrenesulfonate, and examples of the dispersion of hydrophilic organic polymer include carboxy-modified polyethylene and a salt thereof.

On the other hand, the aqueous dispersion of the hydrophilic organic polymer having a carboxyl group, a sulfone group, a phosphoric acid group, an amine group, an amide group, a hydroxyl group etc. is preferably formed as an emulsion of a block copolymer having a hydrophilic block and a hydrophobic block. In such block copolymer having a hydrophilic block and a hydrophobic block, the hydrophobic block can be a unit of a polymer or a copolymer principally constituted by a hydrocarbon monomer. Such unit of polymer or copolymer principally constituted by a hydrocarbon monomer can be a (co)polymer unit principally formed by a diene type monomer, or a (co)polymer unit obtained by hydrogenation thereof.

Also in the block copolymer, the hydrophilic block can be an aforementioned hydrophobic polymer unit (hydrophobic block) to which a hydrophilic group is introduced. Such hydrophilic group can be a sulfone group, a carboxylic acid (carboxyl) group, a phosphoric acid group, an amine group, an amide group, a hydroxyl group etc. Among these, a sulfone group, a carboxylic acid (carboxyl) group, a phosphoric acid group, an amine group, an amide group or a hydroxyl group are preferable, more preferably a sulfone group or a carboxylic acid (carboxyl) group, and particularly preferably a sulfone group. For example there can be employed a (co)polymer unit principally formed by a hydrocarbon monomer, such as a (co)polymer unit principally formed by a diene type monomer, a (co)polymer unit principally formed by an olefinic monomer such as an aromatic vinyl compound or an olefin, or a (co)polymer unit formed by hydrogenation thereof, in which a hydrophilic group such as a sulfone group is included. In the (co)polymer unit principally constituted by the hydrocarbon monomer, a hydrophilic group such as sulfone group can be included for example by a method of sulfonating such (co)polymer unit thereby introducing a hydrophilic group or by a method of copolymerizing a monomer including a hydrophilic group. Preferable method is a method of introducing a hydrophilic group into a block copolymer (hereinafter called base polymer) including a (co)polymer unit principally formed by a diene type monomer and a (co)polymer unit principally formed by an olefinic monomer such as an aromatic vinyl compound or an olefin, or into a block copolymer formed by hydrogenation of such base polymer.

The diene type monomer, to be employed in the (co)polymer principally formed by a diene type monomer, is preferably a diene type compound having 4 to 12 carbon atoms, more preferably a diene type compound having 4 to 8 carbon atoms and particularly preferably a diene type compound having 4 to 6 carbon atoms. Specific examples of such diene type compound include 1,3-butadiene, 1,2-butadiene, 1,2-pentadiene, 1,3-pentadiene, 2,3-pentadiene, isoprene, 1,2-hexadiene, 1,3-hexadiene, 1,4-hexadiene, 1,5-hexadiene, 2,3-hexadiene, 2,4-hexadiene, 2,3-dimethyl-1,3-butadiene, 2-ethyl-1,3-butadiene, 1,2-heptadiene, 1,3-heptadiene, 1,4-heptadiene, 1,5-heptadiene, 1,6-heptadiene, 2,3-heptadiene, 2,5-heptadiene, 3,4-heptadiene, 3,5-heptadiene, cyclopentadiene, dicyclopentadiene, ethylidenenorbornene and branched aliphatic dienes having 4 to 7 carbon atoms or alicyclic dienes. These compounds may be used singly or in a combination of two or more kinds. Among these, particularly preferred are 1,3-butadiene and isoprene.

Also the (co)polymer unit principally formed by the olefinic monomer is a (co)polymer unit principally formed by an olefinic monomer such as an aromatic vinyl compound or an olefin. The aromatic vinyl compound can be, for example, styrene, α-methylstyrene, o-methylstyrene, p-methylstyrene, m-methylstyrene, or vinylnaphthalene.

Also the olefin can be, for example, ethylene or propylene. Such monomers can be employed singly or in a combination of two or more kinds. Among these, an aromatic vinyl compound is preferred, and styrene is particularly preferred.

Also in the unit of (co)polymer principally formed by a diene type monomer, (co)polymer principally formed by an olefinic monomer such as an aromatic vinyl compound or an olefin, or (co)polymer formed by hydrogenation thereof, another monomer may be used in combination with the aforementioned monomer. Examples of such monomer include a (meth)acrylic acid alkyl ester such as methyl (meth)acrylate, ethyl (meth)acrylate or butyl (meth)acrylate, a mono- or di-carboxylic acid such as (meth)acrylic acid, crotonic acid, maleic acid, fumaric acid or itaconic acid or an anhydride of dicarboxylic acid, a vinylcyan compound such as (meth)acrylonitrile, and an unsaturated compound such as vinyl chloride, vinylidene chloride, vinylmethyl ethyl ketone, vinyl acetate, (meth)acrylamide or glycidyl (meth)acrylate. Such monomers may be employed singly or in a combination of two or more kinds.

In the (co)polymer unit principally constituted by the diene type monomer, there may be copolymerized the aforementioned aromatic vinyl compound or olefin as additional monomer, in an inferior amount. Also in the (co)polymer unit principally constituted by the aromatic vinyl compound, the aforementioned diene type monomer or olefin may be copolymerized in an inferior amount. Also in the (co) polymer unit principally constituted by the olefin, the aforementioned diene type monomer or aromatic vinyl compound may be copolymerized as additional monomer in an inferior amount. In case of employing such additional monomer, the amount of use thereof in each (co)polymer unit is usually 60% or less, preferably 50 mass % or less, more preferably 30 mass % or less, and particularly preferably 20 mass % or less.

By introducing a compound formed by such water-soluble polymer compound having a carboxyl group or a sulfone group, a metal salt thereof, and a dispersion of hydrophilic organic polymer in the back layer, the charge leak time and/or the surface resistance of the back surface can be easily maintained within the aforementioned ranges.

In the transportation by the paired transport rollers and/or the conveyor belt as explained in the foregoing, the photosensitive material tends to be more easily charged in case the paired transport rollers are formed by hard rubber rollers of satisfactory dimensional stability or by metal rollers. Therefore, in order to reduce such easiness of charging, it is preferred to include, in the back layer of the photosensitive material, at least one selected from fluorine type surfactants represented by the following general formulae (I), (II), (III) and (IV). Such fluorine type surfactants may be used singly or in combination of two or more kinds. The fluorine type surfactant represented by the general formula (I) is particularly preferred.

In a second embodiment of the invention, in order to improve the stacking property of the photosensitive material after processing and to reduce the edge stain in a low-replenishment process, the photosensitive material includes at least one selected from fluorine type surfactants represented by the following general formulae (I), (II), (III) and (IV). Such fluorine type surfactant may be included in any layer of the photosensitive material, but, in a preferred embodiment, the fluorine type surfactant is included in the outermost non-photosensitive hydrophilic colloid layer of the photosensitive material. It is also possible to form anew a non-photosensitive hydrophilic colloid layer containing the fluorine type surfactant as a new outermost layer. Such non-photosensitive hydrophilic colloid layer containing the fluorine type surfactant may be formed by coating an aqueous coating composition containing the fluorine type surfactant onto the substrate. The type of the fluorine type surfactant is not particularly restricted as long as the effect of the present invention can be exhibited, and the fluorine type surfactant may be employed singly or in a combination of two or more kinds.The fluorine type surfactant represented by the general formula (I) is particularly preferable.

At first, the fluorine type surfactant of the invention represented by the general formula (I) will be explained in detail:

General formula (I)

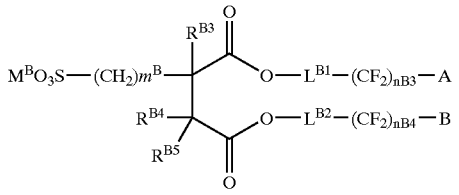

In the general formula (I), $R^{B3}$, $R^{B4}$ and $R^{B5}$ each independently represent a hydrogen atom or a substituent group; A and B each independently represent a fluorine atom or a hydrogen atom; $n^{B3}$ and $n^{B4}$ each independently represent an integer within a range from 4 to 8; $L^{B1}$ and $L^{B2}$ each independently represent a substituted or unsubstituted alkylene group, a substituted or unsubstituted alkyleneoxy group, or a divalent connecting group formed by a combination thereof; $m^B$ represents 0 or 1; and M represents a cation.

In the general formula (I), $R^{B3}$, $R^{B4}$ and $R^{B5}$ each independently represent a hydrogen atom or a substituent group. For such substituent group, following substituent T is applicable.

Each of $R^{B3}$, $R^{B4}$ and $R^{B5}$ is preferably an alkyl group or a hydrogen atom, more preferably an alkyl group having 1 to 12 carbon atoms or a hydrogen atom, further preferably a methyl group or a hydrogen atom, and particularly preferably a hydrogen atom.

In the general formula (I), A and B each independently represent a fluorine atom or a hydrogen atom. Preferably A and B are both fluorine atoms or both hydrogen atoms, and more preferably both fluorine atoms.

In the general formula (I), $n^{B3}$ and $n^{B4}$ each independently represent an integer within a range from 4 to 8. Preferably $n^{B3}$ and $n^{B4}$ represent integers within a range from 4 to 6 and meeting a condition $n^{B3}=n^{B4}$, more preferably integers 4 or 6 satisfying a condition $n^{B3}=n^{B4}$, and further preferably satisfying $n^{B3}=n^{B4}=4$.

In the general formula (I), $m^B$ represents 0 or 1, which are equally preferable.

In the general formula (1), $L^{B1}$ and $L^{B2}$ each independently represent a substituted or unsubstituted alkylene group, a substituted or unsubstituted alkyleneoxy group, or a divalent connecting group formed by a combination thereof. For the substituent, following substituent T is applicable. Each of $L^{B1}$ and $L^{B2}$ preferably has 4 or less carbon atoms, and is preferably an unsubstituted alkylene.

In the general formula (I), M represents a cation, which is preferably a lithium ion, a sodium ion, a potassium ion, or an ammonium ion, more preferably a lithium ion, a sodium ion or a potassium ion, and further preferably a sodium ion.

Among the fluorine type surfactants represented by the general formula (I), a fluorine type surfactant represented by the following general formula (I-I) is preferable:

General formula (I-1)

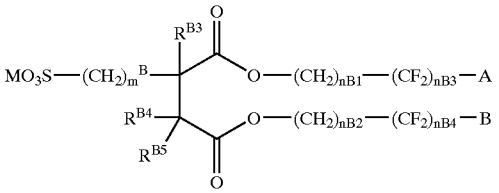

In the general formula (I-I), $R^{B3}$, $R^{B4}$, $R^{B5}$, $n^{B3}$, $n^{B4}$, $m^{B}$, A, B and M have the same meanings and the same preferred ranges as in the general formula (I), and $n^{B1}$ and $n^{B2}$ each independently represent an integer from 1 to 6.

In the general formula (I-I), $n^{B1}$ and $n^{B2}$ each independently represent an integer from 1 to 6. Preferably $n^{B1}$ and $n^{B2}$ represent integers within a range from 1 to 6 and satisfying a condition $n^{B1}=n^{B2}$, more preferably integers 2 or 3 satisfying a condition $n^{B1}=n^{B2}$, and further preferably satisfying $n^{B1}=n^{B2}=2$.

Among the fluorine type surfactants represented by the general formula (I), a fluorine type surfactant represented by the following general formula (I-2) is more preferable:

General formula (I-2)

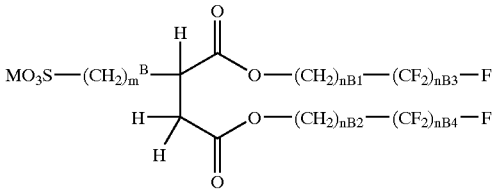

In the general formula (I-2), $n^{B3}$, $n^{B4}$, $m^{B}$, and M have the same meanings and the same preferred ranges as in the general formula (I). Also in the general formula (I-2), $n^{B1}$ and $n^{B2}$ have the same meanings and the same preferred ranges as in the general formula (I-1).

Among the fluorine type surfactants represented by the general formula (I), a fluorine type surfactant represented by the following general formula (I-3) is further preferable:

General formula (I-3)

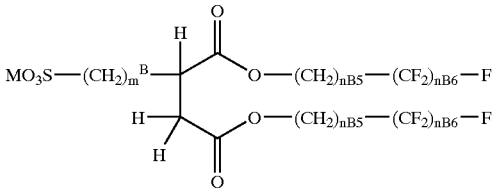

In the general formula (I-3), $n^{B5}$ represents 2 or 3, and $n^{B6}$ represents an integer within a range of 4 to 6. $m^{B}$ represents 0 or 1, both being similarly preferable. M has the same meaning and the same preferred range as M in the general formula (I).

In the following, specific examples of the fluorine type surfactant represented by the general formula (I) are shown, but the present invention is not limited by such specific examples.

FS-101

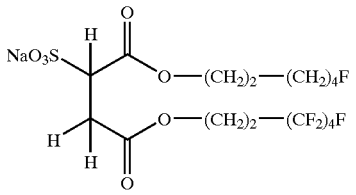

FS-102

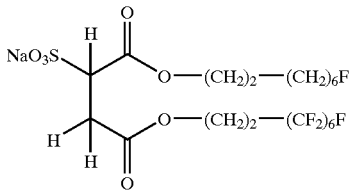

FS-103

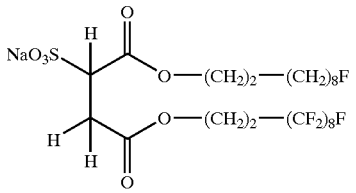

FS-104

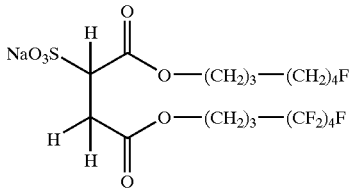

FS-105

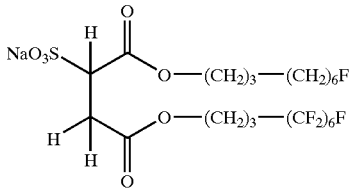

FS-106

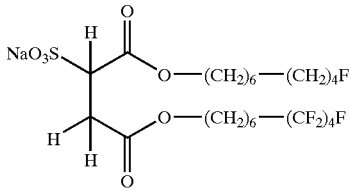

FS-107

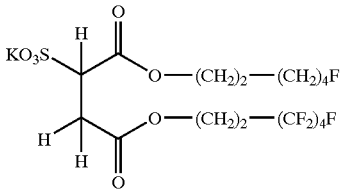

FS-108

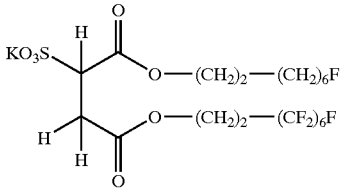

-continued
FS-109
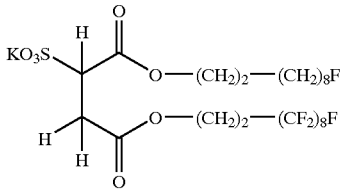
FS-110
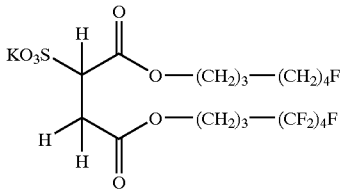
FS-111
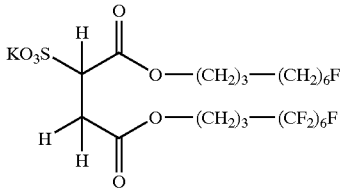
FS-112
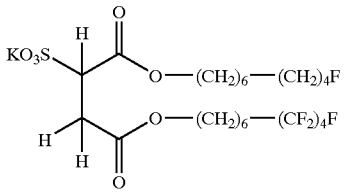
FS-113
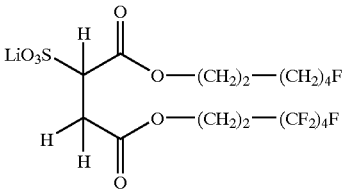
FS-114
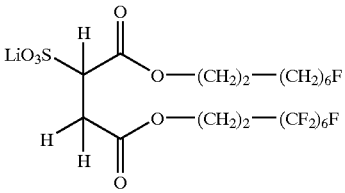
FS-115
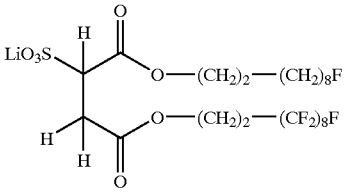
FS-116
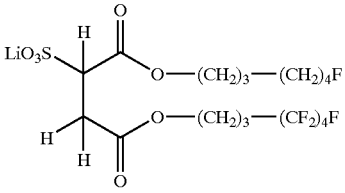
-continued
FS-117
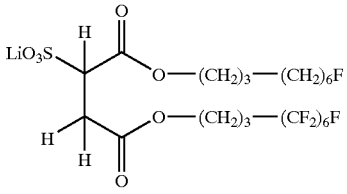
FS-118
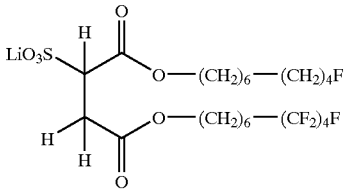
FS-119
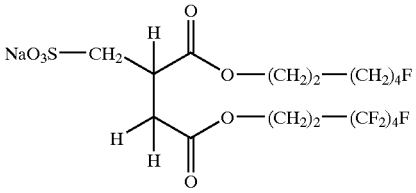
FS-120
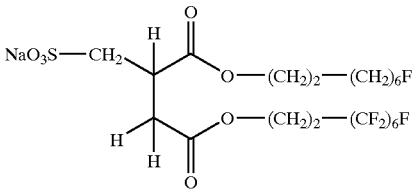
FS-121
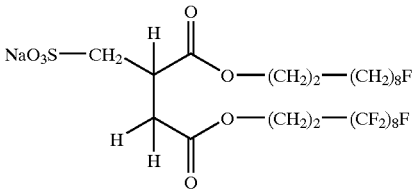
FS-122
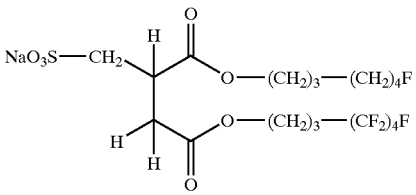
FS-123
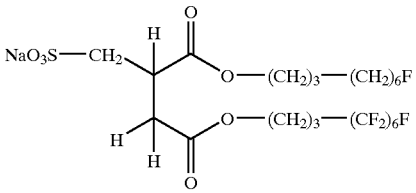
FS-124
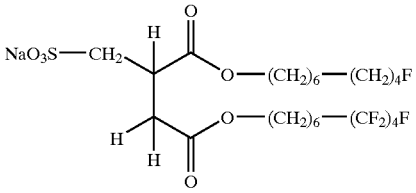

-continued
FS-125
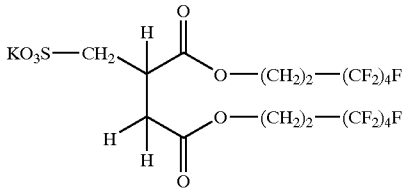
FS-126
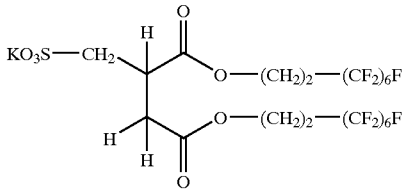
FS-127
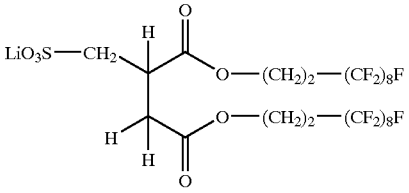
FS-128
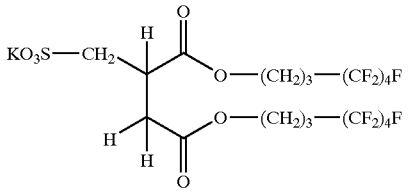
FS-129
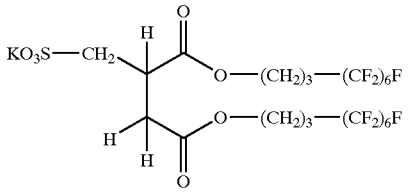
FS-130
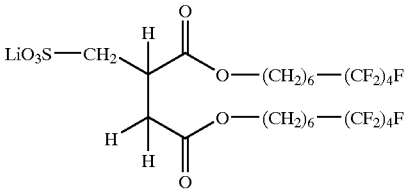
FS-131
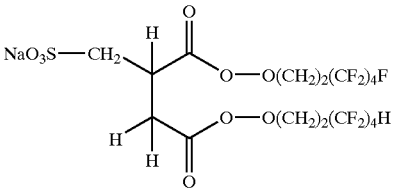
FS-132
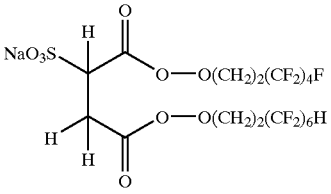
-continued
FS-133
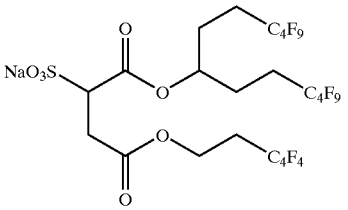
FS-134
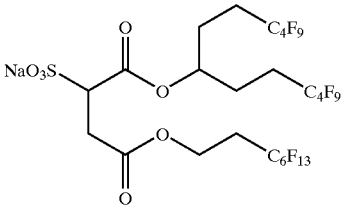
FS-135
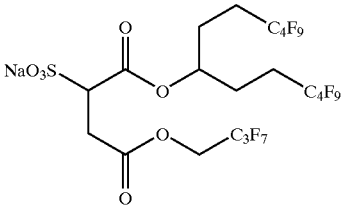
FS-136
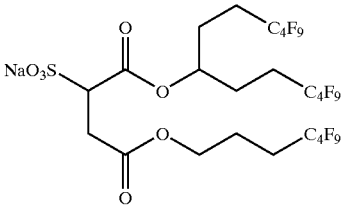
FS-137
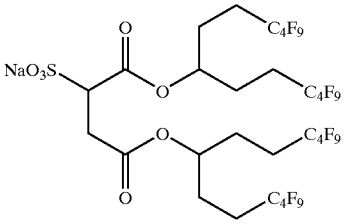
FS-138
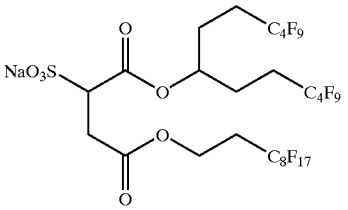
FS-139
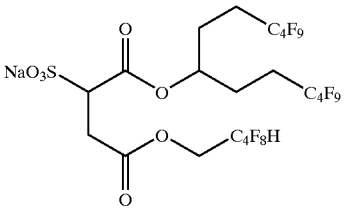
The fluorine type surfactant represented by the general formula (I) can be easily synthesized by combining ordinary esterification reaction and sulfonation reaction. Also the counter cation can be easily converted by an ion exchange resin. In the following, there will be shown examples of representative synthesizing methods, but the present invention is by no means limited by such examples of synthesis.

SYNTHESIS EXAMPLE 1

Synthesis of FS-101

1-1: Synthesis of di(3,3,4,4,5,5,6,6,6-nonafluorohexyl) maleate 90.5 g (0.924 mol) of maleic anhydride, 500 g (1.89 mol) of 3,3,4,4,5,5,6,6,6-nonafluorohexanol and 17.5 g (0.09 mol) of p-toluenesulfonic acid monohydrate were refluxed in 1000 L of toluene for 20 hours while distilling off generated water. Then, after cooling to the room temperature, toluene was added, the organic phase was rinsed with water and the solvent was distilled off under a reduced pressure to obtain 484 g (yield 86%) of the desired product as transparent liquid.

1-2: Synthesis of FS-101

514 g (0.845 mol) of di(3,3,4,4,5,5,6,6,6-nonafluorohexyl)maleate, 91.0 g (0.875 mol) of sodium hydrogensulfite and 250 ml of water-ethanol (1/1 v/v) were refluxed under heating for 6 hours, and extraction was conducted by adding 500 mL of ethyl acetate and 120 mL of saturated aqueous solution of sodium chloride. The organic phase was recovered and subjected to dehydration by adding sodium sulfate. After sodium sulfate was removed by filtration, the filtrate was concentrated, and 2.5 L of acetone were added and heated. After an insoluble substance was eliminated by filtration, the solution was cooled to 0° C. and 2.5 L of acetonitrile were added slowly. A precipitated solid was recovered by filtration, and obtained crystals were dried at 80° C. under a reduced pressure to obtain 478 g (yield 79%) of the desired compound as white crystals.

The obtained desired compound had following $^1$H-NMR data:

$^1$H-NMR (DMSO-$d_6$) δ2.49–2.62 (m, 4H), 2.85–2.99 (m, 2H), 3.68 (dd, 1H), 4.23–4.35 (m, 4H).

In the following, the fluorine type surfactant represented by the general formula (II) will be explained in detail:

General Formula (II)

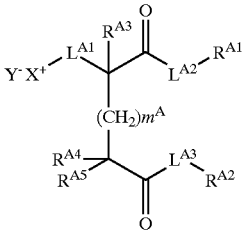

In the general formula (II), $R^{A1}$ and $R^{A2}$ each independently represent a substituted or unsubstituted alkyl group, but at least one of $R^{A1}$ and $R^{A2}$ represents an alkyl group substituted with a fluorine atom; $R^{A3}$, $R^{A4}$ and $R^{A5}$ each independently represent a hydrogen atom or a substituent group; $L^{A1}$, $L^{A2}$ and $L^{A3}$ each independently represent a single bond or a divalent connecting group; $X^+$ represents a cationic substituent; $Y^-$ represents a counter anion but may be dispensed with in case the charge in the molecule becomes 0; and $m^A$ represents 0 or 1.

In the general formula (II), $R^{A1}$ and $R^{A2}$ each independently represent a substituted or unsubstituted alkyl group. The alkyl group has one or more carbon atoms, and may be linear, branched or cyclic. The substituent can be for example a halogen atom, an alkenyl group, an aryl group, an alkoxyl group, a halogen atom other than fluorine, a carboxylic acid ester group, a carbonamide group, a carbamoyl group, an oxycarbonyl group, or a phosphoric acid ester group. However, at least one of $R^{A1}$ and $R^{A2}$ represents an alkyl group substituted with a fluorine atom (hereinafter alkyl group substituted with a fluorine atom being represented as "Rf").

In the general formula (II), Rf is an alkyl group having one or more carbon atoms substituted with at least one fluorine atom. Rf is only required to be substituted with at least one fluorine atom, and may have a straight, branched or cyclic structure. It may be further substituted with a substituent other than the fluorine atom, or may be substituted with fluorine atom only. In Rf, the substituent other than fluorine atom can be, for example, an alkenyl group, an aryl group, an alkoxyl group, a halogen atom other than fluorine, a carboxylic acid ester group, a carbonamide group, a carbamoyl group, an oxycarbonyl group or a phosphoric acid ester group.

In the general formula (II), Rf is preferably a fluorine-substituted alkyl group having 1 to 16 carbon atoms, more preferably having 1 to 12 carbon atoms and further preferably 4 to 10 carbon atoms.

Preferred examples of Rf include:

$-(CH_2)_2-(CF_2)_4F$, $-(CH_2)_2-(CF_2)_6F$, $-(CH_2)_2-(CF_2)_8F$, $-(CH_2)-(CF_2)_4H$, $-(CH_2)-(CF_2)_6H$, $-(CH_2)-(CF_2)_8H$, $-(CH_2)_3-(CF_2)_4F$, $-(CH_2)_6-(CF_2)_4F$, and $-CH(CF_3)CF_3$.

In the general formula (II), Rf is further preferably an alkyl group having 4 to 10 carbon atoms wherein an end thereof is substituted with a trifluoromethyl group, and particularly preferably an all group having 3 to 10 carbon atoms represented by $-(CH_2)_\alpha-(CF_2)_{62}F$ (α representing an integer of 1 to 6 and β representing an integer of 3 to 8). Specific examples include:

$-CH_2-(CF_2)_2F$, $-(CH_2)_6-(CF_2)_4F$, $-(CH_2)_3-(CF_2)_4F$, $-CH_2-(CF_2)_3F$, $-(CH_2)_2-(CF_2)_4F$, $-(CH_2)_3-(CF_2)_4F$, $-(CH_2)_6-(CF_2)_4F$, $-(CH_2)_2-(CF_2)_6F$, $-(CH_2)_3-(CF_2)_6F$, and $-(CH_2)_2-(CF_2)_6F$.

Among these, most preferred are —$(CH_2)_2$—$(CF_2)_4F$, and —$(CH_2)_2$—$(CF_2)_6F$.

In the general formula (II), it is preferred that both $R^{A1}$ and $R^{A2}$ represent Rf.

In the general formula (II), in case $R^{A1}$ and $R^{A2}$ each represents an alkyl group other than Rf, namely an alkyl group not substituted with a fluorine atom, such alkyl group is preferably a substituted or unsubstituted alkyl group having 1 to 24 carbon atoms, and more preferably a substituted or unsubstituted alkyl group having 6 to 24 carbon atoms. Preferred examples of the unsubstituted alkyl group having 6 to 24 carbon atoms include an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group and a cycloheptyl group. Also preferred examples of the substituted alkyl group having 6 to 24 total carbon atoms include a 2-hexenyl group, an oleyl group, a linoleyl group, a linolenyl group, a benzyl group, a β-phenetyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-cholorophenyl)dodecyl group, and a 2-(diphenylphophate) ethyl group.

In the general formula (II), the alkyl group other than Rf represented by each of $R^{A2}$ and $R^{A2}$ is more preferably a substituted or unsubstituted alkyl group having 6 to 18 carbon atoms. Preferred examples of the unsubstituted alkyl group with 6 to 18 carbon atoms include an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, and a 4-tert-butylcyclohexyl group. Also preferred examples of the substituted alkyl group having 6 to 18 total carbon atoms include a phenetyl group, a 6-phenoxyhexyl group, a 12-phenyldodecyl group, an oeyl group, a linoleyl group and a linolenyl group.

In the general formula (II), the alkyl group other than Rf represented by each of $R^{A1}$ and $R^{A2}$ is particularly preferably is an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group or a linolenyl group, and most preferably a linear, branched or cyclic unsubstituted alkyl group having 8 to 16 carbon atoms.

In the general formula (II), $R^{A3}$, $R^{A4}$ and $R^{A5}$ each independently represent a hydrogen atom or a substituent, and for such substituent there can be applied a substituent T to be explained later.

In the general formula (II), each of $R^{A3}$, $R^{A4}$ and $R^{A5}$ preferably represents an alkyl group or a hydrogen atom, more preferably an alkyl group having 1 to 12 carbon atoms or a hydrogen atom, further preferably a methyl group or a hydrogen atom, and particularly preferably a hydrogen atom.

In the general formula (II), $L^{A1}$ and $L^{A2}$ each independently represent a single bond or a divalent connecting group. The single bond or the divalent connecting group is not particularly restricted, but it preferably represents a group formed singly by an arylene group, —O—, —S— or —$NR^{A100}$—($R^{A100}$ represents a hydrogen atom or a substituent; substituent is similar to a substituent T to be explained later; $R^{A100}$ is preferably an alkyl group, an aforementioned Rf or a hydrogen atom, and more preferably a hydrogen atom) or by combining these groups, and more preferably —O—, —S— or —$NR^{A100}$—, further preferably —O— or —$NR^{A100}$—, particularly preferably —O— or —NH— and most preferably —O—.

In the general formula (II), $L^{A3}$ represents a divalent connecting group. The divalent connecting group is not particularly restricted, but it preferably represents a group formed singly by an alkylene group, an arylene group, —C(=O)—, —O—, —S—, —S(=O)—, —$S(=O)_2$— or —$NR^{A100}$ ($R^{A100}$ represents a hydrogen atom or a substituent; substituent is similar to a substituent T to be explained later; $R^{A100}$ is preferably an alkyl group or a hydrogen atom, and more preferably a hydrogen atom) or by combining these groups, and more preferably a group formed singly by an aklylene group having 1 to 12 carbon atoms, an arylene group having 6 to 12 carbon atoms, —C(=O)—, —O—, —S—, —S(=O)—, —$S(=O)_2$— or —$NR^{A100}$—, or by combining these groups. $L^{A3}$ further preferably represents a group formed singly by an aklylene group having 1 to 8 carbon atoms, —C(=O)—, —O—, —S—, —S(=O)—, —$S(=O)_2$— or —$NR^{A100}$—, or by combining these groups, and can be, for example:

—$(CH_2)_2S$—,

—$(CH_2)_2NH$—,

—$(CH_2)_3NH$—,

—$(CH_2)_2C(=O)NH$—,

—$(CH_2)_2SCH_2$—,

—$(CH_2)_2NHCH_2$—, or

—$(CH_2)_3NHCH_2$—.

In the general formula (II), $X^+$ represents a cationic substituent, and, for $X^-$, there is preferred an organic cationic substituent, more preferably a cationic group of nitrogen or phosphor. Further preferably it is a pyridinium cation or an ammonium cation, and more preferably a trialkylammonium cation represented by the following general formula (II-1):

General formula (II-1)

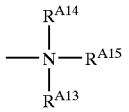

In the general formula (II-1), $R^{A13}$, $A^{A14}$ and $A^{A15}$ each independently represent a substituted or unsubstituted alkyl group. For such substituent, the following substituent T may be applied. Also $R^{A13}$, $A^{A14}$ and $A^{A15}$ may be bonded to each other to form a ring, if possible. Each of $R^{A13}$, $A^{A14}$ and $A^{A15}$ preferably an alkyl group having 1 to 12 carbon atoms, more preferably an alkyl group having 1 to 6 carbon atoms, further preferably a methyl group, an ethyl group or a methylcarboxyl group, and particularly preferably a methyl group.

In the general formula (II-1), $Y^-$ represents a counter anion, which can be an inorganic anion or an organic anion. $Y^-$ may be dispensed with in case the charge becomes 0 in the molecule. An inorganic anion can preferably be, for example, an iodine ion, a bromine ion, or a chlorine ion, and an organic anion can preferably be, for example, a p-toluenesulfonic acid ion or a benzenesulfonic acid ion. For $Y^-$, there is more preferred an iodine ion, a p-toluenesulfonic acid ion or a benzenesulfonic acid ion, and further preferably a p-toluenesulfonic acid.

In the general formula (II), $m^A$ represents 0 or 1, preferably 0.

Among the fluorine type surfactants represented by the general formula (II), there is preferred a fluorine type surfactant represented by the following general formula (11-2):

General formula (II-2)

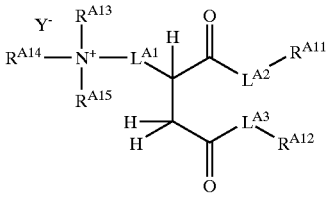

In the general formula (II-2), $R^{A11}$ and $R^{A12}$ each independently represent a substituted or unsubstituted alkyl group, but at least one of $R^{A11}$ and $R^{A12}$ represents an alkyl group substituted with a fluorine atom, and total number of atoms in $R^{A11}$ and $R^{A12}$ is 19 or less; $L^{A12}$ and $L^{A13}$ each independently represent —O—, —S— or —$NR^{100}$ wherein $R^{100}$ represents a hydrogen atom or a substituent; $L^{A1}$ represents a single bond or a divalent connecting group. $L^{A1}$ and $Y^-$ have the same meanings and the same preferred ranges as in the foregoing general formula (II). $R^{A13}$, $A^{A14}$ and $A^{A15}$ have the same meanings and the same preferred ranges as in the foregoing general formula (II-1).

In the general formula (II-2), $L^{A2}$ and $L^{A3}$ each independently represent —O—, —S— or —$NR^{100}$— ($R^{100}$ represents a hydrogen atom or a substituent; substituent can be a substituent T to be explained later; $R^{100}$ is preferably an alkyl group, an aforementioned Rf or a hydrogen atom, and more preferably a hydrogen atom). $L^{A2}$ and $L^{A3}$ are more preferably —O— or —NH— and further preferably —O—.

In the general formula (II-2), $R^{A11}$ and $R^{A12}$ respectively have the same meanings and the same preferred ranges as $R^{A1}$ and $R^{A2}$ in the general formula (II). A total number of carbon atoms in $R^{A11}$ and $R^{A12}$ is 19 or less.

Among the fluorine type surfactants represented by the general formula (II-2), there is more preferred a fluorine type surfactant represented by the following general formula (II-3):

General formula (II-3)

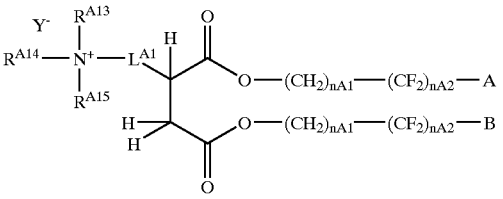

In the general formula (II-3), $R^{A13}$, $A^{A14}$, $A^{A15}$, $L^{A1}$ and $Y^-$ have the same meanings and the same preferred ranges as in the foregoing general formulae (II) and (II-1). A and B each independently represent a fluorine atom or a hydrogen atom. It is preferred that both A and B represent fluorine atoms or hydrogen atoms, and more preferably fluorine atoms.

In the general formula (II-3), $n^{A1}$ represents an integer within a range of 1 to 6, and $n^{A2}$ represents an integer within a range of 3 to 8.

Among the fluorine type surfactants represented by the general formula (II), there is further preferred a fluorine type surfactant represented by the following general formula (II-4):

General formula (II-4)

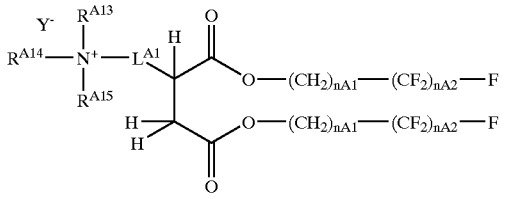

In the general formula (II-4), $n^{A1}$ represents an integer within a range of 1 to 6, and $n^{A2}$ represents an integer within a range of 3 to 8, but $2(n^{A1}+n^{A2})$ is equal to or less than 19. $R^{A13}$, $A^{A14}$, $A^{A15}$, $L^{A1}$ and $Y^-$ have the same meanings and the same preferred ranges as in the foregoing general formulae (II) and (II-1).

In the general formula (II-4), $n^{A1}$ represents an integer within a range of 1 to 6, preferably 1 to 3, further preferably 2 or 3 and most preferably 2. Also $n^{A2}$ represents an integer within a range of 3 to 8, more preferably 3 to 6, and further preferably 4 to 6. In a preferred combination of $n^{A1}$ and $n^{A2}$, $n^{A1}$ is 2 or 3 and $n^{A2}$ is 4 or 6.

In the following there will be shown specific examples of the fluorine type surfactant represented by the general formula (II), but the present invention is not limited at all by such examples. In the presentation of the following example compounds, an alkyl group or a perfluoroalkyl group has a linear chain structure unless specified otherwise. Also in the presentation, an abbreviation 2EH means 2-ethylhexyl and 2BO means 2-butyloctyl.

FS-201

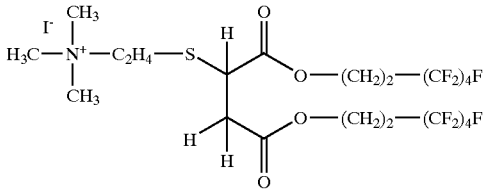

FS-202

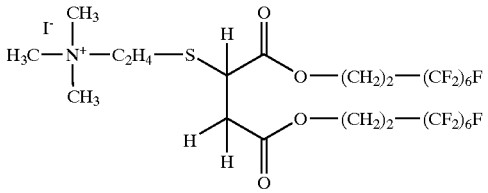

FS-203

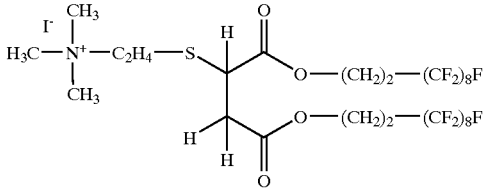

-continued
FS-204
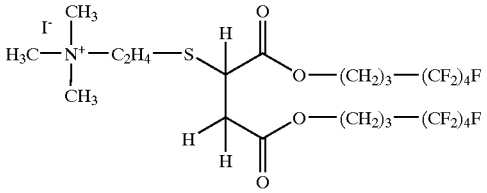
FS-205
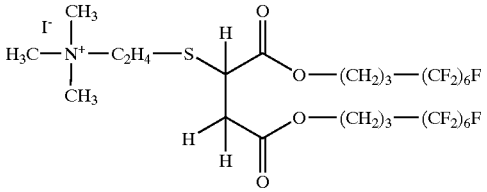
FS-206
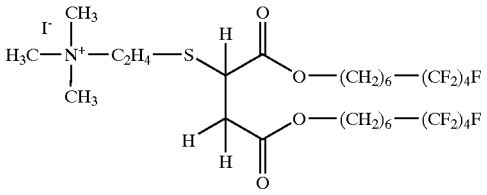
FS-207
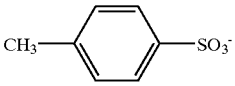
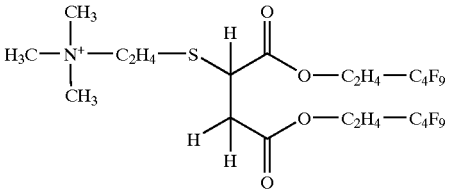
FS-208
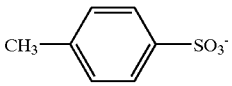
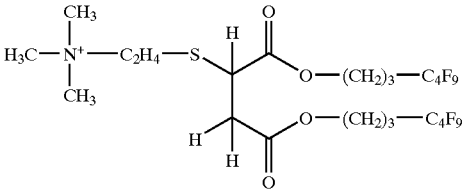
FS-209
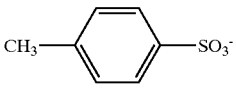
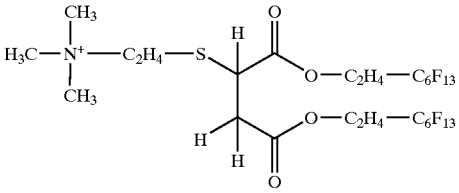
-continued
FS-210
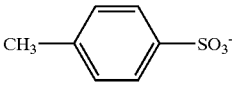
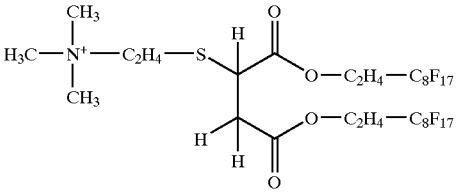
FS-211
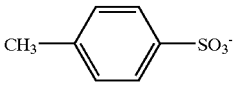
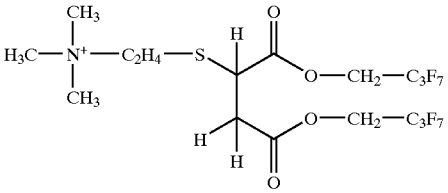
FS-212
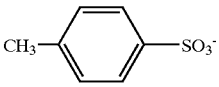
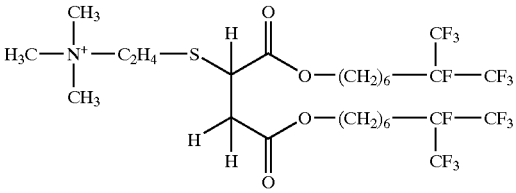
FS-213
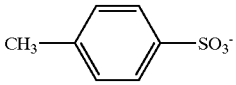
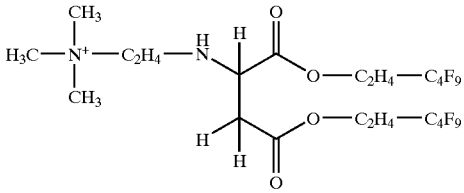
FS-214
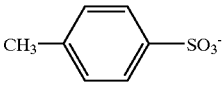
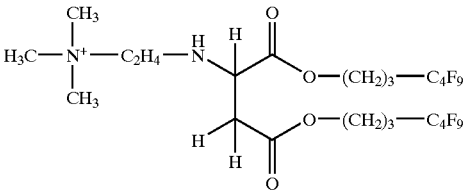

-continued
FS-215
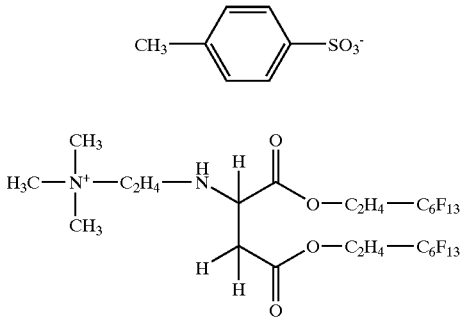
FS-216
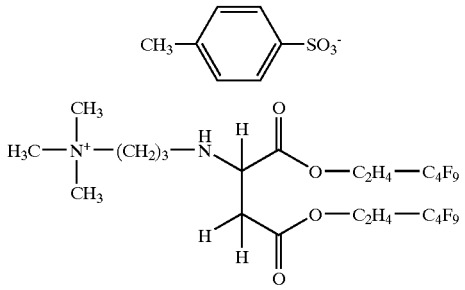
FS-217
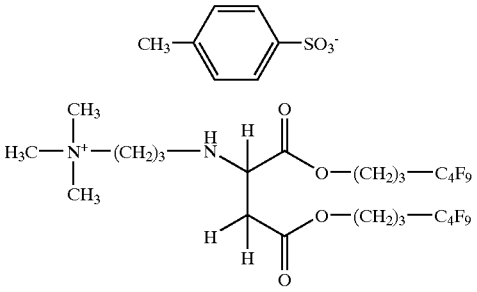
FS-218
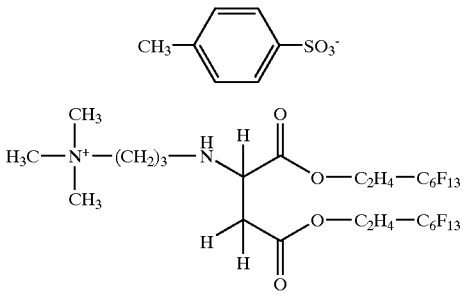
FS-219
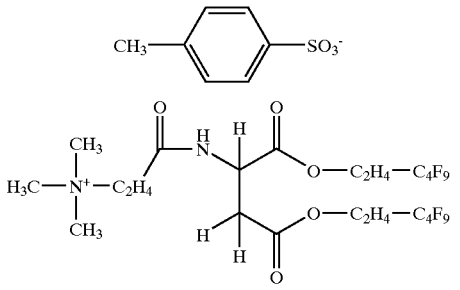
-continued
FS-220
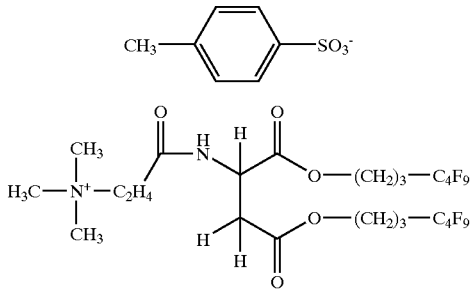
FS-221
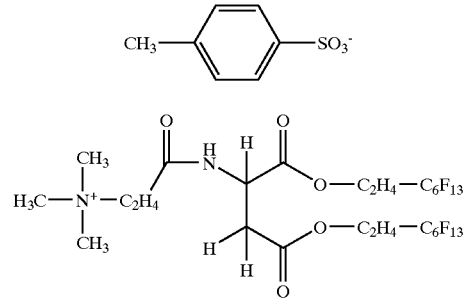
FS-222
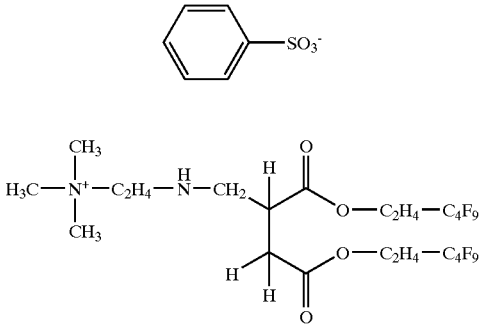
FS-223
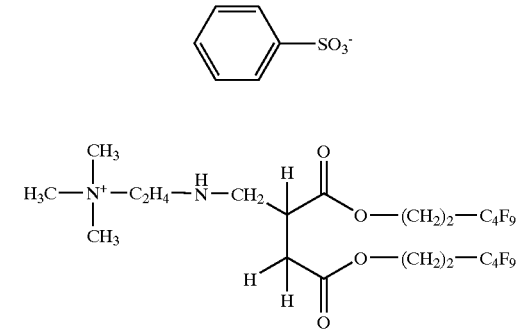
FS-224
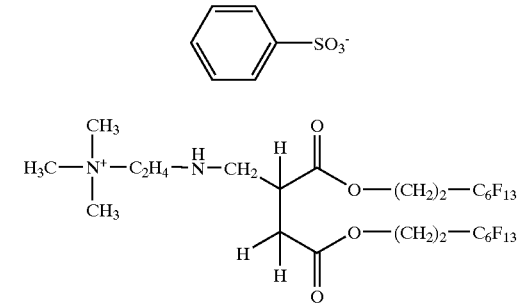

-continued
FS-225
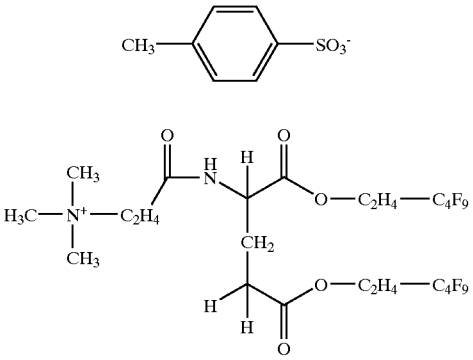
FS-226
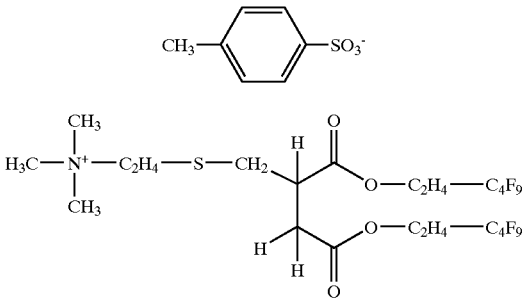
FS-227
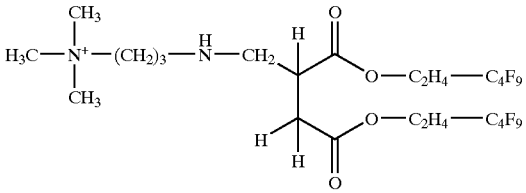
FS-228
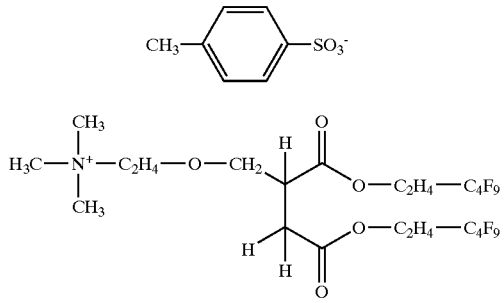
FS-229
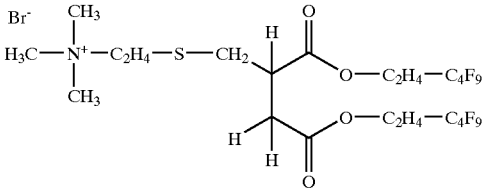
-continued
FS-230
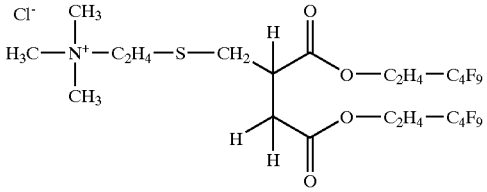
FS-231
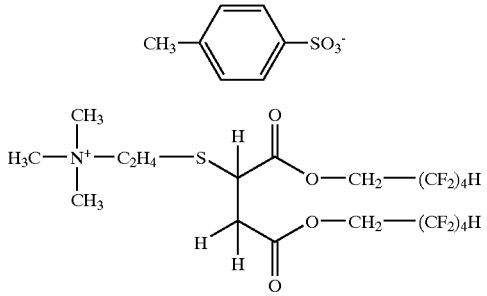
FS-232
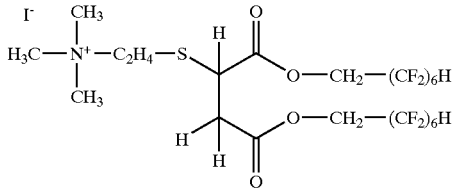
FS-233
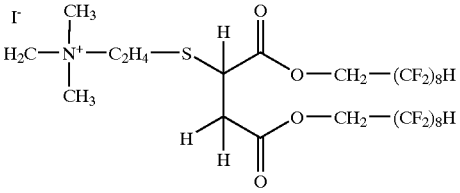
FS-234
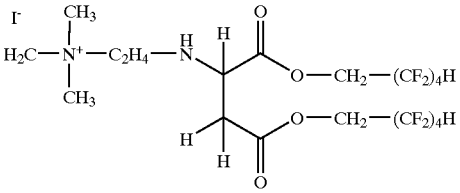
FS-235
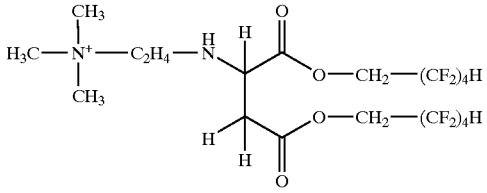

-continued
FS-236
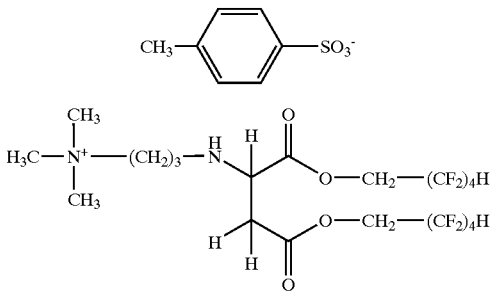
FS-237
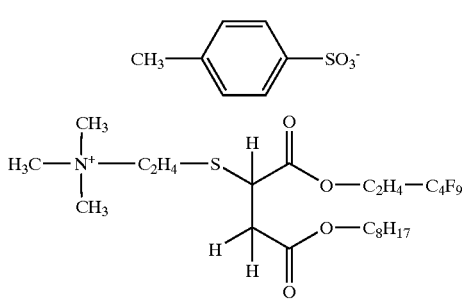
FS-238
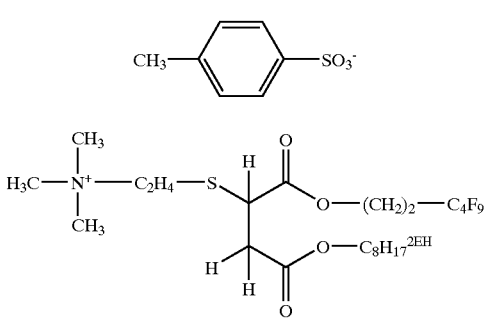
FS-239
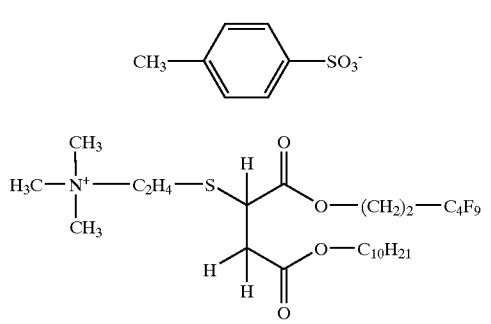
FS-240
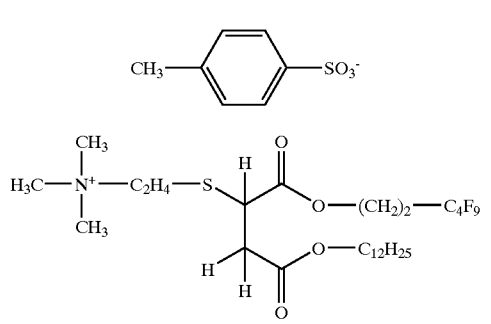
-continued
FS-241
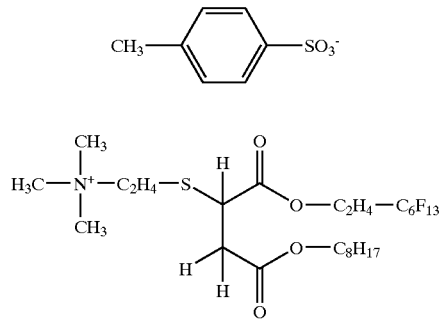
FS-242
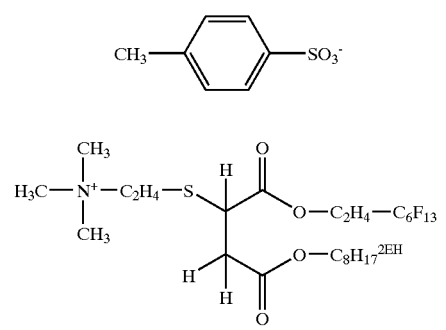
FS-243
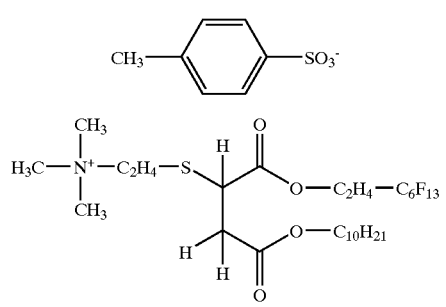
FS-244
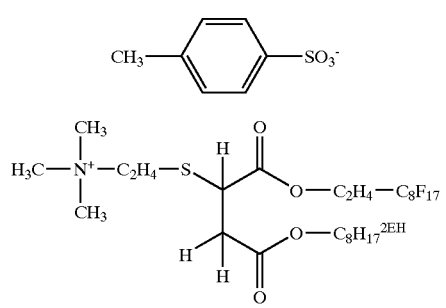
FS-245
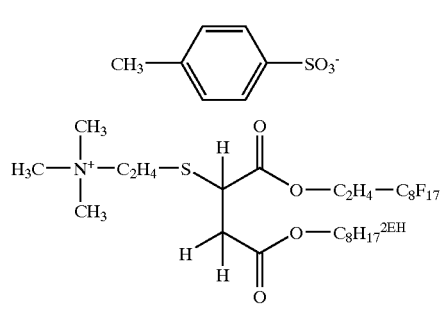

-continued
FS-246
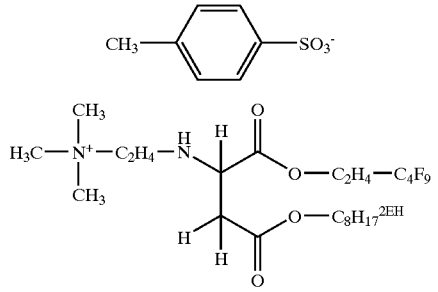
FS-247
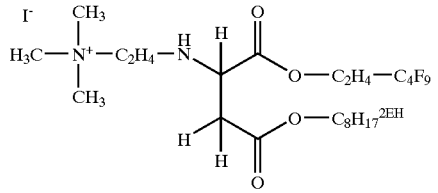
FS-248
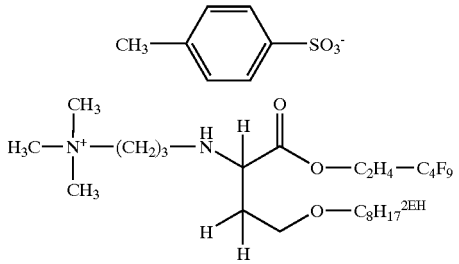
FS-249
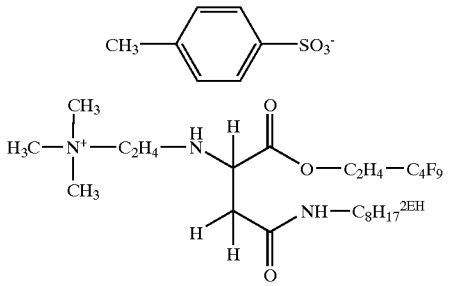
FS-250
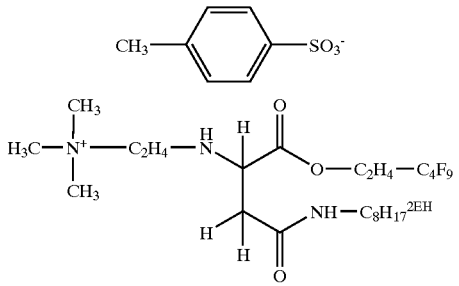
FS-251
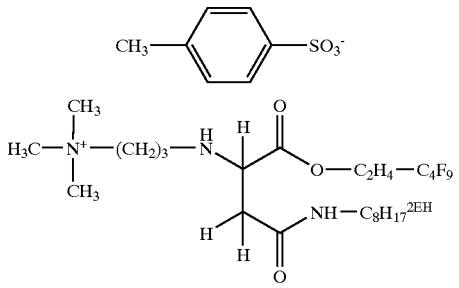
-continued
FS-252
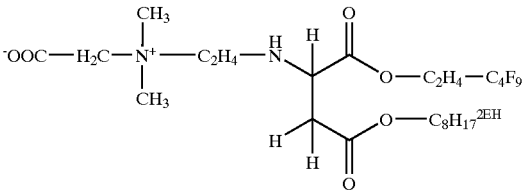
FS-253
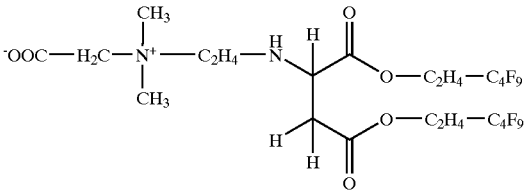
FS-254
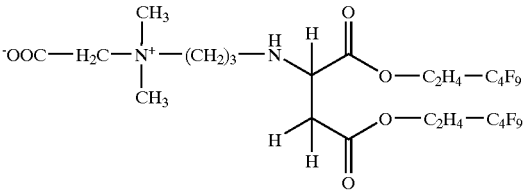
FS-255
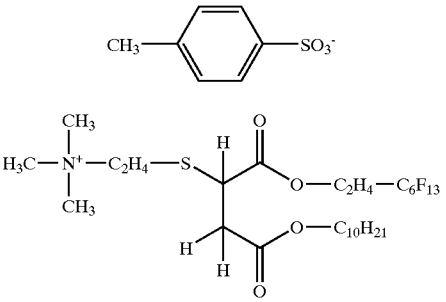
FS-256
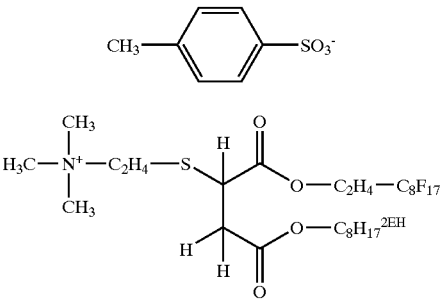
FS-257
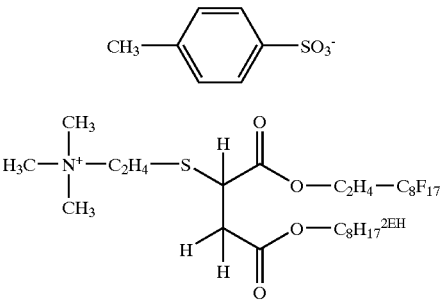

-continued
FS-258
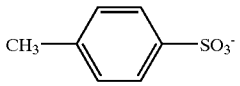
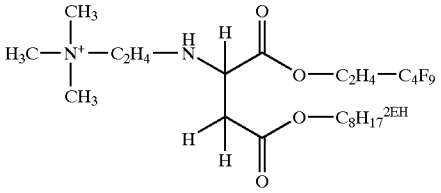
FS-259
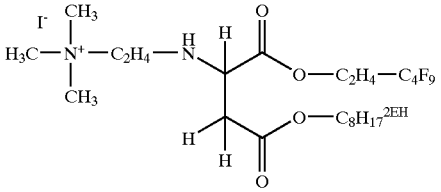
FS-260
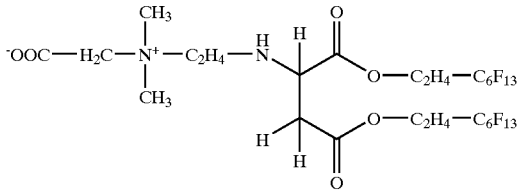
FS-261
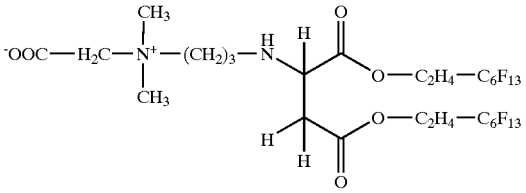
FS-262
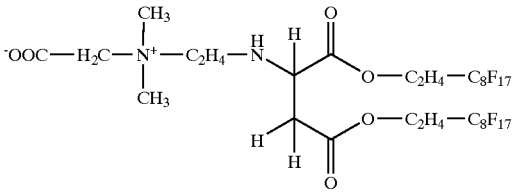
FS-263
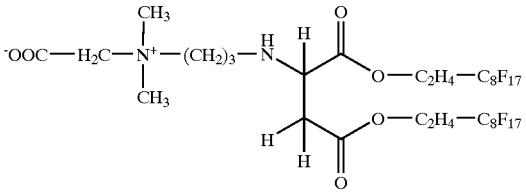
FS-264
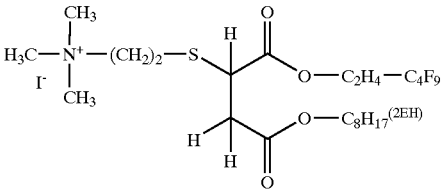
-continued
FS-265
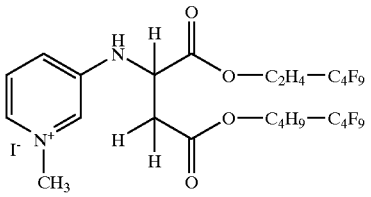
FS-266
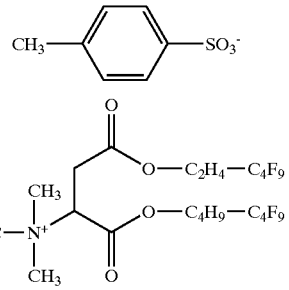
FS-267
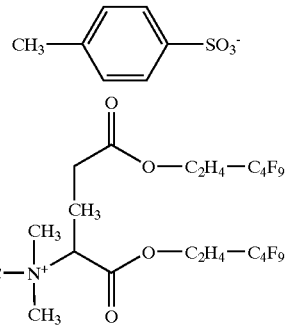
FS-268
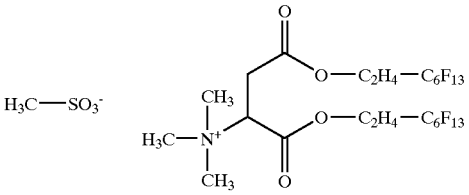
FS-269
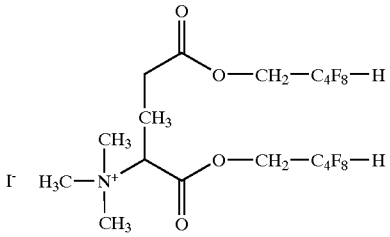
FS-270
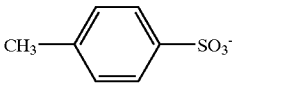
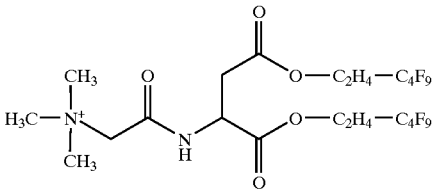

-continued

FS-271

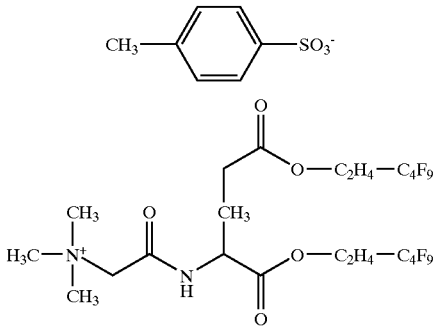

FS-272

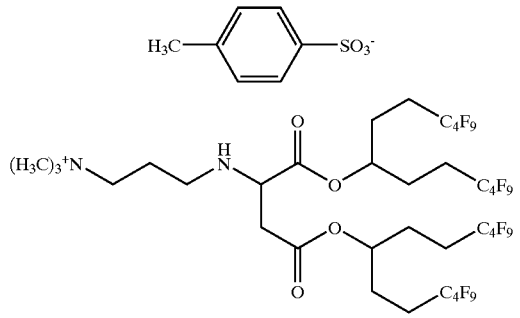

FS-273

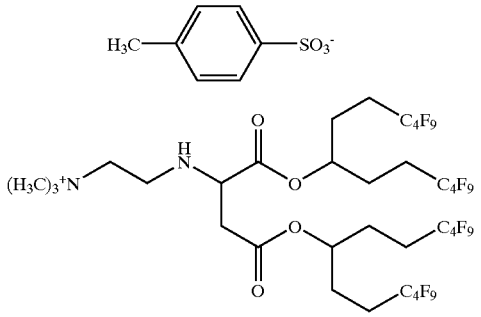

FS-274

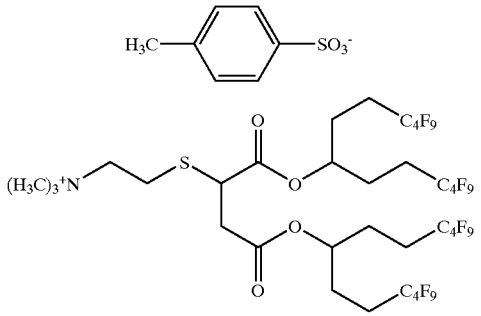

FS-275

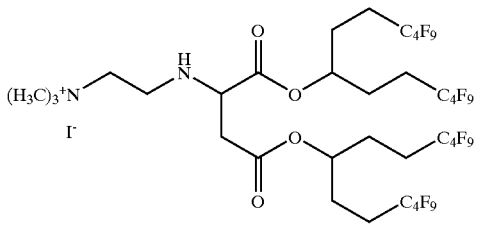

-continued

FS-276

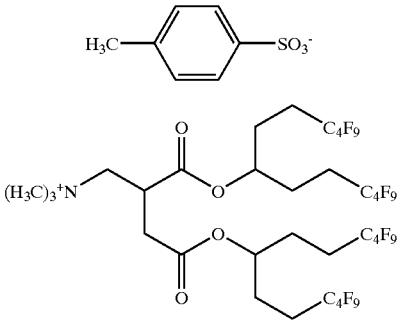

The fluorine type surfactants represented by the general formula (II) can be synthesized from a fumaric acid derivative, a maleic acid derivative, an itaconic acid derivative, a glutamic acid derivative, an aspartic acid derivative etc. For example, in case of employing a fumaric acid derivative, a maleic acid derivative or an itaconic acid derivative as a starting material, synthesis can be achieved by executing a Michael's addition reaction to a double bond thereof with a nucleophilic reagent, and then by forming a cation with an alkylation reagent.

In the following there will be shown examples of synthesis of the fluorine type surfactant represented by the general formula (II), but the present invention is by no means limited by such examples.

SYNTHESIS EXAMPLE 2

Synthesis of FS-213

2-1: Synthesis of 1,4-di(3,3,4,4,5,5,6,6,6-nonafluorohexyl) 2-(2-(N,N-dimethylamino)ethylamino)succinate 500 g (0.82 mol) of 1,4-di(3,3,4,4,5,5,6,6,6-nonafluorohexyl)succinate, 79.5 g (0.90 mol) of N,N-dimethylaminoethylamine and 11.3 g (0.08 mol) of potassium carbonate were dissolved in 500 mL of acetonitrile, and were refluxed under heating for 45 minutes. Then the liquid after reaction was transferred to a separating funnel, and the 2 L of ethyl acetate were added. After washing an organic phase with aqueous solution (1.5 L) of sodium chloride, the organic phase was recovered and the organic solvent was distilled off under reduced pressure to obtain 453 g (yield 79%) of the desired compound as pale yellow oil.

2-2: Synthesis of FS-213

380 g (0.55 mol) of the aforementioned compound, 101.6 g (0.55 mmol) of methyl p-toluenesulfonate and 1500 mL of ethyl acetate were refluxed for 2 hours under heating, then an insoluble substance was filtered off and the filtrate was cooled under agitation in an iced bath. Crystals precipitated after a while from the filtrate. The obtained crystals were recovered by filtration, washed with ethyl acetate and dried under a reduced pressure for 2 hours at 80° C. 300 g of the desired compound was obtained (yield 62%) as a colorless transparent solid.

The obtained desired compound showed following $^1$H-NMR data:

$^1$H-NMR(DMSO-$d_6$): δ2.50(s, 3H), 2.61–2.73(br, 8H), 3.07(s, 9H), 3.33(m, 2H), 3.66(m, 1H), 4.30–4.40(m, 4H), 7.11(d, 2H), 7.48(d,2H).

In the following, the fluorine type surfactant represented by the following general formula (III) will be explained in detail:

General formula (III)

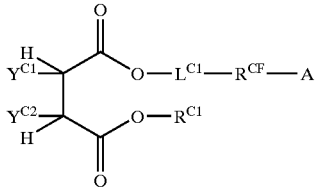

In the general formula (III), $R^{C1}$ represents a substituted or unsubstituted alkyl group; $R^{CF}$ represents a perfluoroalkylene group; A represents a hydrogen atom or a fluorine atom; $L^{C1}$ represents a substituted or unsubstituted alkylene group, a substituted or unsubstituted alkyleneoxy group or a divalent connecting group formed by a combination thereof; one of $Y^{C1}$ and $Y^{C2}$ represents a hydrogen atom while the other represents —$L^{C2}$—$SO_3M$, in which M represents a cation.

In the general formula (III), $R^{C1}$ represents a substituted or unsubstituted alkyl group. The substituted or unsubstituted alkyl group may be linear, branched or cyclic. For the substituent, a substituent T to be explained later may be applied. The substituent can preferably be for example an alkenyl group, an aryl group, an alkoxyl group, a halogen atom (preferable C1), a carboxylic acid ester group, a carbonamide group, a carbamoyl group, an oxycarbonyl group, or a phosphoric acid ester group.

In the general formula (III), $R^{C1}$ is preferably an unsubstituted alkyl group, more preferably an unsubstituted alkyl group having 2 to 24 carbon atoms, further preferably an unsubstituted alkyl group having 4 to 20 carbon atoms, and particularly preferably an unsubstituted alkyl group with 6 to 20 carbon atoms.

In the general formula (III), $R^{CF}$ represents a perfluoroalkylene group. Here, a perfluoroalkylene group means an alkylene group wherein all the hydrogen atoms are substituted by fluorine atoms. The perfluoroalkylene group may have a linear, branched or cyclic structure. $R^{CF}$ preferably has 1 to 10 carbon atoms, more preferably 1 to 8 carbon atoms.

In the general formula (III), A represents a hydrogen atom or a fluorine atom, and preferably a fluorine atom.

In the general formula (III), $L^{C1}$ represents a substituted or unsubstituted alkylene group, a substituted or unsubstituted alkyleneoxy group or a divalent connecting group formed by a combination thereof. A preferred range of the substituent is same as that for $R^{C1}$. $L^{C1}$ preferably has 4 or less carbon atoms, and is preferably a unsubstituted alkylene.

In the general formula (III), one of $Y^{C1}$ and $Y^{C2}$ represents a hydrogen atom while the other represents —$L^{C2}$—$SO_3M$; and M represents a cation. A cation represented by M can preferably be, for example an alkali metal ion (such as lithium ion, sodium ion or potassium ion), an alkali earth metal ion (such as barium ion, or calcium ion), or an ammonium ion. Among these, more preferred is lithium ion, sodium ion, potassium ion or ammonium ion, further preferably lithium ion, sodium ion or potassium ion, and such ion can be suitably selected in accordance with a total number of carbon atoms of the compound of the general formula (III) and degree of branching of the substituent and the alkyl group. In case a total number of the carbon atoms of $R^{C1}$, $RC^2$ and $RC^3$ is 16 or more, lithium ion is excellent in attaining solubility (particularly to water) and charge preventing ability or coating uniformity at the same time.

In the general formula (III), $L^{C2}$ represents a single bond or a substituted or unsubstituted alkylene group. A preferred range of the substituent is similar to that of $R^{C1}$.

$L^{C2}$ is preferably a single bond or an alkylene group with 2 or less carbon atoms, more preferably a single bond or a unsubstituted alkylene group, and further preferably a single bond or a methylene group. Particularly preferably $L^{C2}$ is a single bond.

Among the fluorine type surfactants represented by the general formula (III), there is preferred a fluorine type surfactant represented by the following general formula (III-1):

General formula (III-1)

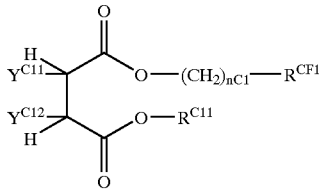

In the general formula (III-1), $R^{C11}$ represents a substituted or unsubstituted alkyl group having 6 or more total carbon atoms; $R^{CF1}$ represents a perfluoroalkylene group having 6 or less total carbon atoms; one of $Y^{C11}$ and $Y^{C12}$ represents a hydrogen atom while the other represents $SO_3M^C$; $M^C$ represents a cation; and $n^{C1}$ represents an integer equal to or larger than 1.

In the general formula (III-1), $R^{C11}$ represents a substituted or unsubstituted alkyl group having 6 or more carbon atoms in total. However $R^{C11}$ cannot be an alkyl group substituted with a fluorine atom. The substituted or unsubstituted alkyl group represented by $R^{C11}$ may be linear, branched or cyclic. The substituent can be, for example, an alkenyl group, an aryl group, an alkoxyl group, a halogen atom other than fluorine, a carboxylic acid ester group, a carbonamide group, a carbamoyl group, an oxycarbonyl group, or a phosphoric acid ester group.

In the general formula (III-1), the substituted or unsubstituted alkyl group represented by $R^{C11}$ preferably has 6 to 24 total carbon atoms. Preferred examples of the unsubstituted alkyl group having 6 to 24 carbon atoms include an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group and a cycloheptyl group. Also preferred examples of the substituted alkyl group having 6 to 24 carbon atoms in total, including carbon atoms of the substituent, include a 2-hexenyl group, an oleyl group, a linoleyl group, a linolenyl group, a benzyl group, a β-phenetyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-cholorophenyl)dodecyl group, and a 2-(diphenylphophate) ethyl group.

In the general formula (III-1), the substituted or unsubstituted alkyl group represented by each of RCII more preferably has 6 to 18 carbon atoms in total. Preferred examples of the unsubstituted alkyl group having 6 to 18 carbon atoms include an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, and a 4-tert-butylcyclohexyl group. Also preferred examples of the substituted alkyl group having 6 to 18 carbon atoms in total, including carbon atoms in the substituent, include a phenetyl group, a 6-phenoxyhexyl group, a 12-phenyldodecyl group, an oleyl group, a linoleyl group and a linolenyl group. Among these, $R^{C11}$is particularly preferably an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group or a linolenyl group, and particularly preferably a linear, branched or cyclic unsubstituted alkyl group having 8 to 16 carbon atoms.

In the general formula (III-1), $R^{CF1}$ represents a perfluoroalkylene group having 6 or less carbon atoms. Here, a perfluoroalkylene group means an alkylene group wherein all the hydrogen atoms are substituted by fluorine atoms. The alkyl group in the perfluoroalkylene group may have a linear, branched or cyclic structure. Examples of the perfluoroalkyl group represented by $R^{CF1}$ include, for example, a trifluoromethyl group, a pentafluoroethyl group, a heptafluoro-n-propyl group, a heptafluoroisopropyl group, a nonafluoro-n-butyl group, an undecafluoro-n-pentyl group, a tridecafluoro-n-hexyl group, and undecafluorocyclohexyl group. Among these, a perfluoroalkyl group having 2 to 4 carbon atoms (for example, pentafluoroethyl group, heptafluoro-n-propyl group, heptafluoroisopropyl group or nonafluoro-n-butyl group) is preferred, and particularly preferred is heptafluoro-n-propyl group or nonafluoro-n-butyl group.

In the general formula (III-1), $n^{C1}$ represents an integer equal to or larger than 1. It is preferably within a range from 1 to 4, and particularly preferably 1 or 2.

Also as to a combination of $n^{C1}$ and $R^{CF1}$, it is more preferred that $R^{CF1}$ is a heptafluoro-n-propyl group or a nonafluoro-n-butyl group in case $n^{C1}$=1, and is a nonafluoro-n-butyl group in case $n^{C1}$=2.

In the general formula (III-1), one of $Y^{C11}$ and $Y^{C12}$ represents a hydrogen atom while the other represents $SO_3M^C$; and $M^C$ represents a cation. A cation represented by $M^C$ can preferably be, for example, an alkali metal ion (such as lithium ion, sodium ion or potassium ion), an alkali earth metal ion (such as barium ion, or calcium ion), or an ammonium ion. Among these, particularly preferred is lithium ion, sodium ion, potassium ion or ammonium ion, and most preferred is sodium ion.

In the following there will be shown specific examples of the fluorine type surfactant represented by the general formula (III), but the present invention is not limited at all by such examples.

FS-301

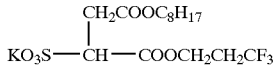

FS-302

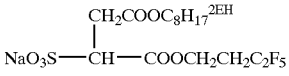

FS-303

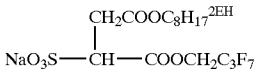

FS-304

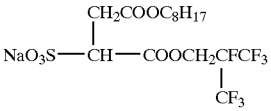

-continued

FS-305

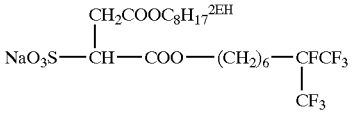

FS-306

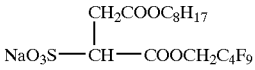

FS-307

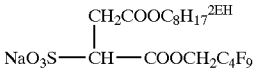

FS-308

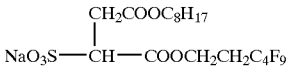

FS-309

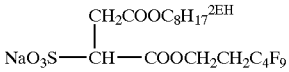

FS-310

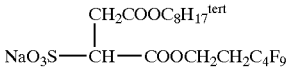

FS-311

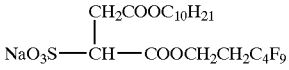

FS-312

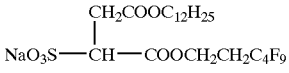

FS-313

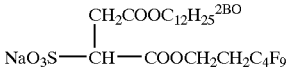

FS-314

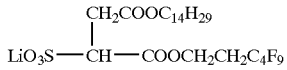

FS-315

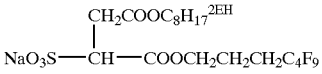

FS-316

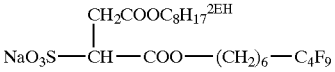

FS-317

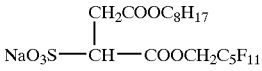

FS-318

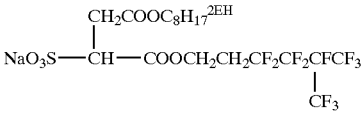

FS-319

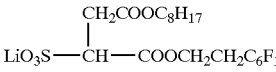

FS-320

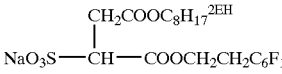

FS-321

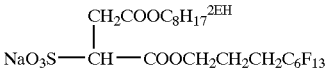

FS-322

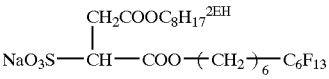

-continued

FS-323

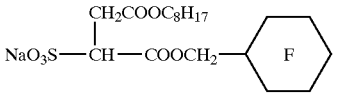

FS-324

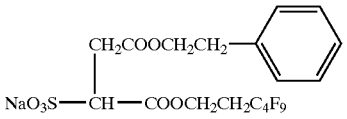

FS-325

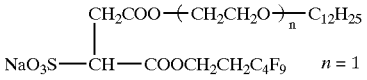

FS-326

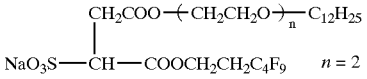

FS-327

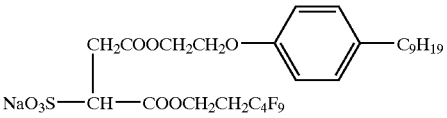

FS-328

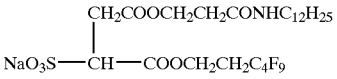

FS-329

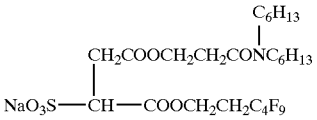

FS-330

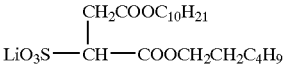

FS-331

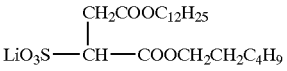

FS-332

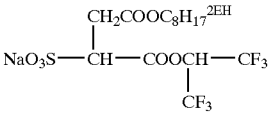

FS-333

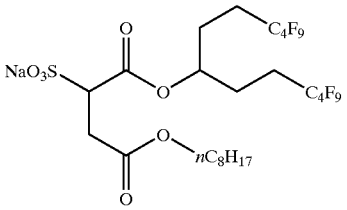

FS-334

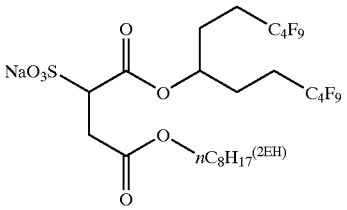

-continued

FS-335

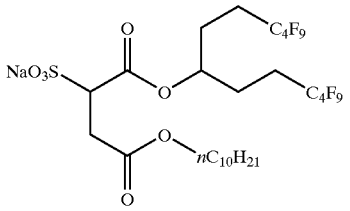

The fluorine type surfactant represented by the general formula (III) can be easily synthesized by starting from ordinary maleic anhydride or the like and executing a monoesterification, an acid halogenation, an esterification and a sulfonation. Also the counter cation can be easily changed with an ion exchange resin.

In the following, there will be shown representative examples of the synthesis of the fluorine type surfactant represented by the general formula (III), however the present invention is by no means limited by such examples.

SYNTHESIS EXAMPLE 3

Synthesis of FS-302

3-1: Synthesis of (2-ethylhexyl)maleate chloride

To 4.1 g (20 mmol.) of diphosphor pentoxide, 4.5 g (20 mmol.) of mono(2-ethylhexyl)maleate (manufactured by Aldrich) was slowly added dropwise while keeping th temperature at or less than 30° C. After the dropwise addition, the mixture was agitated for 1 hour at room temperature, then heated to 60° C., maintained under a reduced pressure with an aspirator to distill off generated phosphor oxichloride, to obtain 4.5 g (yield 92%) of (2-ethylhexyl)maleate chloride as brown oil.

3-2: Synthesis of mono-2-ethylhexyl mono-2,2,3,3,4,4,4-heptafluorobutyl maleate 66.8 g (0.334 moles) of 2,2,3,3,4,4,4-heptafluorobutanol and 29.6 mL (0.367 moles) of pyridine were dissolved in 180 mL of acetonitrile, then the solution was cooled in an ice bath and 90.6 g (0.367 moles) of 2-ethylhexyl maleate chloride were added dropwise keeping an internal temperature at 20° C. or lower. After the dropwise addition, the mixture was agitated for 1 hour at the room temperature. Then 1000 mL of ethyl acetate were added, and, after the organic phase was washed with a 1 mol/L aqueous solution of hydrochloric acid and a saturated aqueous solution of sodium chloride, the organic phase was recovered, then subjected to distilling off of the organic solvent under a reduced pressure, and a purification by silica gel column chromatography (hexane/chloroform: 10/0-7/3 v/v) to obtain 80.3 g (yield 59%) of the desired compound as colorless transparent oil.

3-3: Synthesis of sodium mono-2-ethylhexykl mono-2,2,3,3,4,4,4-heptafluorobutyl sulfosuccinate (FS-302)

80.3 g (0.196 moles) of mono-2-ethylhexyl mono-2,2,3,3,4,4,4-heptafluorobutyl maleate, 20.4 g (0.196 moles) of sodium hydrogensulfite and 80 mL of water-ethanol (1/1 v/v) were mixed and refluxed under heating for 10 hours. Then 1000 mL of ethyl acetate were added, and, after the organic phase was washed with a saturated aqueous solution of sodium chloride, the organic phase was recovered, then subjected to distilling off of the organic solvent under a reduced pressure, and a purification by silica gel column chromatography (chloform/methanol: 9/1 v/v). After the recovered organic phase was washed with a saturated aqueous solution of sodium chloride, the organic solvent was distilled off under a reduced pressure to obtain 32 g yield 32%) of the desired compound as colorless transparent solid.

The obtained desired compound showed following $^1$H-NMR data:

$^1$H-NMR(DMSO-d): 80.81–0.87(m, 6H), 1.24(m, 8H), 1.50(br, 1H), 2.77–2.99(m, 2H), 3.63–3.71(m, 1H), 3.86–3.98(m, 3H), 4.62–4.84(br, 1H).

SYNTHESIS EXAMPLE 4

Synthesis of FS-312

4-1: Synthesis of monodecyl mono-3,3,4,4,5,5,6,6,6-nanofluorohexyl maleate 164.6 g (623 mmol) of 3,3,4,4,5,5,6,6,6-nonafluorohexanol and 49.3 mL (623 mmol) of pyridine were dissolved in 280 mL of chloroform, then the solution was cooled in an ice bath and 155.8 g (566 mmol) of monododecyl maleate chloride were added dropwise keeping an internal temperature at 20° C. or lower. After the dropwise addition, the mixture was agitated for 1 hour at the room temperature. Then ethyl acetate was added, and, after the organic phase was washed with a 1 mol/L aqueous solution of hydrochloric acid and a saturated aqueous solution of sodium chloride, the organic phase was recovered, then subjected to distilling off of the organic solvent under a reduced pressure, and a purification by silica gel column chromatography (hexane/chloroform: 10/0-7/3 v/v) to obtain 48.2 g (yield 18%) of the desired compound.

4-2: Synthesis of sodium monodecyl mono-3,3,4,4,5,5,6,6,6-nonafluorohexyl sulfosuccinate (FS-312)

48.0 g (90 mmol) of monodecyl mono-3,3,4,4,5,5,6,6,6-nonafluorohexyl maleate, 10.4 g (99 mmol) of sodium hydrogensulfite and 50 mL of water-ethanol (1/1 v/v) were mixed and refluxed under heating for 5 hours. Then ethyl acetate was added, and, after the organic phase was washed with a saturated aqueous solution of sodium chloride, the organic phase was recovered, then subjected to distilling off of the organic solvent under a reduced pressure, and a recrystallization using acetonitrile to obtain 12.5 g (yield 22%) of the desired compound as colorless transparent solid.

The obtained desired compound showed following $^1$H-NMR data:

$^1$H-NMR(DMSO-d): δ0.81–0.87(t, 3H), 1.24(m, 18H), 1.51(br, 2H), 2.50–2.70(m, 2H), 2.70–2.95(m, 2H), 3.61–3.70(m, 1H), 3.96(m, 2H), 4.28(ms, 2H).

SYNTHESIS EXAMPLE 5

Synthesis of FS-309

5-1: Synthesis of mono-2-ethylhexyl mono-3,3,4,4,5,5,6,6,6-nanofluorohexyl maleate 515 g (1.95 moles) of 3,3,4,4,5,5,6,6,6-nonafluorohexanol, 169 g (2.13 moles) of pyridine and 394 mL (3.89 moles) of triethylamine were dissolved in 1000 mL of chloroform, then the solution was cooled in an ice bath and 530 g (2.14 moles) of 2-ethylhexyl maleate chloride were added dropwise keeping an internal temperature at 20° C. or lower. After the dropwise addition, the mixture was agitated for 1 hour at the room temperature. Then chloroform was added, and, after the organic phase was washed with water and a saturated aqueous solution of sodium chloride, the organic phase was recovered, then subjected to distilling off of the organic solvent under a reduced pressure, and a purification by silica gel column chromatography (hexane/chloroform: 10/0-7/3 v/v) to obtain 508 g (yield 50%) of the desired colorless transparent compound.

5-2: Synthesis of sodium mono-2-ethylhexyl mono-3,3,4,4,5,5,6,6,6-nonafluorohexyl sulfosuccinate (FS-309)

137.5 g (0.29 moles) of mono-2ethylhexyl mono-3,3,4,4,5,5,6,6,6-nonafluorohexyl maleate, 33.2 g (0.32 moles) of sodium hydrogensulfite and 140 mL of water-ethanol (1/1 v/v) were refluxed under heating for 2 hours. Then 1000 mL of ethyl acetate were added, and, after the organic phase was washed with a saturated aqueous solution of sodium chloride, the organic phase was recovered, then subjected to distilling off of the organic solvent under a reduced pressure, and a recrystallization using 800 mL of toluene in which crystals were precipitated upon cooling in an iced bath. Finally the crystals were separated by filtration to obtain 140 g (yield 84%) of the desired colorless transparent compound.

The obtained desired compound showed following $^1$H-NMR data:

$^1$H-NMR(DMSO-$d_6$): δ0.82–0.93(m, 6H), 1.13–1.32(m, 8H), 1.50(br, 1H), 2.57–2.65(m, 2H), 2.84–2.98(m, 2H), 3.63–3.68(m, 1H), 3.90(d, 2H), 4.30(m, 2H).

SYNTHESIS EXAMPLE 6

Synthesis of FS-332

6-1: Synthesis of mono-2-ethylhexyl mono-1,1,1,3,3,3,-hexafluoro-2-propyl maleate 33.7 g (201 mmol) of 1,1,1,3,3,3-hexafluoro-2-propanol (HFIP), and 17.9 mL (220 mmol) of pyridine were dissolved in 80 mL of acetonitrile, then the solution was cooled in an ice bath and 41.8 g (220 mmol) of mono 2-ethylhexyl maleate chloride were added dropwise keeping an internal temperature at 20° C. or lower. After the dropwise addition, the mixture was agitated for 1 hour at the room temperature. Then ethyl acetate was added, and, after the organic phase was washed with a 1 mol/L aqueous solution of hydrochloric acid and a saturated aqueous solution of sodium chloride, the organic phase was recovered, then subjected to distilling off of the organic solvent under a reduced pressure, and a purification by silica gel column chromatography (hexane/chloroform: 10/0-7/3 v/v) to obtain 10.6 g Wield 14%) of the desired compound as colorless transparent oil.

6-2: Synthesis FS332

10.6 g (28 mmol) of mono-2ethylhexyl mono-1,1,1,3,3,3-hexafluoro-2-propyl maleate, 3.2 g (31 mmol) of sodium hydrogensulfite and 10 mL of water-ethanol (1/1 v/v) were refluxed under heating for 10 hours. Then ethyl acetate was added, and, after the organic phase was washed with a saturated aqueous solution of sodium chloride, the organic phase was recovered, then subjected to distilling off of the organic solvent under a reduced pressure, and a recrystallization using acetonitrile to obtain 1.7 g (yield 13%) of the desired compound as colorless transparent solid.

The obtained desired compound showed following $^1$H-NMR data:

$^1$H-NMR(DMSO-d): δ0.81–0.87(m, 6H), 1.25(m, 8H), 1.50(br, 1H), 2.73–2.85(m, 2H), 3.59(m, 1H), 3.85–3.90(m, 2H), 12.23(br, 1H).

In the following, the fluorine type surfactant represented by the following general formula (IV) will be explained in detail:

$$[Rf^D—(L^D)_{nD}]_{mD}—W \qquad \text{General formula (IV)}$$

In the general formula (IV), $Rf^D$ represents a perfluoroalkyl group; $L^D$ represents an alkylene group; W represents a group having an anionic, cationic, betainic or porous nonionic group necessary for providing a surface-active property; $n^D$ represents an integer 0 or 1; and $m^D$ represents an integer from 1 to 3.

$Rf^D$ represents a perfluoroalkyl group having 3 to 20 carbon atoms, and, as specific example, can be a $C_3F_7$— group, a $C_4F_9$— group, a $C_6F_{13}$— group, a $C_8F_{17}$— group, a $C_{12}F_{25}$— group, or a $C_{16}F_{33}$— group.

In the general formula (IV), $L^D$ represents an alkylene group. The alkylene group has 1 or more carbon atoms, but preferably 2 or more carbon atoms and also preferably 20 or less carbon atoms. Specific examples include a methylene group, an ethylene group, a 1,2-propylene group, a 1,3-propylene group, a 1,2-butylene group, a 1,4-butylene group, a 1,6-hexylene group and 1,2-octylene group.

In the present invention, there may be employed a mixture of plural compounds in which $Rf^D$ represents perfluoroalkyl groups of mutually different chain length, or only a compound comprising a single perfluoroalkyl group. Also there may be employed a mixture of plural compounds in which $Rf^D$ is same but $L^D$ is mutually different.

In case of employing a mixture of plural compounds in which $Rf^D$ represents perfluoroalkyl groups of mutually different chain lengths, such perfluoroalkyl groups preferably have an average chain length of 4 to 10 carbon atoms, particularly preferably 4 to 9 carbon atoms.

In the general formula (IV), $n^D$ represents an integer 0 or 1, preferably 1. Also $m^D$ represents an integer from 1 to 3, and, in case $m^D$ is 2 or 3, $[Rf^D—(L^D)n^D]$ may be mutually same or different. In case W is not a phosphate ester group, there is preferred $m^D$=1, but, in case W represents a phosphate ester group, $m^D$ can be any of 1 to 3. In case $m^D$ is a mixture of 1 to 3, its average value is preferably from 0.5 to 2.

In the general formula (IV), W represents a group having a cationic group, an anionic group, a betainic group, or a polar nonionic group, which is necessary for providing the surface-active property. A bonding method with Rc is not important as long as such group is included. Examples of the anionic group for providing the surface-active property include a sulfonic acid group, an ammonium or metal salt thereof, a carboxylic acid group, an ammonium or metal salt thereof, a phosphonic acid group, an ammonium or metal salt thereof, a sulfate ester group, an ammonium or metal salt thereof, a phosphate ester group, and an ammonium or metal salt thereof.

Examples of the cationic group for providing the surface-active property include a quaternary alkylammonium group such as trimethylammoniumethyl group, or a trimethylammonoiumpropryl group; and an aromatic ammonium group such as dimethylphenylammoniumalkyl group or N-methylpyridinium group. In these groups, there is present a suitable counter ion such as a halogen atom, a benzenesulfonate anion or a toluenesulfonate anion, among which preferred is toluenesulfonate anion.

Examples of the betainic group for providing the surface-active property include a group with a betain structure such as $—N^+(CH_3)_2COO^-$, or $—N^+(CH_3)_2CH_2CH_2COO^-$.

Examples of the nonionic group for providing the surface-active property include a polyoxyalkylene group and a polyhydric alcohol group, preferably a polyoxyalkylene group such as polyethylene glycol or polypropylene glycol. However such group may have, at an end thereof, a group other than a hydrogen atom, such as an alkyl group.

In the general formula (IV), $Rf^D$ is preferably a perfluoroalkyl group having 4 to 16 carbon atoms, and more preferably a perfluoroalkyl group having 6 to 16 carbon atoms. $L^D$ preferably represents an alkylene group having 2 to 16 carbon atoms, more preferably an alkylene group having 2 to 8 carbon atoms, and particularly preferably an ethylene group. $n^D$ is preferably 1.

In the general formula (IV), $L^D$ and the group necessary for providing the surface-active property may be bonded in any form, for example by an alkylene chain or by arylene, and these groups may have a substituent. Also these groups may contain, in the main chain or in the side chain, an oxy group, a thio group, a sulfonyl group, a sulfoxide group, a sulfonamide group, an amide group, an amino group etc.

In the following there will be shown specific examples of the fluorine type surfactant represented by the general formula (IV), but the present invention is not limited at all by such examples.

| | | |
|---|---|---|
| FS-401 | $C_8F_{17}CH_2CH_2SO_3^-Li^+$ | |
| FS-402 | $C_8F_{17}CH_2CH_2SO_3^-Na^+$ | |
| FS-403 | $C_8F_{17}CH_2CH_2SO_3^-K^+$ | |
| FS-404 | $C_6F_{13}CH_2CH_2SO_3^-K^+$ | |
| FS-405 | $C_{10}F_{21}CH_2CH_2SO_3^-Li^+$ | |
| FS-406 | $C_8F_{17}CH_2CH_2SCH_2COO^-Na^+$ | |
| FS-407 | $C_8F_{17}CH_2CH_2OCH_2COO^-K^+$ | |
| FS-408 | $C_8F_{17}CH_2CH_2SCH_2CH_2COO^-Na^+$ | |
| FS-409 | $C_8F_{17}CH_2CH_2SCH_2CH_2COO^-Li^+$ | |
| FS-410 | $C_8F_{17}CH_2COO^-K^+$ | |
| FS-411 | $F(CF_2CF_2)_nCH_2CH_2SO_3^-Na^+$ | n = 3–7 |
| FS-412 | $F(CF_2CF_2)_nCH_2CH_2SO_3^-Li^+$ | n = 3–7 |
| FS-413 | $C_8F_{17}CH_2CH_2SO_2N(C_3H_7)(CH_2CH_2O)_4(CH_2)_4SO_3^-Na^+$ | |
| FS-414 | $F(CF_2CF_2)_nCH_2CH_2O(CH_2CH_2O)_x—(CH_2)_4SO_3^-Na^+$ | n = 1–7, x = 4 |
| FS-415 | $C_8F_{17}CH_2CH_2OPO(O^-Na^+)_2$ | |
| FS-416 | $C_8F_{17}CH_2CH_2SO_2N(C_3H_7)CH_2COO^-Na^+$ | |
| FS-417 | $C_8F_{17}CH_2CH_2SO_2N(C_3H_7)CH_2CH_2OPO(O^-Na^+)_2$ | |
| FS-418 | $[F(CF_2CF_2)_nCH_2CH_2O]_xPO(O^-M^+)_y$ | $M^+ = H^+, NH_4^+, Na^+, Li^+$ x + y = 3, n = 1–7 |

-continued

| | | | |
|---|---|---|---|
| FS-419 | $[F(CF_2CF_2)_nCH_2CH_2O]_xPO(O^-M^+)_y(OCH_2CH_2OH)_z$ | $M^+ = H^+, NH_4^+, Na^+, Li^+$ | x + y + z = 3, n = 1–7 |
| FS-420 | $F(CF_2CF_2)_nCH_2CH_2SO_3^-M^+$ | $M^+ = H^+, NH_4^+, Na^+, Li^+, K^+$ | n = 1–9 |
| FS-421 | $C_6F_{13}CH_2CH_2SO_3^-M^+$ | $M^+ = H^+, NH_4^+, Na^+, Li^+, K^+$ | |
| FS-422 | $F(CF_2CF_2)_nCH_2CH_2SCH_2CH_2COO^-Li^+$ | n = 1–9 | |
| FS-423 | $C_8F_{17}CH_2CH_2SO_2NHCH_2CH_2CH_2N^+(CH_3)_3$ | 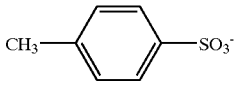 | |
| FS-424 | $C_6F_{13}CH_2CH_2NHCH_2CH_2N^+(CH_3)_3$ | 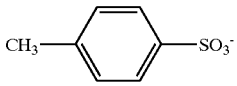 | |
| FS-425 | $C_8F_{17}CH_2CH_2SO_2NHCH_2CH_2CH_2OCH_2CH_2N^+(CH_3)_3$ | 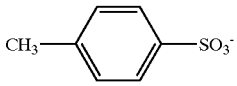 | |
| FS-426 | $F(CF_2CF_2)_nCH_2CH_2SO_2NHCH_2CH_2CH_2N^+(CH_3)_3$ | 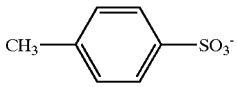 | n = 1–7 |
| FS-427 | $F(CF_2CF_2)_nCH_2CH_2SO_2NHCH_2CH_2CH_2OCH_2CH_2N^+(CH_3)_3$ | 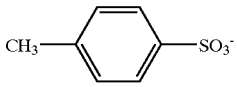 | n = 1–7 |
| FS-428 | $F(CF_2CF_2)_nCH_2CH_2N^+(CH_3)_3Cl^-$ | n = 1–9 | |
| FS-429 | $F(CF_2CF_2)_nCH_2CH_2NHCH_2CH_2N^+(CH_3)_3I^-$ | n = 1–7 | |
| FS-430 | $C_6F_{13}CH_2CH_2O(CH_2CH_2O)_nH$ | n = 5–10 | |
| FS-431 | $C_8F_{17}CH_2CH_2O(CH_2CH_2O)_nH$ | n = 10–15 | |
| FS-432 | $C_8F_{17}CH_2CH_2O(CH_2CH_2O)_nH$ | n = 15–20 | |
| FS-433 | $C_{10}F_{21}CH_2CH_2O(CH_2CH_2O)_nH$ | n = 15–20 | |
| FS-434 | $C_8F_{17}CH_2CH_2SO_2N(C_3H_7)CH_2CH_2O(CH_2CH_2O)_nH$ | n = 15 | |
| FS-435 | $F(CF_2CF_2)_mCH_2CH_2O(CH_2CH_2O)_nH$ | m = 3–7, n = 5–10 | |
| FS-436 | $C_8F_{17}CH_2CH_2SO_2N(C_2H_5)(CH_2CH_2O)_nH$ | n = 5–10 | |
| FS-437 | $-(CH_2-C(CH_3)(COOCH_2CH_2C_8F_{17}))_x-(CH_2-C(CH_3)(COO(CH_2CH_2O)_nOCH_3))_y-$ | x/y = 20/80, n = 5–10 | |
| FS-438 | $F(CF_2CF_2)_nCH_2CH_2O(CH_2CH_2O)_xH$ | n = 1–7, x = 0–15 | |
| FS-439 | $F(CF_2CF_2)_nCH_2CH_2O(CH_2CH_2O)_xH$ | n = 1–9, x = 0–25 | |
| FS-440 | $F(CF_2CF_2)_nCH_2CH_2S(CH_2CH_2O)_xH$ | n = 1–9, x = 0–25 | |
| FS-441 | $C_6F_{13}CH_2CH_2SO_2N(C_3H_7)CH_2CH_2O(CH_2CH_2O)_xH$ | x = 0–15 | |
| FS-442 | $C_8F_{17}CH_2CH_2SO_2NH(CH_2)_3N^+(CH_3)_2CH_2CH_2COO^-$ | | |

The fluorine type surfactant represented by the general formula (IV) can be produced by an ordinary synthesizing method, and commercially available surfactants containing a perfluoroalkyl group of so-called telomer type can be used. Examples thereof include Zonyl FSP, FSE, FSJ, NF, TBS, FS-62, FSA, and FSK (foregoing being ionic), Zonyl 9075, FSO, FSN, FSN-100, FS-300, and FS-310 (foregoing being nonionic) manufactured by DuPont K.K.; S-111, S-112, S-113, S-121, S-131, S-132 (foregoing being ionic), S-141, and S-145 (foregoing being nonionic), manufactured by Asahi Glass Co.; Unidyne DS-101, DS-102, DS-202, DS-301 (foregoing being ionic), DS-401, and DS-403 (foregoing being nonionic), manufactured by Daikin Industries Ltd.

Also, among the aforementioned compounds, the ionic surfactant can be utilized in various salt forms obtained by ion exchange or neutralization according to the purpose of use or the necessary properties, or in the presence of one or more counter ions.

In the following there will be explained a substituent T cited as an example of the substituent in the foregoing general formulae.

The substituent T can be, for example, an alkyl group (preferably having 1 to 20 carbon atoms, more preferably having 1 to 12 carbon atoms and particularly preferably having 1 to 8 carbon atoms; such as methyl group, ethyl group, isopropyl group, tert-butyl group, n-octyl group, n-decyl group, n-hexadecyl group, cyclopropyl group, cyclopentyl group or cyclohexyl group), an alkenyl group (preferably having 2 to 20 carbon atoms, more preferably having 2 to 12 carbon atoms and particularly preferably having 2 to 8 carbon atoms; such as vinyl group, allyl group, 2-butenyl group, or 2-pentenyl group), an alkynyl group (preferably having 2 to 20 carbon atoms, more preferably having 2 to 12 carbon atoms and particularly preferably having 2 to 8 carbon atoms; such as propargyl group or 3-pentynyl group), an aryl group (preferably having 6 to 30 carbon atoms, more preferably having 6 to 20 carbon atoms and particularly preferably having 6 to 12 carbon atoms; such as phenyl group, p-methylphenyl group, or naphthyl group), a substituted or unsubstituted amino group (preferably having 0 to 20 carbon atoms, more preferably having 0 to 10 carbon atoms and particularly preferably having 0 to 6 carbon atoms; such as unsubstituted amino group, methylamino group, dimethylamino group, diethylamino group or dibenzylamino group), an alkoxy group (preferably having 1 to 20 carbon atoms, more preferably having 1 to 12 carbon atoms and particularly preferably having 1 to 8 carbon atoms; such as methoxy group, ethoxy group or butoxy group), an aryloxy group (preferably having 6 to 20 carbon atoms, more preferably having 6 to 16 carbon atoms and particularly preferably having 6 to 12 carbon atoms; such as phenyloxy group or 2-naphthyloxy group), an acyl group (preferably having 1 to 20 carbon atoms, more preferably with 1 to 16 carbon atoms and particularly preferably having 1 to 12 carbon atoms; such as acetyl group, benzoyl group, formyl group or pivalyol group), an alkoxycarbonyl group (preferably having 2 to 20 carbon atoms, more preferably having 2 to 16 carbon atoms and particularly preferably having 2 to 12 carbon atoms; such as methoxycarbonyl group or ethoxycarbonyl group), an aryloxycarbonyl group (preferably having 7 to 20 carbon atoms, more preferably having 7 to 16 carbon atoms and particularly preferably having 7 to 10 carbon atoms; such as phenyloxycarbonyl group), an acyloxy group (preferably having 2 to 20 carbon atoms, more preferably having 2 to 16 carbon atoms and particularly preferably having 2 to 10 carbon atoms; such as acetoxy group or benzoyloxy group), an acylamino group (preferably having 2 to 20 carbon atoms, more preferably having 2 to 16 carbon atoms and particularly preferably having 2 to 10 carbon atoms; such as acetylamino group or benzoylamino group), an alkoxycarbonylamino group (preferably having 2 to 20 carbon atoms, more preferably having 2 to 16 carbon atoms and particularly preferably having 2 to 12 carbon atoms; such as methoxycarbonylamino group), an aryloxycarbonylamino group (preferably having 7 to 20 carbon atoms, more preferably having 7 to 16 carbon atoms and particularly preferably having 7 to 12 carbon atoms; such as phenyloxycarbonylamino group), a sulfonylamino group (preferably having 1 to 20 carbon atoms, more preferably having 1 to 16 carbon atoms and particularly preferably having 1 to 12 carbon atoms; such as methanesulfonylamino group or benzenesulfonylamino group), a sulfamoyl group (preferably having 0 to 20 carbon atoms, more preferably having 0 to 16 carbon atoms and particularly preferably having 0 to 12 carbon atoms; such as sulfamoyl group, methylsulfamoyl group, dimethylsulfamoyl group or phenylsulfamoyl group), a carbamoyl group (preferably having 1 to 20 carbon atoms, more preferably having 1 to 16 carbon atoms and particularly preferably having 1 to 12 carbon atoms; such as unsubstituted carbamoyl group, methylcarbamoyl group, diethylcarbamoyl group or phenylcarbamoyl group), an alkylthio group (preferably having 1 to 20 carbon atoms, more preferably having 1 to 16 carbon atoms and particularly preferably having 1 to 12 carbon atoms; such as methylthio group or ethylthio group), an arylthio group (preferably having 6 to 20 carbon atoms, more preferably having 6 to 16 carbon atoms and particularly preferably having 6 to 12 carbon atoms; such as phenylthio group), a sulfonyl group (preferably having 1 to 20 carbon atoms, more preferably having 1 to 16 carbon atoms and particularly preferably having 1 to 12 carbon atoms; such as mesyl group or tosyl group), a sulfinyl group (preferably having 1 to 20 carbon atoms, more preferably having 1 to 16 carbon atoms and particularly preferably having 1 to 12 carbon atoms; such as methanesulfinyl group or benzenesulfinyl group), an ureide group (preferably having 1 to 20 carbon atoms, more preferably having 1 to 16 carbon atoms and particularly preferably having 1 to 12 carbon atoms; such as unsubstituted ureide group, methylureide group or phenylureide group), a phosphoric acid amide group (preferably having 1 to 20 carbon atoms, more preferably having 1 to 16 carbon atoms and particularly preferably having 1 to 12 carbon atoms; such as diethylphosphoric acid amide group or phenylphosphoric acid amide group), a hydroxyl group, a mercapto group, a halogen atom (such as fluorine atom, chlorine atom, bromine atom or iodine atom), a cyano group, a sulfo group, a carboxyl group, a nitro group, a hydroxamic acid group, a sulfino group, a hydrazino group, an imino group, a heterocyclic group (preferably having 1 to 30 carbon atoms, more preferably having 1 to 12 carbon atoms; for example a heterocyclic group including a hetero atom such as a nitrogen atom, an oxygen atom or a sulfur atom, such as imidazolyl group, pyridyl group, quinolyl group, furyl group, piperidyl group, morpholino group, benzoxazolyl group, benzimidazolyl group or benzthioazolyl group), a silyl group (preferably having 3 to 40 carbon atoms, more preferably having 3 to 30 carbon atoms and particularly preferably having 3 to 24 carbon atoms; such as trimethylsilyl group or triphenylsilyl group). These substituents may be further substituted. Also in case there are two or more substituents, they may be mutually same or different, or may be mutually bonded to form a ring if possible.

An amount of addition of the aforementioned fluorine type surfactant, represented by the general formulae (I), (II), (III) and (IV), to the photosensitive material is not particularly limited, but is in general within a range of $1\times10^{-5}$ to 1 g/m$^2$, preferably $1\times10^{-4}$ to $1\times10^{-1}$ g/m$^2$, preferably $1\times10^{-3}$ to $1\times10^{-2}$ g/m$^2$.

In addition to the fluorine type surfactant represented by the general formulae (I), (II), (III) and (IV), another surfactant may be used in combination. Examples of the surfactant usable in combination include those described in JP-A No. 62-215272 (pages 649 to 709), Research Disclosures (RD) Item 17643, pp.26–27(December 1978), Item 18716, p.650 (November 1979), and Item 307105, pp.875–876(November 1989).

In the following, there will be given a detailed explanation on the silver halide emulsion.

Silver halide grain in the silver halide emulsion is preferably a cubic grain substantially having a {100} plane, a tetradecahedral crystal grain (which may have rounded apexes and may include higher order planes), an octahedral crystal grain, or a planar grain of which at least 50% of the entire projection area are composed of a {100} or {111} plane and which has an aspect ratio of 2 or higher. The aspect ratio is obtained by dividing a diameter of a circle corresponding to a projected area with a thickness of the grain. In the invention, there is preferably employed a cubic grain, a planar grain having {100} plane as a principal plane, or a planar grain having {111} plane as a principal plane.

For the silver halide emulsion, there can be employed an emulsion based on silver chloride, silver bromide, silver iodobromide, silver chloro(iodo)bromide etc., but, from the standpoint of rapid processability, preferred is an emulsion based on silver chloride, silver chlorobromide, silver chloroiodide or silver chlorobromoiodide in which a content of silver chloride is 90 mol. % or higher, and more preferred is an emulsion based on silver chloride, silver chlorobromide, silver chloroiodide or silver chlorobromoiodide in which a content of silver chloride is 98 mol. % or higher. Among such silver halide emulsion, preferred is an emulsion having, in a shell portion of the silver halide grain, 0.01 to 0.50 mol. % of a silver iodide phase, on the basis of total molar amount of silver, more preferably 0.05 to 0.40 mol. %, since such emulsion provides a high sensitivity and a high intensity exposability. Also an emulsion having, on the surface of the silver halide grain, 0.2 to 5 mol. % of a silver bromide localized phase on the basis of a total molar amount of silver is preferable, and more preferably 0.5 to 3 mol. %, since such emulsion provides a high sensitivity and achieves stabilization of photographic performances.

The silver halide emulsion is normally subjected to chemical sensitization. For chemical sensitization, there may be employed sulfur sensitization represented by an addition of an unstable sulfur compound, precious metal sensitization represented by gold sensitization, and reduction sensitization, which may be employed singly or in combination. For chemical sensitization, there is preferably employed a compound described in JP-A No. 62-215272, lower right column in page 18 to upper right column in page 22. Among these, gold sensitization is particularly preferred, since gold sensitization allows to further reduce the variation of photographic performances under a scan exposure with a laser light or the like.

In the following, there will be given a more detailed explanation on the photosensitive material, but such examples are not restrictive unless specified otherwise.

There will be given an explanation on a reflective substrate, employed preferably for the photosensitive material. The reflective substrate employed for the photosensitive material preferably contain a white pigment in a water-resistant resinous covering layer of the reflective substrate, on a side thereof on which photosensitive layers are to be coated. The white pigment to be dispersed in the water-resistant resin can be an inorganic pigment such as titanium dioxide, barium sulfate, lithopone, aluminum oxide, calcium carbonate, silicon oxide, antimony trioxide, titanium phosphate, zinc oxide, lead white or zirconium oxide, or an organic powder such as of polystyrene, or styrene-divinylbenzene copolymer. Among these, the use of titanium dioxide is particularly effective. Titanium dioxide can be rutile type or anatase type, but anatase type is preferred in case of giving priority to whiteness and rutile type is preferred in case of giving priority to image sharpness. It is also possible to blend the anatase type and the rutile type taking whiteness and sharpness into consideration. Also in case the water-resistant resinous layer is formed by plural layers, it is also preferred to use the anatase type in a layer and the rutile type in another layer. Also such titanium dioxide may be produced by either of a sulfate process and a chloride process.

The water-resistant resin of the reflective substrate is a resin with a water absorption rate (mass %) of 0.5 or less, preferably 0.1 or less, for example a polyolefin such as polyethylene, polypropylene or polyethylene based polymers, a vinylic polymer or copolymer (such as polystyrene, polyacrylate or a copolymer thereof), a polyester (such as polyethylene terephthalate or polyethylene isophthalate) or a copolymer thereof. Particularly preferred are polyethylene and polyester. The polyethylene can be high density polyethylene, low density polyethylene, linear low-density polyethylene or a blend thereof.

As the polyester, a polyester synthesized by condensation polymerization of a dicarboxylic acid and a diol is preferable, and preferred example of the dicarboxylic acid include terephthalic acid, isophthalic acid and naphthalene-dicarboxylic acid. Preferred examples of the diol include ethylene glycol, butylene glycol, neopentyl glycol, triethylene glycol, butane diol, hexylene glycol, bisphenol-A ethylene oxide addition product (2,2-bis(4-(2-hydroxyethyloxy)phenyl)propane), and 1,4-dihydroxymethylcyclohexane. Various polyesters obtained by condensation polymerization of such dicarboxylic acids singly or in a mixture and such diols singly or in a mixture can be used. Among these, it is preferred that at least one of the dicarboxylic acids is terephthalic acid.

A mixing ratio of the water-resistant resin and the white pigment, in mass ratio, is within a range of 98/2 to 30/70 (water-resistant resin/white pigment), preferably 95/5 to 50/50 and particularly preferably 90/10 to 60/40. The water-resistant resinous covering layer is coated on a base material preferably with a thickness of 2 to 200 $\mu$m, more preferably 5 to 80 $\mu$m. A resin or a resin composition, to be coated on a side of the base material, opposite to the side on which the photosensitive layer is to be coated, preferably has a thickness of 5 to 100 $\mu$m, more preferably 10 to 50 $\mu$m.

In the reflective substrate, it may be preferable, from the standpoints of cost and produceability of the substrate, that the water-resistant resinous covering layer on the side on which the photosensitive layer is to be coated, is composed of two or more layers with different contents of the white pigment. In such case, it is preferred that, among the water-resistant resinous covering layers, a water-resistant resinous covering layer closest to the base material has a content of the white pigment lower than that of at least one upper water-resistant resinous covering layer.

In a multi-layer water-resistant resinous layer, the content of the white pigment in each layer is within a range of 0 to 70 mass %, preferably 0 to 50 mass %, more preferably 0 to 40 mass %. Also in such multi-layer water-resistant resinous layer, the content of the white pigment in a layer having the highest content is within a range of 9 to 70 mass %, preferably 15 to 50 mass %, and more preferably 20 to 40 mass %.

Also a blueing agent may be included in the water-resistant resin layer for adjusting the whiteness in the whiteness range of the present invention. As the blueing agent, there can be utilized a known material such as Prussian blue, cobalt blue, oxidized cobalt phosphate, a quinacridone pigment or a mixture thereof. A particle size of the blueing agent is not particularly limited, but the commercially available blueing agent usually has a particle size within a range of 0.3 to 10 $\mu$m, and a blueing agent having its particle size within such range is generally acceptable for the use. In case the water-resistant resin layer of the reflective substrate employed in the present invention has a multi-layered structure, it is preferred that the content of the blueing agent in an uppermost layer therein is equal to or higher than the content in lower layers. A preferred content of the blueing agent is 0.2 to 0.5 mass % in the uppermost layer and 0 to 0.45 mass % in layers beneath the uppermost layer.

The base material to be used in the reflective substrate can be any of a natural pulp paper utilizing natural pulp as a principal raw material, a mixed paper formed from natural pulp and synthetic fibers, a synthetic fiber paper utilizing synthetic fibers as a principal raw material, so-called synthetic paper prepared by converting a synthetic resin film of polystyrene or polypropylene or the like to a pseudo paper, and a plastic film for example a polyester film such as of polyethylene terephthalate or polybutylene terephthalate, a cellulose triacetate film, a polystyrene film or a polyolefin film such as polypropylene film, but, for the base material for a photographic water-resistant resinous coating, there is particularly preferably and advantageously employed a natural pulp paper (hereinafter simply called a base paper).

A thickness of the base paper for the reflective substrate is not particularly limited. However a weight of the base paper is preferably within a range of 50 to 250 g/m$^2$ and a thickness is preferably within a range of 50 to 250 $\mu$m.

A more preferable reflective substrate is a paper substrate having a polyolefin layer including small pores, on a side where the silver halide emulsion layers are to be provided. The polyolefin layer may be composed of plural layers, and, in such case, a configuration is preferable in which a polyolefin layer adjacent to a gelatin layer on the side of the silver halide emulsion layers is free from small pores (for example polypropylene or polyethylene), and polyolefin layers closer to the paper substrate contain small pores. The plural polyolefin layers or single polyolefin layer present between the paper substrate and the photographic layers preferably have a density within a range of 0.40 to 1.0 g/ml, more preferably 0.50 to 0.70 g/ml. Also the plural polyolefin layers or single polyolefin layer present between the paper substrate and the photographic layers preferably have a thickness within a range of 10 to 100 $\mu$m, more preferably 15 to 70 $\mu$m. Also a thickness ratio of the polyolefin layer to the paper substrate is preferably from 0.05 to 0.2, more preferably 0.1 to 0.15.

It is also preferred to form a polyolefin layer on a surface (rear surface) of the paper substrate opposite to the photographic layers, in order to increase the rigidity of the reflective substrate, and, in such case, the polyolefin layer on the rear surface is preferably composed of polyethylene layer or polypropylene layer having a matted surface, more preferably composed of polypropylene layer. The polyolefin layer on the rear surface preferably has a thickness of 5 to 50 $\mu$m, more preferably 10 to 30 $\mu$m, and preferably has a density of 0.7 to 1.1 g/ml. In the reflective substrate recited in the invention, preferred embodiments relating to the polyolefin layer provided on the paper substrate can be those described in JP-A Nos. 10-333277, 10-333278, 11-52513 and 11-65024, EP 0880065 and EP 0880066.

In the aforementioned water-resistant resin layer, a fluorescent whitening agent can be preferably included. Also a hydrophilic colloid layer in which the fluorescent whitening agent is dispersed can be formed separately. The fluorescent whitening agent is preferably a benzoxazole type, a coumarine type, or a pyrazoline type, and more preferably a benzoxazolylnaphthalene type or a benzoxazolylstilbene type. An amount of use is not particularly limited, but preferably within a range from 1 to 100 mg/m$^2$. In case of mixing in the water-resistant resin, a mixing ratio is preferably 0.0005 to 3 mass % on the basis of the resin, more preferably 0.001 to 0.5 mass %.

The reflective substrate may also be formed by coating a hydrophilic colloid layer containing a white pigment, on a translucent substrate or a reflective substrate explained above. Also the reflective substrate may have a metallic surface showing mirror reflectivity or second type diffusion reflectivity.

In case of using the aforementioned blue pigment and the aforementioned red and/or purple pigment in combination, they may be dispersed in the same or different hydrophilic colloid layers without particular limitation.

It is also preferred, in photographic layers of the photosensitive material, to adjust the whiteness with an oil-soluble dye. Representative examples of the oil-soluble dye are compounds 1 to 27 described in JP-A No. 2-842, pages (8) and (9).

It is also possible to adjust the whiteness by including a fluorescent whitening agent in a hydrophilic colloid layer of the photosensitive material and causing the fluorescent whitening agent to remain in the photosensitive material after the processing thereof. It is also possible to add, in the photosensitive material, a polymer capable of capturing the fluorescent whitening agent such as polyvinyl pyrrolidone.

In the photosensitive material, it is preferred, for preventing irradiation or halation or improving handling safety under a safe light, to add a dye that can be decolored by processing (particularly an oxonol dye or a cyanine dye) as described in EP 0,337,490A2, pages 27 to 76 into the hydrophilic colloid layer. Also a dye described in EP 0819977 may be preferably used according to the present invention. Among these water-soluble dyes, some may deteriorate color separation or handling safety under a safe light in case the amount of use is increased. As the dyes usable without deteriorating the color separation, water-soluble dyes described in JP-A Nos. 5-127324, 5-127325 and 5-216185 are preferable.

In the photosensitive material, there can be employed a colored layer that can be decolored by processing, instead of or in combination with the water-soluble dye. The colored layer that can be decolored by processing may be positioned in direct contact with the emulsion layer, or separated from the emulsion layer by an intermediate layer containing an agent for preventing color mixing in processing, which is made of gelatin or hydroquinone. Such colored layer is preferably provided under (on the substrate side of) an emulsion layer that develops the same primary color as the color of the colored layer. It is possible to individually provide the colored layers corresponding to all the primary colors, or to provide the color layers corresponding to arbitrarily selected ones among such primary colors. It is also possible to provide a colored layer which is colored corresponding to plural primary color ranges. The optical reflective density of the colored layer is preferably within a range of 0.2 to 3.0 at a wavelength of a highest optical density within a wavelength range used for the exposure (a visible light range of 400 to 700 nm in case of the exposure in an ordinary printer, or a wavelength of a scanning exposure light source in case of a scan exposure). It is more preferably within a range of 0.5 to 2.5, and particularly preferably within a range of 0.8 to 2.0.

For forming the colored layer, there can be employed a method known in the related art. For example there can be employed a method of introducing a dye described in JP-A No. 2-282244, page 3, upper right column to page 8, or a dye described in JP-A No. 3-7931, page 3, upper right column to page 11, lower left column, into the hydrophilic colloid layer in a state of a solid particle dispersion, a method of mordanting a cationic polymer with an anionic dye, a method of adsorbing a dye on fine particles such as of silver halide thereby achieving fixation in the layer, or a method of employing colloidal silver as described in JP-A No. 1-239544. For dispersing fine dye powder in solid state, a method of introducing a dye that is substantially insoluble in water at least at a pH value of 6 or lower but is substantially water soluble at least at a pH value of 8 or higher is described in JP-A No. 2-308244. Also a method of mordanting a cationic polymer with an anionic dye is described for example in JP-A No.2-84637, pages 18 to 26. Also a method of preparing colloidal silver as a light absorbing agent is described in U.S. Pat. Nos. 2,688,601 and 3,459,563. Among these, the method of introducing the fine powder dye or the method of employing colloidal silver is preferable.

The photosensitive material is preferably containing at least one yellow color-developing silver halide emulsion layer, at least one magenta color-developing silver halide emulsion layer, and at least one cyan color-developing silver halide emulsion layer, and such silver halide emulsion layers are generally formed in an order, from the side of the substrate, of the yellow color-developing silver halide emulsion layer, the magenta color-developing silver halide emulsion layer, and the cyan color-developing silver halide emulsion layer.

However, there may also be adopted another different layer configuration.

The silver halide emulsion layer containing a yellow coupler may be formed in any position on the substrate, but, in case such yellow coupler-containing layer contains silver halide flat grains, it is preferably formed in a position farther, from the substrate, than at least one of the magenta coupler-containing silver halide emulsion layer and the cyan coupler-containing silver halide emulsion layer. Also in view of accelerating color-developing processing and silver elimination and reducing a remaining color of the sensitizing dye, the yellow coupler-containing silver halide emulsion layer is preferably formed in a position farthest, from the substrate, among silver halide emulsion layers. Also the cyan coupler-containing silver halide emulsion layer is preferably formed in a center position between other silver halide emulsion layers in view of reducing a blix fading, and is preferably formed as a lowermost layer in view of reducing a light fading. Also each color developing layer for yellow, magenta or cyan may be composed of two or three layers. It is also preferred, as described in JP-A Nos. 4-75055, 9-114035 and 10-246940 and U.S. Pat. No. 5,576,159, to form a coupler layer not including a silver halide emulsion as a color developing layer, adjacent to a silver halide emulsion layer.

For the silver halide emulsion, other materials (for example additives) and photographic layers (for example layer composition) to be employed in the photosensitive material, and a processing method and processing additives to be employed for processing the photosensitive material, there can be advantageously employed those described in JP-A Nos. 62-215272 and 2-33144, and European Patent No. 0,355,660A2, particularly those described in European Patent No. 0,355,660A2. There are also preferred a silver halide color photosensitive material and a processing method therefor described in JP-A Nos. 5-34889, 3-359249, 4-313753, 4-270344, 5-66527, 4-34548, 4-145433, 2-854, 1-158431, 2-90145, 3-194539 and 2-93641 and EP-A No. 0520457A2.

Particularly for the reflective substrate, the silver halide emulsion, different metal ions to be doped in the silver halide grain, a stabilizer or an antifoggant for the silver halide emulsion, the chemical sensitizing method (sensitizer), the spectral sensitizing method (spectral sensitizer), cyan, magenta and yellow couplers and an emulsifying/dispersing method thereof, a color image stability improving agent (antistain agent or antifading agent), a dye (colored layer), a gelatin type, a layer configuration of the photosensitive material and a coated film pH of the photosensitive material, there can be particularly advantageously employed those described in respective portions of patent references shown in Table 1.

TABLE 1

| Element | JP-A No. 7-104448 | JP-A No. 7-77775 | JP-A No. 7-301895 |
|---|---|---|---|
| Reflective substrate | column 7, line 12–column 12, line 19 | column 35, line 43–column 44, line 1 | column 5, line 40–column 9, line 26 |
| Silver halide emulsion | column 72, line 29–column 74, line 18– | column 44, line 36–column 46, line 29– | column 77, line 48–column 80, line 28– |
| Different metal ion | column 74, lines 19–44 | column 46, line 30–column 47, line 5– | column 80, line 29–column 81, line 6– |
| Stabilizer or antifoggant | column 75, lines 9–18 | column 47, lines 20–29 | column 18, line 11–column 31, line 37 (particularly mercapto heterocyclic compound) |
| Chemical sensitization (chemical sensitizer) | column 74, line 45–column 75, line 6 | column 47, lines 7–17 | column 81, lines 9–17 |
| Spectral sensitization (spectral sensitizer) | column 75, line 19–column 76, line 45 | column 47, line 30–column 49, line 6 | column 81, line 21–column 82, line 48 |
| Cyan coupler | column 12, line 20–column 39, line 49 | column 62, line 50–column 63, line 16 | column 88, line 49–column 89, line 16 |
| Yellow coupler | column 87, line 40–column 88, line 3 | column 63, lines 17–30 | column 89, lines 17–30 |
| Magenta coupler | column 88, line 4–18 | column 63, line 3–column 64, line 11 | column 31, line 34–column 77, line 44 and column 88, lines 32–46 |
| Coupler emulsifying method | column 71, line 3–column 72, line 11 | column 61, lines 36–49 | column 87, lines 35–48 |
| Color image preservability improving agent (antistain agent) | column 39, line 50–column 70, line 9 | column 61, line 50–column 62, line 49 | column 87, line 49–column 88, line 48 |
| Antifading agent | column 70, line 10–column 71, line 2 | | |
| Dye (coloring agent) | column 77, line 42–column 78, line 41 | column 7, line 14–column 19, line 42 and column 50, line 3–column 51, line 14 | column 9, line 27–column 18, line 10 |

TABLE 1-continued

| Element | JP-A No. 7-104448 | JP-A No. 7-77775 | JP-A No. 7-301895 |
|---|---|---|---|
| Gelatin type | column 78, lines 42–48 | column 51, lines 15–20 | column 83, lines 13–19 |
| Layer configuration of photo-sensitive mat. | column 39, lines 11–26 | column 44, lines 2–35 | column 31, line 38–column 32, line 33 |
| Film pH of photosensitive material | column 72, lines 12–28 | | |
| Scan exposure | column 76, line 6–column 77, line 41 | column 49, line 7–column 50, line 2 | column 82, line 49–column 83, line 12 |
| Preservative in developer | column 88, line 19–column 89, line 22 | | |

Also for the cyan, magenta and yellow couplers employed in the photosensitive material, also useful are those described in JP-A No. 62-215272, page 91, upper right column, line 4 to page 121, upper left column, line 6; JP-A No.2-33144, page 3, upper right column, line 14 to page 18, upper left column, last line and page 30, upper right column, line 6 to page 35, lower right column, line 11; and EP 0355,660A2, page 4, lines 15 to 27; page 5, lines 30 to page 28, last line; page 45, lines 29 to 31; and page 47, line 23 to page 63, line 50.

Also in the invention, there may be advantageously added a compound represented by general formula (II) or (III) in WO98/33760 or a general formula (D) in JP-A No. 10-221825.

As a cyan dye forming coupler (hereinafter also simply called "cyan coupler") employable in the invention, there can be, for example, employed a pyrrolotriazole coupler, and, examples of the pyrrolotriazole coupler include a coupler represented by a general formula (I) or (II) in JP-A No.5-313324, a coupler represented by a general formula (I) in JP-A No.6-347960 and coupler examples described in these patent references. There can also be employed a cyan coupler of phenol type or naphthol type, for example, a cyan coupler represented by a general formula (ADF) in JP-A No. 10-333297. As a cyan coupler other than those described in the foregoing, there can also be employed a pyrroloazole cyan coupler described in European patents EP0488248 and EP0491197A1, a 2,5-diacylaminophenol coupler described in U.S. Pat. No. 5,888,716, a pyrazoloazole cyan coupler having an electron attracting group or a hydrogen bonding group at the 6-position described in U.S. Pat. Nos. 4,873,183 and 4,916,051, and particularly a pyrazolozaole cyan coupler having a carbamoyl group at the 6-position described in JP-A Nos. 8-171185, 8-311360 and 8-339060.

Also, in addition to a diphenylimidazole cyan coupler described in JP-A No. 2-33144, there may be employed a 3-hydroxypyridine cyan coupler described in European Patent EP0333185A2 (particularly preferred being a 2-equivalent coupler formed by introducing a chlorine dissociative group in a 4-equivalent coupler (42) listed in examples, or a coupler (6) or (9)), a cyclic active methylene cyan coupler described in JP-A No. 64-32260 (particularly preferred being specific coupler examples 3, 8 and 34), a pyrrolopyrazole cyan coupler described in European Patent EP0456226A1, and a pyrroloimidazole cyan coupler described in European Patent EP0484909.

Among these cyan couplers, there is particularly preferred a pyrroloazole cyan coupler represented by a general formula (I) in JP-A No. 11-282138, and a description of this patent reference in paragraphs 0012 to 0059, including example cyan couplers (1)–(47), is directly applicable to the present application and is advantageously incorporated as a part of the specification of the present application.

As a magenta dye forming coupler (hereinafter also simply called "amagenta coupler") employable in the invention, there can be employed a 5-pyrazolone magenta coupler or a pyrazoloazole magenta coupler as described in known references in the foregoing table. In consideration of a color hue, an image stability and a color developing ability, there is preferred a pyrazolotriazole coupler in which a secondary or tertiary alkyl group is directly bonded to 2-, 3- or 6-position of the pyrazolotriazole ring as described in JP-A No. 61-65245, a pyrazoloazole coupler including a sulfonamide group within a molecule as described in JP-A No.61-65246, a pyrazoloazole coupler having an alkoxyphenylsulfoneanide ballast group as described in JP-A No. 61-147254, or a pyrazoloazole coupler having an alkoxy group or an aryloxy group at 6-position as described in European Patents Nos. 226,849A and 294,785A. As the magenta coupler, there is particularly preferred a pyrroloazole coupler represented by a general formula (M-I) in JP-A No. 8-122984, and a description of this patent reference in paragraphs 0009 to 0026 is directly applicable to the present application and is advantageously incorporated as a part of the specification of the present application. In addition there is preferably employed a pyrazoloazole coupler having steric hindering groups at 3- and 6-positions, as described in European Patents Nos. 854384and 884640.

As a yellow dye forming coupler (hereinafter also simply called "yellow coupler") employable in the invention, there can be employed, in addition to compounds described in the foregoing table, an acylacetamide yellow coupler having a 3- to 5-membered cyclic structure in an acyl group as described in European Patent EP0447969A1, a malondianilide yellow coupler having a cyclic structure described in European Patent EP0482552A1, a pyrrol-2/3-yl or indol-2/3-yl carbonylacetate anilide coupler described in EP-A Nos. 953870A1, 953871A1, 953872A1, 953873A1, 953874A1 and 953875A1, and an acylacetamide yellow coupler having a dioxane structure as described in U.S. Pat. No. 5,118,599. Among these, particularly preferred are an acylacetamide yellow coupler in which the acyl group is 1-alkylcyclopropane-1-carbonyl group and a malondianilide yellow coupler in which one of anilides constitutes an indoline ring. These couplers may be used singly or in combination.

The coupler to be employed in the present invention is preferably emulsified and dispersed in an aqueous hydrophilic colloid solution by impregnating in a loadable latex polymer (cf. U.S. Pat. No. 4,203,716) in the presence (or absence) of the high-boiling point organic solvent described in the foregoing table 1, or by dissolving together with a polymer insoluble in water but soluble in an organic solvent. The preferred polymer that is insoluble in water but soluble in organic solvent can be a homopolymer or a copolymer described in U.S. Pat. No. 4,857,449, columns 7–15, and WO 88/00723, pages 12 to 30. A methacrylate or acrylamide polymer is more preferred, and particularly preferably an acrylamide polymer is employed in consideration of the color image stability.

In the present invention, there can be employed known color mixing preventing agents, among which preferred are those described in the following patent references.

For example, there can be employed a redox compound of a high molecular weight described in JP-A No.5-333501, a phenidone or hydrazine compound described in WO 98/33760 and U.S. Pat. No. 4,923,787, or a white coupler described in JP-A Nos. 5-249637 and 10-282615 and German Patent No. 19629142A1. Particularly in case of elevating pH of the developer thereby accelerating development, there can be preferably employed redox compounds described in German Patent No. 19618786A1, European Patents Nos. 839623A1 and 842975A1, German Patent No. 19806846A1 and French Patent No. 2760460A1.

In the photosensitive material, it is preferable to use, as an ultraviolet absorber, a compound comprising a triazine skeleton having a high molar absorption coefficient, and there can be employed compounds described for example in the following patent references. Such compounds may be preferably added in a photosensitive layer and/or a non-photosensitive layer. For example, there can be employed compounds described in JP-A Nos. 46-3335, 55-152776, 5-197074, 5-232630, 5-307232, 6-211813, 8-53427, 8-234364, 8-239368, 9-31067, 10-115898, 10-147577 and 10-182621, German Patent No. 19739797A, European Patent No. 711804A and JP-T No. 8-501291.

As a binder or a protective colloid employable in the photosensitive material, gelatin is advantageously employed, but other hydrophilic colloids may also be employed singly or in combination with gelatin. In preferred gelatin, a content of heavy metals contained as impurities such as iron, copper, zinc or manganese is preferably 5 ppm or less, more preferably 3 ppm or less. Also an amount of calcium included in the photosensitive material is preferably 20 mg/m$^2$ or less, more preferably 10 mg/m$^2$ or less and most preferably 5 mg/m$^2$ or less.

In the photosensitive material, in order to avoid various molds and bacteria which deteriorate the image by proliferation in the hydrophilic colloid layer, it is preferred to add an antimold or antibacterial agent as described in JP-A No. 63-271247. Also a pH value of films of the photosensitive material is preferably within a range from 4.0 to 7.0, more preferably from 4.0 to 6.5.

In the following there will be given an explanation of development process solutions (color developer, bleach-fixing solution and rinse solution) to be employed in an image forming method of a second embodiment of the present invention.

At first there will be explained the color developer.

The color developer contains a color developing agent, and a preferred example of the color developing agent is a known aromatic primary amine color developing agent, particularly a p-phenylenediamine derivative, of which representative examples are shown in the following but such examples are not restrictive:

1) N,N-diethyl-p-phenylenediamine
2) 4-amino-3-methyl-N,N-diethyaniline
3) 4-amino-N-(β-hydroxyethyl)-N-methylaniline
4) 4-amino-N-ethyl-N-(β-hydroxyethyl)-aniline
5) 4-amino-3-methyl-N-ethyl-N-(β-hydroxyethyl)-aniline
6) 4-amino-3-methyl-N-ethyl-N-(3-hydroxypropyl)-aniline
7) 4-amino-3-methyl-N-ethyl-N-(4-hydroxybutyl)-aniline
8) 4-amino-3-methyl-N-ethyl-N-(β-methanesulfonamide-ethyl)aniline
9) 4-amino-N,N-diethyl-3-(β-hydroxyethyl)-aniline
10) 4-amino-3-methyl-N-ethyl-N-(β-methoxyethyl)-aniline
11) 4-amino-3-methyl-N-(β-ethoxyethyl)-N-ethylaniline
12) 4-amino-3-methyl-N-(3-carbamoylpropyl)-N-n-propylaniline
13) 4-amino-N-(4-carbamoylbutyl)-N-n-propyl-3-methylaniline
14) N-(4-amino-3-methylphenyl)-3-hydroxypyrrolidine
15) N-(4-amino-3-methylphenyl)-3-(hydroxymethyl)-pyrrolidine
16) N-(4-amino-3-methylphenyl)-3-pyrrolidine carboxamide.

Among the foregoing p-phenylenediamine derivatives, particularly preferred are compounds 5), 6), 7), 8) and 12), among which further preferred are compounds 5) and 8). These p-phenylenediamine derivatives, in a state of solid raw materials, are usually present in a salt such as sulfate, hydrochloric acid salt, sulfite, naphthalenedisulfonate, or p-toluenesulfonate.

The aforementioned aromatic primary amine developing agent is so added as to obtain its concentration of 2 to 200 mmol. per 1 liter of developer, preferably 6 to 100 mmol. and more preferably 10 to 40 mmol.

The color developer may contain a small amount of sulfite ions or may be substantially free from the sulfite ions, depending on the type of the photosensitive material to be processed, but it is preferred that a small amount of sulfite ions is contained. The sulfite ions have an evident preserving function, but, if present in an excessive amount, may detrimentally affect the photographic properties in the course of the color development. Also there may be included a small amount of hydroxylamine. Hydroxylamine (usually used as a sulfuric acid salt or a hydrochloric acid salt, but such form as salt being omitted for simplicity) functions as a preservative for the developer, like sulfite ions, but may affect the photographic characteristics because of a silver developing activity of hydroxylamine itself, so that the addition thereof has to be limited to a small amount.

As a preservative in the color developer, in addition to the hydroxylamine and sulfite ions explained above, an organic preservative may be added. An organic preservative means any organic compound that can reduce, when contained in the developer for the photosensitive material, a rate of deterioration of the aromatic primary amine developing agent. Thus, it is an organic compound having a function of preventing oxidation by air etc. of the color developing agent, and particularly effective are derivatives of the aforementioned hydroxylamine, hydroxamic acids, hydrazides, phenols, α-hydroxyketones, α-aminoketones, sugars, monoamines, diamines, polyamines, quaternary ammonium salts, nitroxy radicals, alcohols, oximes, diamides and condensed-ring amines. These compounds are disclosed in JP-A Nos. 63-4235, 63-30845, 63-21647, 63-44655, 63-53551, 63-43140, 63-56654, 63-58346, 63-43138, 63-146041, 63-44657 and 63-44656, U.S. Pat. Nos. 3,615,503 and 2,494,903, JP-A No. 52-143020 and Japanese Patent Publication (JP-B) No. 48-30496.

Also there may be contained if necessary, as other organic preservatives, metals described in JP-A Nos. 57-44148 and 57-53749, salicylic acids described in JP-A No. 59-180588, alkanol amines described in JP-A No. 54-3532, polyethylene imines described in JP-A No. 56-94349, aromatic polyhydroxy compounds described in U.S. Pat. No. 3,746,544 etc. In particular there may be added, for example, an alkanol amine such as triethanolamine or tripropanolamine, a substituted or unsubstituted dialkyihydroxyamine such as disulfoethylhydroxylamine or diethylhydroxylamine, or an aromatic polyhydroxy compound.

Among these organic preservatives, the hydroxylamine derivatives are described in detail for example in JP-A Nos. 1-97953, 1-186939, 1-186940 and 1-187557. In particular, a combined addition of a hydroxylamine derivative and an amine may be effective for improving stability of the color developer and stability in a continuous processing.

The aforementioned amines include cyclic amines described in JP-A No. 63-239447, amines described in JP-A No. 63-128340 and amines described in JP-A Nos. 1-186939 and 1-187557. A content of the preservative in the developer is variable depending on the type of the preservative, but is generally within a range of 1 to 200 mmol. per 1 liter of the developer, preferably 10 to 100 mmol per 1 liter of the developer.

In the color developer, chlorine ions may be added if necessary, for example in the developer for a color paper. The color developer often contains chlorine ions in a range of $3.5\times10^{-2}$ to $1.5\times10^{-1}$ mole/L, but the chlorine ions often need not be added to a replenisher solution since the chlorine ions are released into the developer as a by-product of development. Also a developer for a photosensitive material for photographing purpose need not contain chlorine ions.

It is also possible to add bromine ions, and the bromine ions in the color developer are preferably present in an amount of $1.0\times10^{-3}$ mol/L or less. The bromine ions are often not required, like the chlorine ions mentioned above, in the color developer and the replenishing solution, but, in case the addition is necessary, the addition is so executed that the bromine ion concentration is within the above-mentioned range.

In case the photosensitive material to be processed is based on a silver iodide emulsion, a situation for the iodine ions is similar to that for the bromine ions, but the bromine ions are usually not contained in the replenishing solution since the iodine ions are usually released from the photosensitive material to provide an iodine ion concentration of about 0.5 to 10 mg/L in the developer.

A halide may also be added to the color developer, and, in case of addition of such halide, a chlorine ion supplying material can be sodium chloride, potassium chloride, ammonium chloride, lithium chloride, nickel chloride, magnesium chloride, manganese chloride or calcium chloride, among which preferred is sodium chloride or potassium chloride. A bromine ion supplying material can be sodium bromide, potassium bromide, ammonium bromide, lithium bromide, calcium bromide, magnesium bromide, manganese bromide, nickel bromide, cerium bromide or thallium bromide, among which preferred is potassium bromide or sodium bromide. Also an iodine supplying material can be sodium iodide or potassium iodide.

The color developer preferably has a pH of 9.0 to 13.5, and the replenishing solution therefor preferably has a pH of 9.0 to 13.5. Therefore, in the color developer and the replenishing solution, in order to maintain such pH value, there may be added an alkali agent, a buffering agent and, if necessary, an acid agent.

At the preparation of the color developer, it is preferred to use various buffer agents for maintaining the above-mentioned pH value. As the buffer agent, there can be employed a carbonate salt, a phosphate salt, a borate salt, a tetraborate salt, a hydroxybenzoate salt, a glycil salt, an N,N-dimethylglycin salt, a leucine salt, a norleucine salt, a guanine salt, a 3,4-dihydroxyphenylalanine salt, an alanine salt, an aminobutyric acid salt, a 2-amino-2-methyl-1,3-propane diol salt, a valine salt, a proline salt, a trishydroxyaminomethane salt, and a lysine salt. In particular, the carbonate salt, phosphate salt, tetraborate salt and hydroxybenzoate salt have advantages such as a excellent buffer ability in a pH range of pH 9.0 or higher, absence of detrimental influence (for example fogging) on the photographic performance when added to the color developer, and a low cost, and it is particularly preferred to utilize such buffer agent.

Specific examples of the buffer agent include sodium carbonate, potassium carbonate, sodium bicarbonate, potassium bicarbonate, trisodium phosphate, tripotassium phosphate, disodium phosphate, dipotassium phosphate, sodium phosphate, potassium phosphate, sodium tetraborate (borax), potassium tetraborate, sodium o- hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate. However the present invention is not limited to these compounds.

Since the buffer agent is not a reacting or consumed component, an amount of addition in the composition is so determined as to obtain a concentration of 0.01 to 2 mol/L, preferably 0.1 to 0.5 mol/L both in the color developer and the replenishing solution.

In the color developer, there may also be added other components such as a precipitation preventing agent for calcium or magnesium, or various chelating agents which also serve as a stabilizer. Examples of such component include nitrilotriacetic acid, diethylenetriamine pentaacetic acid, ethylenediamine tetraacetic acid, N,N,N-trimethylenephosphonic acid, ethylenediamine-N,N,N',N'-tetramethylenesulfonic acid, transcyclohexanediamine tetraacetic acid, 1,2-diaminopropane tetraacetic acid, glycol etherdiamine tetraacetic acid, ethylenediamine o-hydroxyphenylacetic acid, ethylenediamine disuccinic acid (SS isomer), N-(2-carboxylate ethyl)-L-aspartic acid, β-alanine diacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid. These chelating agents may be used in a combination of two or more kinds, if necessary. Also such chelating agent is only required to be present in an amount enough for masking metal ions in the color developer. For example it is added so as to obtain a concentration of about 0.1 to 10 g/L.

In the color developer, there may be added an arbitrary development accelerator if necessary. As the development accelerator, there may be added, according to the requirement, a neoether compound as described in JP-B Nos. 37-16088, 37-5987, 38-7826, 44-12380, 45-9019 and U.S. Pat. No. 3,813,247; a p-phenylenediamine compound as described in JP-A Nos. 52-49829 and 50-15554; a quaternary ammonium salt as described in JP-A No. 50-137726, JP-B No. 44-30074 and JP-A Nos. 56-156826 and 52-43429; an amine compound as described in U.S. Pat. Nos. 2,494,903, 3,128,182, 4,230,796 and 3,253,919, JP-B No. 41-11431, and U.S. Pat. Nos. 2,482,546, 2,596,926 and 3,582,346; a polyalkylene oxide as described in JP-B Nos. 37-16088 and 42-25201, U.S. Pat. No. 3,128,183, JP-B Nos. 41-11431 and 42-23883 and U.S. Pat. No. 3,532,501; a 1-phenyl-3-pyrazolidone; or an imidazole. An amount of addition of such development accelerator in the composition is so determined as to obtain a concentration of 0.001 to 0.2 mol/L, preferably 0.01 to 0.05 mol/L both in the color developer and the replenishing solution.

In the color developer, there may be added, if necessary, an arbitrary antifoggant in addition to the aforementioned halogen ions. Representative examples of an organic antifoggant include nitrogen-containing heterocyclic compounds such as benzotriazole, 6-nitrobenzimidazole, 5-nitrosoisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolizine, and adenine.

In the color developer, there may be added a surfactant such as an alkylsulfonic acid, an arylsulfonic acid, an aliphatic carboxylic acid or an aromatic carboxylic acid according to the necessity. An amount of addition of such surfactant in the composition is so determined as to obtain a concentration of 0.0001 to 0.2 mol/L, preferably 0.001 to 0.05 mol/L both in the color developer and the replenishing solution.

In the color developer, a fluorescent whitening agent may be used according to the necessity. For the fluorescent whitening agent, there is preferred a bis(triazinylamino) stilbenesulfonic acid compound. For the bis(triazinylamino) stilbenesulfonic acid compound, there can be utilized a known or commercially available aminostilbene whitening agent. As the known bis(triazinylamino)stilbenesulfonic acid compound, there is preferred a compound as described in JP-A Nos. 6-329936, 7-140625 and 10-140849. The commercially available compounds are described for example in *"Senshoku Note"* 9th edition (Shikisen Sha), pp.165–168, and, among the compounds described therein, preferred are Blankophor BSU liq. and Hakkol BRK.

In the following there will be given an explanation of the bleach-fixing solution.

As a bleaching agent to be used in the bleach-fixing solution, there can be employed a known bleaching agent, but there is particularly preferred an organic complex salt of iron (III) (for example a complex salt of an aminopolycarboxylic acid), an organic acid such as citric acid, tartaric acid or malic acid, a persulfate salt or hydrogen peroxide.

Among these, particularly preferred is the organic complex salt of iron (III), in view of rapid processing and prevention of environmental contamination. Examples of aminopolycarboxylic acid or a salt thereof useful for forming the organic complex salt of iron (III) include ethylenediamine disuccinic acid (SS isomer), N-(2-carboxylatethyl)-L-aspartic acid, β-alanine diaccetic acid and methyliminodiacetic acid, which are biodegradable, also ethylenediamine tetraacetic acid, diethylenetriamine pentaacetic acid, 1,3-diaminopropane tetraacetic acid, propylenediamine tetraacetic acid, nitrilotriacetic acid, cyclohexanediamine tetraacetic acid, iminodiacetic acid, glycol etherdiamine tetraacetic acid and a compound represented by a general formula (I) or (II) in EP No. 0789275. Such compound may be used as a salt of sodium, potassium, lithium or ammonium. Among these compounds, there are preferred ethylenediamine disuccinic acid (SS isomer), N-(2-carboxylatethyl)-L-aspartic acid, β-alanine diaccetic acid, ethylenediamine tetraacetic acid, 1,3-diaminopropane tetraacetic acid, and methyliminodiacetic acid, as iron (III) complex salts thereof show satisfactory photographic characteristics. Such ferric ion complex salt may be employed in a form of a complex salt, or may form a ferric ion complex salt in the solution with a ferric salt such as ferric sulfate, ferric chloride, ferric nitrate, ferric ammonium sulfate or ferric phosphate and a chelating agent such as aminopolycarboxylic acid. The chelating agent may be used in an excess amount, which is more than an amount required for forming the ferric ion complex salt. Among the iron complexes, there is preferred an aminopolycarboxylic acid-iron complex, and an amount of addition is 0.01 to 1.0 mol/L, preferably 0.05 to 0.50 mol/L, more preferably 0.10 to 0.50 mol/L, and further preferably 0.15 to 0.40 mol/L.

A fixing agent to be used in the bleach-flxing solution is a known fixing agent, namely a water-soluble silver halide dissolving agent for example a thiosulfate salt such as sodium thiosulfate or ammonium thiosulfate, a thiocyanate salt such as sodium thiocyanate or ammonium thiocyanate, a thioether compound such as ethylene bis-thioglycolic acid, 3,6-dithia-1,8-octanediol, or a thiourea, and such fixing agent can be employed singly or in a combination of two or more kinds. There can also be employed a special bleach-fixing solution formed by a combination of a fixing agent and a large amount of a halide such as potassium iodide, as disclosed in JP-A No. 55-155354. In the present invention, there is preferred a thiosulfate salt, particularly ammonium thiosultate. An amount of the fixing agent per liter is preferably 0.3 to 2 moles, more preferably 0.5 to 1.0 mole.

The bleach-fixing solution preferably has a pH range of 3 to 8, more preferably 4 to 7. A pH lower than this range increases the desilvering property, but accelerates deterioration of the solution and a leuco form formation of the cyan dye. On the other hand, a pH higher than this range delays the silver elimination and facilitates stain formation. For adjusting pH, there may be added hydrochloric acid, sulfuric acid, nitric acid, a bicarbonate salt, ammonium, potassium hydroxide, sodium hydroxide, sodium carbonate, potassium carbonate etc. according to the necessity.

The bleach-fixing solution may further include a fluorescent whitening agent, a defoamer, a surfactant, or an organic solvent such as polyvinylpyrridone or methanol. The bleach-fixing solution preferably contain, as a preservative, a sulfite ion releasing compound for example a sulfite salt (such as sodium sulfite, potassium sulfite or ammonium sulfite), a bisulfite salt (such as ammonium bisulfite, sodium bisulfite or potassium bisulfite), or a metabisulfite salt (such as potassium metabisulfite, sodium metabisulfite or ammonium metabisulfite), or an arylsulfinic acid such as p-toluenesulfinic acid or m-carboxybenzenesulfinic acid. Such compound is preferably contained in amount of about 0.02 to 1.0 mol/L as converted into sulfite ions or sulfinic acid ions.

In addition to the foregoing, there may also be added, as a preservative, ascorbic acid, a carbonyl-bisulfite addition product or a carbonyl compound. There may be further added a buffer agent, a fluorescent whitening agent, a chelating agent, a defoamer, an antimold agent etc. according to the necessity.

Now there will be given an explanation on the rinse solution (rinsing water and/or stabilizing solution).

In the rinse solution, in order to prevent proliferation of bacteria and adhesion of resulting floating substance to the photosensitive material, there may be employed a bactericide such as a isothiazolone compound or a thiapentazole described in JP-A No. 57-8542, a chlorine-type bactericide such as sodium chloroisocyanurate described in JP-A No. 61-120145, benzotriazole or copper ions as described in JP-A No. 61-267761, or bactericides described in Hiroshi Horiguchi, Bokin Bokun no Kagaku, (1986) Sankyo Shuppan, edited by Eisei Gijutukai, *Biseibutsuno Mekkin, Sakkin, Bokungijutsu*, (1982) Kogyo Gijutsukai, and *Bokin Bokunzai Jiten*, edited by Nippon Bokin Bokun Gakkai (1986). Also for the above-mentioned problem, there can be extremely effectively employed a method of reducing calcium and magnesium, described in JP-A No. 62-288838.

In the rinse solution, in order to deactivate the remaining magenta coupler thereby preventing dye discoloration and stain generation there can be added an aldehyde such as formaldehyde, acetaldehyde or pyruvinaldehyde; a methylol compound or hexamethylene tetramine described in U.S. Pat. No. 4,786,583; a hexahydrotriazine described in JP-A No. 2-153348, a formaldehyde-bisulfurous acid addition product described in U.S. Pat. No. 4,921,779 or an azolylmethylamine described in EP Nos. 504609 and 519190.

In the rinse solution (particularly rinsing water), it is possible to use a surfactant as a water expellant or a chelating agent, represented by EDTA, as water softening agent. Also in the rinse solution (particularly in stabilizing solution), there is added a compound having an image stabilizing function, such as an aldehyde represented by formaline, a buffer agent for obtaining a film pH suitable for dye stabilization, and ammonium compounds.

EXAMPLES

In the following, the present invention will be further clarified by examples, but the present invention is not limited to such examples.

Example 1

(Preparation of Emulsion B-H)

An emulsion high in cubic silver chloride content, having a sphere-corresponding diameter of 0.55 $\mu$m and a variation coefficient of 10% was prepared by an ordinary method of mixing silver nitrate and sodium chloride by simultaneous addition to an agitated aqueous solution of gelatin. However, in a period where the addition of silver nitrate proceeds by 80% to 90%, potassium bromide (in an amount corresponding to 3 mol. % on the basis of 1 mole of silver halide to be formed) and $K_4[Ru(CN)_6]$ in an amount of $0.6\times10^{-6}$ moles per 1 mole of silver were added. Also at a point when the addition of silver nitrate proceeds by 90%, potassium iodide (0.3 mol. % on the basis of 1 mole of silver halide to be formed) was added. Also in a period where the addition of silver nitrate proceeds by 92% to 98%, $K_2[Ir(5\text{-methylthiazole})Cl_5]$ and $K_2[Ir(H_2O)Cl_5]$ were added, in respective amounts of $2.5\times10^{-7}$ moles and $4.0\times10^{-7}$ moles per 1 mole of silver. After a desalting process on the obtained emulsion, gelatin was added and re-dispersion was executed. To this emulsion, sodium thiosulfonate, a sensitizing dye A and a sensitizing dye B were added in respective amounts $3\times10^{-4}$ moles on the basis of 1 mole of silver, and the emulsion was ripened so as to achieve optimum chemical sensitization employing sodium thiosulfate pentahydrate as a sulfur sensitizer and bis(1,4,5-trimethyl-1,2,4-triazorium-3-thiolate)aurate (I) tetrafluoroborate as a gold sensitizer. Then there were further added 1-phenyl-5-mercaptotetrazole and 1-(5-methylureidophenyl)-5-mercaptotetrazole in respective amounts of $3\times10^{-4}$ moles per 1 mole of silver. The emulsion thus obtained was designated as an emulsion B-H.

(Preparation of Emulsion B-L)

An emulsion high in cubic silver chloride content, which cubic silver chloride has a sphere-corresponding diameter of 0.45 $\mu$m and a variation coefficient of 10%, was prepared in the same manner as the emulsion B-H except for changing the addition rate of silver nitrate and sodium chloride. The emulsion thus obtained was designated as an emulsion B-L.

Sensitizing dye A

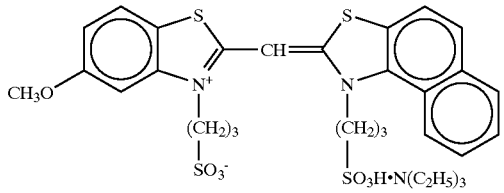

-continued

Sensitizing dye B

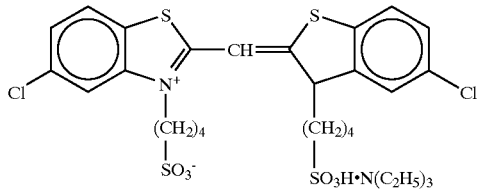

(Preparation of Emulsion G-H)

An emulsion high in cubic silver chloride content having a sphere-corresponding diameter of 0.35 $\mu$m and a variation factor of 10% was prepared by an ordinary method of mixing silver nitrate and sodium chloride by simultaneous addition to an agitated aqueous solution of gelatin. However, in a period where the addition of silver nitrate proceeds by 80% to 90%, $K_4[Ru(CN)_6]$ was added in an amount of $5\times10^{-7}$ moles per 1 mole of silver. Also in a period where the addition of silver nitrate proceeds by 80% to 100%, potassium bromide (in an amount corresponding to 4 mol. % on the basis of 1 mole of silver halide to be formed) was added. Also at a point when the addition of silver nitrate proceeds by 90%, potassium iodide (0.2 mol. % on the basis of 1 mole of silver halide to be formed) was added. Also in a period where the addition of silver nitrate proceeds by 92% to 95%, $K_2[Ir(5\text{-methylthiazole})Cl_5]$ was added in an amount of $6\times10^{-7}$ moles on the basis of 1 mole of silver. Also in a period where the addition of silver nitrate proceeds by 92% to 98%, $K_2[Ir(H_2O)Cl_5]$ was added in an amount of 3×10−7 moles per 1 mole of silver. After a desalting process on the obtained emulsion, gelatin was added and re-dispersion was executed. To this emulsion, sodium thiosulfonate was added, and the emulsion was ripened so as to achieve optimum chemical sensitization employing sodium thiosulfate pentahydrate as a sulfur sensitizer and bis(1,4,5-trimethyl-1,2,4-triazorium-3-thiolate)aurate (I) tetrafluoroborate as a gold sensitizer. Then there were further added a sensitizing dye D in an amount of $0.6\times10^{-3}$ moles per 1 mole of silver, 1-phenyl-5-mercaptotetrazole in an amount of $4.0\times10^{-4}$ moles per 1 mole of silver, 1-(5-methylureidophenyl)-5-mercaptotetrazole in an amount of $5\times10^{-4}$ moles per 1 mole of silver, and potassium bromide. The emulsion thus obtained was designated as an emulsion G-H.

(Preparation of Emulsion G-L)

An emulsion high in cubic silver chloride content having a sphere-corresponding diameter of 0.28 $\mu$m and a variation coefficient of 10% was prepared in the same manner as the emulsion G-H except for changing the addition rate of silver nitrate and sodium chloride. The emulsion thus obtained was designated as an emulsion G-L.

Sensitiziing dye D

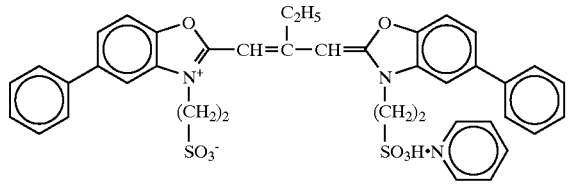

(Preparation of Emulsion R-H)

An emulsion high in cubic silver chloride content having a sphere-corresponding diameter of 0.35 $\mu$m and a variation coefficient of 10% was prepared by an ordinary method of mixing silver nitrate and sodium chloride by simultaneous addition to an agitated aqueous solution of gelatin. However, in a period where the addition of silver nitrate proceeds by 80% to 90%, $K_4[Ru(CN)_6]$ was added in an amount of $5\times10^{-7}$ moles per 1 mole of silver. Also in a period where the addition of silver nitrate proceeds by 80% to 100%, potassium bromide (in an amount corresponding to 4.3 mol. % on the basis of 1 mole of silver halide to be formed) was added. Also at a point when the addition of silver nitrate proceeds by 90%, potassium iodide (0.15 mol. % on the basis of 1 mole of silver halide to be formed) was added. Also in a period where the addition of silver nitrate proceeds by 92% to 95%, $K_2[Ir(5\text{-methylthiazole})Cl_5]$ was added in an amount of $6\times10^{-7}$ moles with respect to 1 mole of silver. Also in a period where the addition of silver nitrate proceeds by 92% to 98%, $K_2[Ir(H_2O)Cl_5]$ was added in an amount of $6\times10^{-7}$ moles per 1 mole of silver. After a desalting process on the obtained emulsion, gelatin was added and re-dispersion was executed. To this emulsion, sodium thiosulfonate was added, and the emulsion was ripened so as to achieve optimum chemical sensitization employing sodium thiosulfate pentahydrate as a sulfur sensitizer and bis(1,4,5-trimethyl-1,2,4-triazorium-3-thiolate)aurate (I) tetrafluoroborate as a gold sensitizer. Then there were further added a sensitizing dye H in an amount of $1.5\times10^{-4}$ moles per 1 mole of silver, 1-phenyl-5-mercaptotetrazole in an amount of $4.0\times10^{-4}$ moles per 1 mole of silver, 1-(5-methylureidophenyl)-5-mercaptotetrazole in an amount of $3\times10^{-4}$ moles per 1 mole of silver, a compound I and potassium bromide. The emulsion thus obtained was designated as an emulsion R-H.

(Preparation of Emulsion R-L)

An emulsion high in cubic silver chloride content having a sphere-corresponding diameter of 0.28 $\mu$m and a variation coefficient of 10% was prepared in the same manner as the emulsion R-H except for changing the addition rate of silver nitrate and sodium chloride. The emulsion thus obtained was designated as an emulsion R-L.

Sensitizing dye H

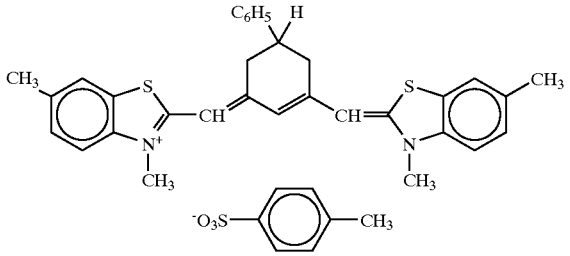

Compound I

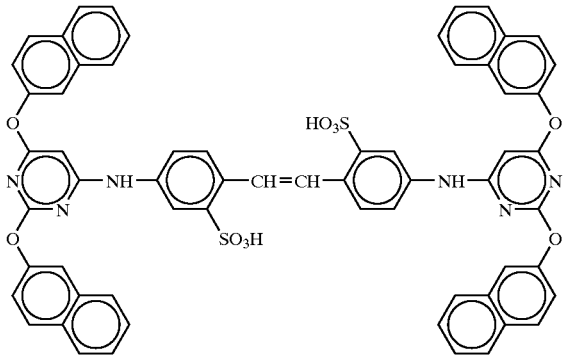

(Preparation of First Layer Coating Solution)

57 g of a yellow coupler (ExY), 7 g of a color image stabilizer (Cpd-1), 5 g of a color image stabilizer (Cpd-2), 6 g of a color image stabilizer (Cpd-3), and 2 g of a color image stabilizer (Cpd-8) were dissolved in 22 g of a solvent (Solv-1) and 80 ml of ethyl acetate, then an obtained solution was emulsified by a high-speed agitation emulsifier (dissolver) in 220 g of a 23.6 wt. % aqueous solution of gelatin, containing 4 g of sodium dodecylbenzenesulfonate, and water was added to obtain 900 g of emulsified dispersion A.

The aforementioned emulsified dispersion A and the emulsions B-H, B-L were mixed and dissolved to obtain a first layer coating solution of a formulation shown in the following. The coating amounts of the emulsion is presented by an amount converted into silver amount.

(Preparation of Coating Solutions for Second to Seventh Layers)

Coating solutions for the second to seventh layers were prepared in a method similar to that for the first layer coating solution, employing the aforementioned emulsions, G-H, G-L, R-H and R-L. As the gelatin hardening agent for each layer, there were employed 1-oxy-3,5-dichloro-s-triazine sodium salt (H-1), (H-2) and (H-3). Amounts of addition were so selected to give the total amount of 100 mg/m$^2$. Also in each layer, Ab-1, Ab-2, Ab-3 and Ab-4 were added so as to respectively obtain total amounts of 14.0 mg/m$^2$, 62.0 mg/m$^2$, 5.0 mg/m$^2$ and 10.0 mg/m$^2$.

(H-1) Hardening Agent

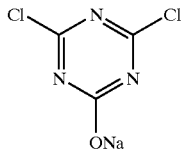

1.4% by mol on the basis of the amount of the gelatin (H-2) Hardening Agent

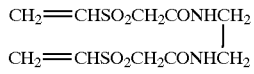

(H-3) Hardening Agent

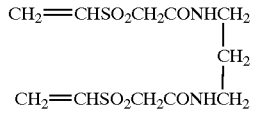

(Ab-1) Preservative agent

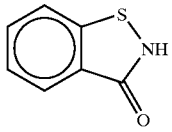

(Ab-2) Preservative agent

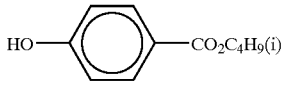

(Ab-3) Preservative agent

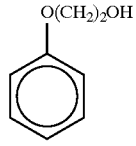

-continued (Ab-4) Preservative agent

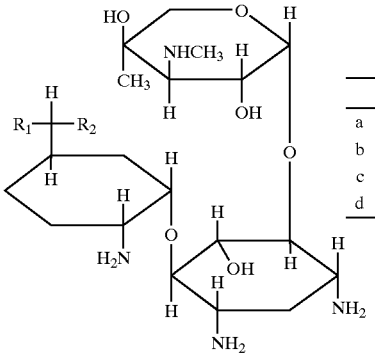

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

1:1:1:1 mixture of a, b, c and d (molar ratio)

And 1 -(3-methylureidophenyl)-5-mercaptotetrazole was added in the second, the fourth, the sixth and the seventh layers with respective amounts of 0.2 mg/m$^2$, 0.3 mg/m$^2$, 0.6 mg/m$^2$ and 0. 1 mg/m$^2$.

In the blue light-sensitive emulsion layer and in the green light-layer, sensitive emulsion layer, 4-hydroxy-6-methyl-1, 3,3a,7-tetrazaindene was added in respective amounts of $1\times10^{-4}$ moles and $2\times10^{-4}$ moles per 1 mole of silver halide.

In the red light-sensitive emulsion layer, a methacrylic acid-butyl acrylate copolymer latex (weight ratio 1:1, average molecular weight 200,000–400,000) was added in an amount of 0.05 g/m$^2$.

Also, to the second layer, the fourth layer and the sixth layer, disodium catechol-3,5-disulfonate was added in amounts of 6 mg/m$^2$, 6 mg/m$^2$, and 17 gm/m$^2$, respectively.

Also, for preventing irradiation, there were added following dyes (parenthesized number indicates a coating amount).

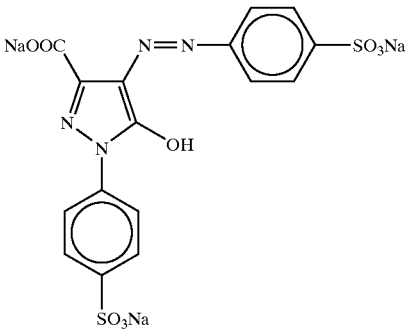

(2 mg/m$^2$)

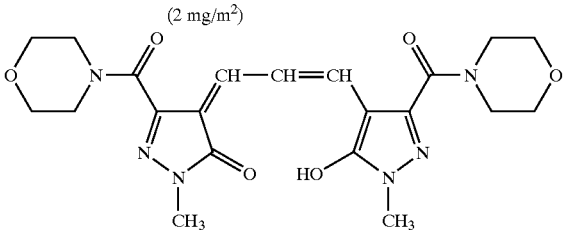

(2 mg/m$^2$)

-continued

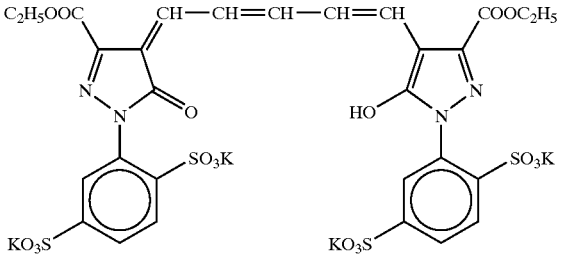

(3 mg/m$^2$)

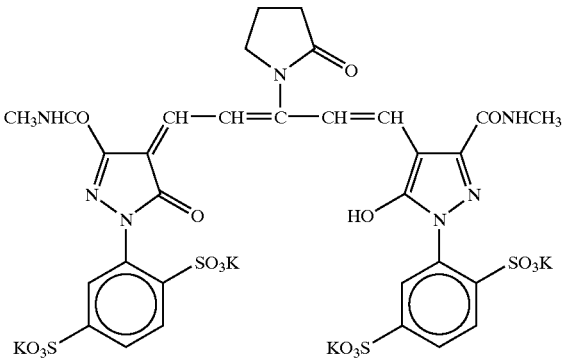

(7 mg/m$^2$)

(Preparation of Substrates 1 to 10 Having a Back Layer)

On a base paper prepared from wood pulp, in which one surface was treated with corona discharge, a polyethylene layer of a thickness of 25 $\mu$m was provided by a melt extrusion method to form a non-glossy resin layer. Further, after the other surface was treated with corona discharge, a polyethylene layer, in which $TiO_2$, zinc stearate, a blueing pigment and a fluorescent whitening agent were blended, was provided thereon by a melt extrusion method to form a glossy resin layer. After the glossy resin layer was treated with corona discharge, a solution principally containing gelatin was coated and dried to form an undercoat layer. Then, after the non-glossy resin layer was treated with corona discharge, a back layer was formed by coating with a bar coater and drying, a hydrophilic organic polymer compound, which is a sodium salt obtained by sulfonating an isoprene-styrene-isoprene ABA-type block copolymer (isoprene/styrene/isoprene=40/20/40, weight-averaged molecular weight: 7500) and neutralizing it with sodium hydroxide, with such an amount of addition that the surface of the back layer (rear surface) has a surface resistance and a charge leak time shown in Table 2, and with an addition of colloidal silica (Snotex C: Nissan Chemical Industries Ltd.), and whereby substrates 1 to 7 were prepared. Also substrates 8 to 10 were prepared in the same manner as in the substrates 1 to 7, except that the surface resistance was so adjusted by a water-soluble polymer compound constituted by polystyrenesulfonate sodium salt (Chemistat SA9: manufactured by Sanyo Chemical Industries Ltd.), in place of the aforementioned isoprene-styrene-isoprene ABA-type block copolymer, that the surface of the back layer (rear surface) has a surface resistance and a charge leak time shown in Table 2.

(Layer Configuration on the Side of Silver Halide Emusion Layers)

In the following there is shown a composition of each layer, in which each number represents a coating amount ($g/m^2$). Silver halide emulsion is indicated by a coating amount converted into a silver amount.

| First layer (blue light-sensitive emulsion layer) | |
|---|---|
| Silver chloride emulsion A (a 3:7 mixture (silver molare ratio) of a gold-sulfur sensitized emulsion B-H containing cubic large-sized silver chloride grains and a gold-sulfur sensitized emulsion B-L containing cubic small-sized silver chloride grains) | 0.24 |
| Gelatin | 1.31 |
| Yellow coupler (ExY) | 0.57 |
| Color image stabilizer (Cpd-1) | 0.06 |
| Color image stabilizer (Cpd-2) | 0.05 |
| Color image stabilizer (Cpd-3) | 0.06 |
| Color image stabilizer (Cpd-8) | 0.03 |
| Solvent (Solv-1) | 0.22 |
| Second layer (color mixing preventing layer) | |
| Gelatin | 1.20 |
| Color mixing preventing agent (Cpd-4) | 0.11 |
| Color image stabilizer (Cpd-5) | 0.018 |
| Color image stabilizer (Cpd-6) | 0.13 |
| Color image stabilizer (Cpd-7) | 0.06 |
| Solvent (Solv-1) | 0.04 |
| Solvent (Solv-2) | 0.13 |
| Solvent (Solv-5) | 0.11 |
| Third layer (green light-sensitive emulsion layer) | |
| Silver chlorobromide emulsion B (a 1:3 mixture (silver molar ratio) of a gold-sulfur sensitized emulsion G-H containing cubic large-sized silver chloride grains and a gold-sulfur sensitized emulsion G-L containing cubic small-sized silver chloride grains) | 0.14 |
| Gelatin | 1.30 |
| Magenta coupler (ExM) | 0.17 |
| Ultraviolet absorber (UV-A) | 0.14 |
| Color image stabilizer (Cpd-2) | 0.003 |
| Color image stabilizer (Cpd-4) | 0.003 |
| Color image stabilizer (Cpd-6) | 0.09 |
| Color image stabilizer (Cpd-8) | 0.02 |
| Color image stabilizer (Cpd-9) | 0.02 |
| Color image stabilizer (Cpd-10) | 0.03 |
| Color image stabilizer (Cpd-11) | 0.0004 |
| Solvent (Solv-3) | 0.09 |
| Solvent (Solv-4) | 0.17 |
| Solvent (Solv-5) | 0.18 |
| Fourth layer (color mixing preventing layer) | |
| Gelatin | 0.68 |
| Color mixing preventing agent (Cpd-4) | 0.06 |
| Color image stabilizer (Cpd-5) | 0.011 |
| Color image stabilizer (Cpd-6) | 0.09 |
| Color image stabilizer (Cpd-7) | 0.06 |
| Solvent (Solv-1) | 0.02 |
| Solvent (Solv-2) | 0.07 |
| Solvent (Solv-5) | 0.069 |
| Fifth layer (red light sensitive emulsion layer) | |
| Silver chlorobromide emulsion C (a 5:5 mixture (silver molar ratio) of a gold-sulfur sensitized emulsion R-H containing cubic large-sized silver chloride grains and a gold-sulfur sensitized emulsion R-L containing cubic small-sized silver chloride grains) | 0.16 |
| Gelatin | 1.25 |
| Cyan coupler (ExC-1) | 0.023 |
| Cyan coupler (ExC-2) | 0.05 |
| Cyan coupler (ExC-3) | 0.15 |
| Ultraviolet absorber (UV-A) | 0.055 |
| Color image stabilizer (Cpd-1) | 0.24 |
| Color image stabilizer (Cpd-7) | 0.002 |
| Color image stabilizer (Cpd-9) | 0.03 |
| Color image stabilizer (Cpd-12) | 0.01 |
| Solvent (Solv-8) | 0.06 |

-continued

| Sixth layer (ultraviolet absorbing layer) | |
|---|---|
| Gelatin | 0.46 |
| Ultraviolet absorber (UV-B) | 0.33 |
| Compound (S1-4) | 0.0014 |
| Solvent (Solv-7) | 0.21 |
| Seventh layer (protective layer) | |
| Gelatin | 1.00 |
| Acryl-modified polyvinyl alcohol copolymer (modification level: 17%) | 0.4 |
| Liquid paraffin | 0.02 |
| Surfactant (Cpd-13) | 0.015 |

(ExY) Yellow coupler

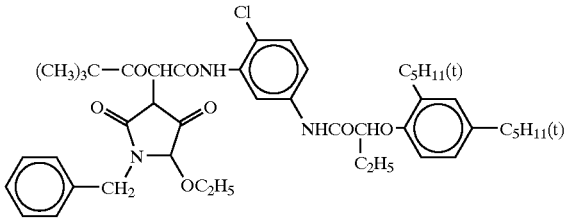

(ExM) Magenta coupler

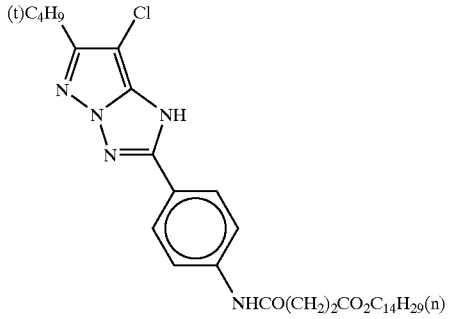

and

40:40:20 mixture (molar ratio) of

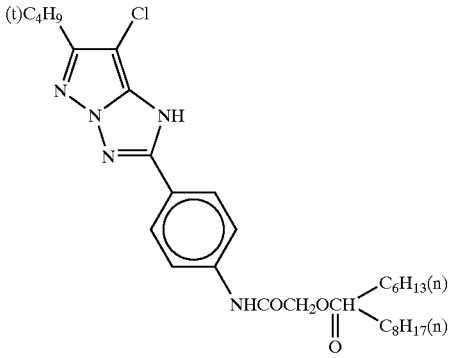

and

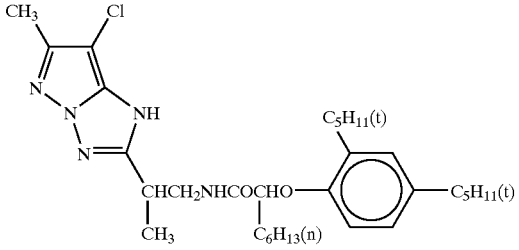

-continued (ExC-1) Cyan coupler

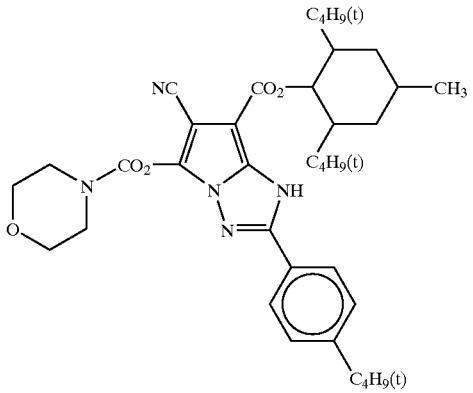

(ExC-2) Cyan coupler

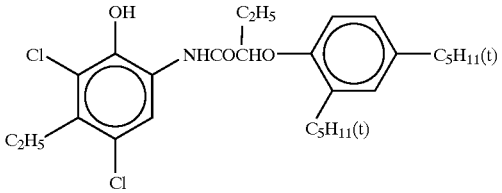

(ExC-3) Cyan coupler

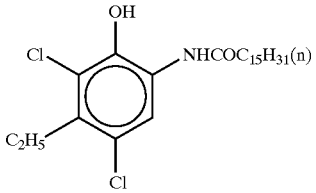

(Cpd-1) Image stabilizer

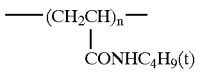

number average molecular weight 60,000

(Cpd-2) Image stabilizer

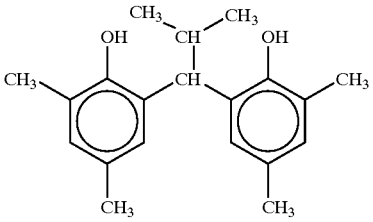

(Cpd-3) Image stabilizer

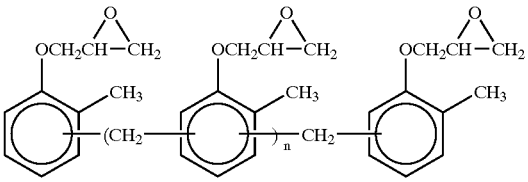

n = 7–8 (average)

-continued (Cpd-4) Color mixing preventing agent

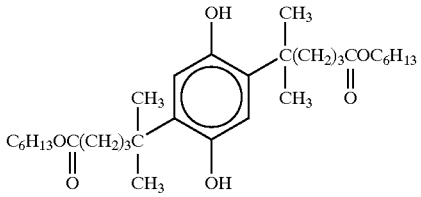

(Cpd-5) Image stabilizer

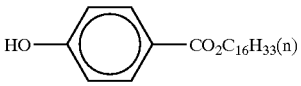

(Cpd-6) Image stabilizer

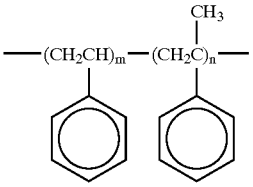

Number average molecular weight 600
m/n = 10/90

(Cpd-7) Image stabilizer

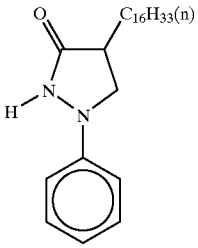

(Cpd-8) Image stabilizer

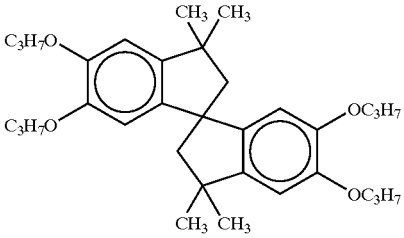

(Cpd-9) Image stabilizer

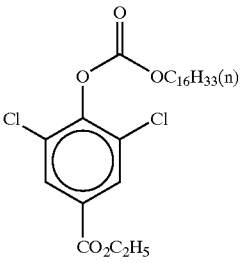

(Cpd-10) Image stabilizer

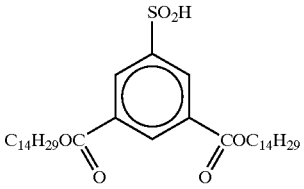

-continued (Cpd-11)

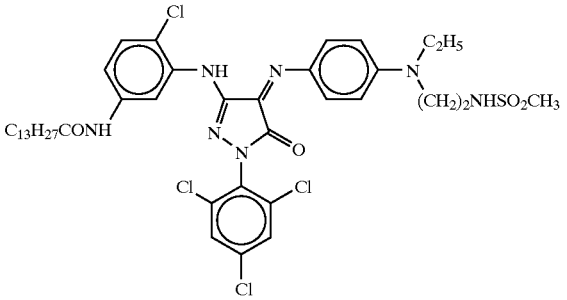

(Cpd-12)

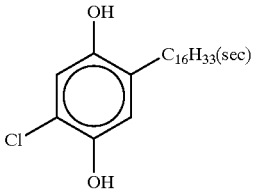

(Cpd-13) Surfactant

7:3 mixture (molar ratio) of

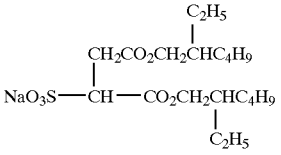

and

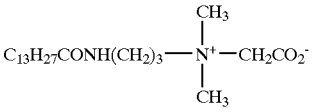

(UV-1) UV absorbing agent

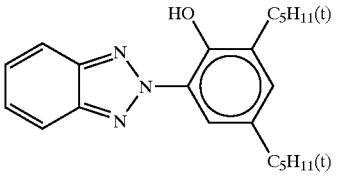

(UV-2) UV absorbing agent

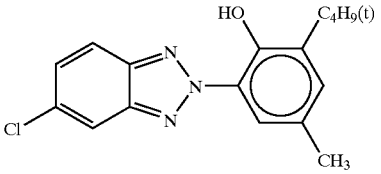

(UV-3) UV absorbing agent

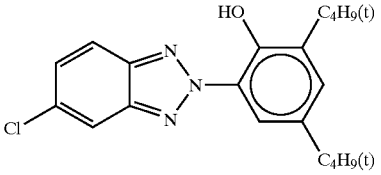

(UV-5) UV absorbing agent

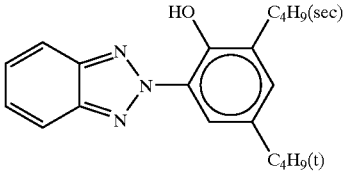

-continued (UV-6) UV absorbing agent

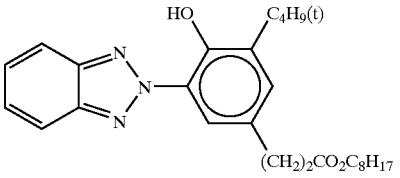

(UV-7) UV absorbing agent

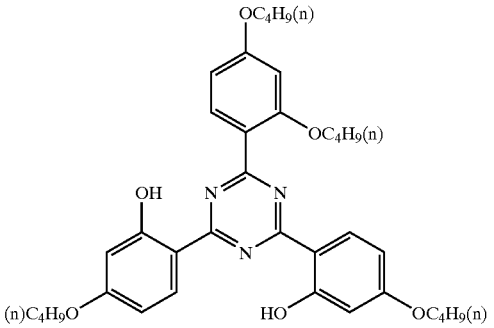

UV-A: mixture of UV-1, UV-2 and UV-3; UV-1/UV-2/UV-3 = 7/2/2 (weight ratio)
UV-B: mixture of UV-1, UV-2, UV-3, UV-5 and UV-6; UV-1/UV-2/UV-3/UV-5/UV-6 = 13/3/3/5/3 (weight ratio)
UV-C: mixture of UV-1 and UV-3; UV-1/UV-3 = 9/1 (weight ratio)

(Solv-1)

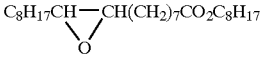

(Solv-2)

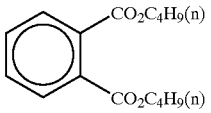

(Solv-3)

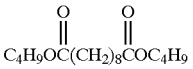

(Solv-4)

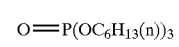

(Solv-5)

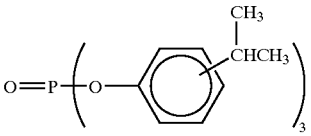

(Solv-7)

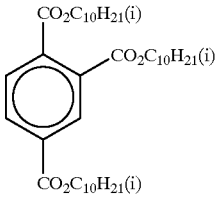

(Solv-8)

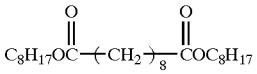

-continued (S1-4)

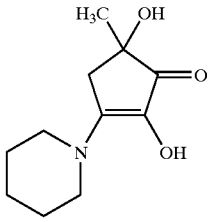

The coating solutions thus prepared were coated and dried on the undercoat layer of the substrates 1–10 prepared in advance, to obtain coated samples 001 to 010. The surface of the back layer (rear surface) of the obtained coated samples 001 to 010 showed a surface resistance and a charge leak time shown in Table 2, when measured in the following manner.

Measurement of surface resistance

Each of the coated samples 001 to 010 was cut into a length of 10 cm and a width of 6 mm, and, after sufficient adjustment of moisture content in an environment of 25° C. and 10%RH, was subjected to a measurement of the surface resistance according to the aforementioned method.

Measurement of charge leak time

Each of the coated samples 001 to 010 was cut into a size of 4 cm×5 cm, and, after sufficient adjustment of moisture content in an environment of 25° C. and 10%RH, was subjected to a measurement of the charge leak time according to the aforementioned method.

(Evaluation of Photographic Properties)

The obtained coated sample was cut into a roll of a width of 127 mm and a length of 180 m, and an image formation was executed with a Digital Minilab Frontier 350 (manufactured by Fuji Photo Film Co., Ltd.) of which a processing unit was modified so as to execute the following developing process A, by fetching a film image from a negative film of an average density, converting such image into a digital signal, then scan exposing the coated sample in an exposure unit and executing a continuous processing (running test) until an replenishing amount reached 4 times of a capacity of a color developing tank. It was thus confirmed that satisfactory photographic properties could be obtained.

- Color developing process A -

| Process step | Temp. | Time | Replenish amount* | Tank capacity |
|---|---|---|---|---|
| Color development | 38.0° C. | 45 sec | 45 mL | 10 L |
| Bleach/fix | 38.0° C. | 45 sec | 35 mL | 10 L |
| Rinse (1) | 38.0° C. | 20 sec | — | 7 L |
| Rinse (2) | 38.0° C. | 20 sec | — | 7 L |
| Rinse (3) | 38.0° C. | 20 sec | — | 7 L |
| Rinse (4) | 38.0° C. | 20 sec | 121 mL | 7 L |
| Drying | 80° C. | 60 sec | | |

Note

*replenishment amount per 1 $m^2$ of photosensitive material

The rinsing was conducted in a 4-tank counter current system from (4) to (1).

Compositions of the developers were as follows.

[Replenishing Solution for Color Developer]

| | |
|---|---|
| Fluorescent whitening agent A-1 | 7.5 g |
| Fluorescent whitening agent B-1 | 12.0 g |
| Dimethylpolysiloxane surfactant (Silicone KF351A/Shin-etsu Chemical Industries) | 0.35 g |
| Ethylenediamine tetraacetic acid | 15.0 g |
| Tri(isopropanol)amine | 30.0 g |
| Potassium hydroxide | 18.5 g |
| Sodium hydroxide | 24.0 g |
| Sodium sulfite | 0.60 g |
| Potassium bromide | 0.04 g |
| 4-amino-3-methyl-N-ethyl-N-(β-ethanesulfonamidethyl)-aniline | 3/2 |
| sulfate monohydrate | 60.0 g |
| Potassium carbonate | 100.0 g |
| pH | 13.0 |
| The total amount adjusted by adding water | 1 L |

A-1

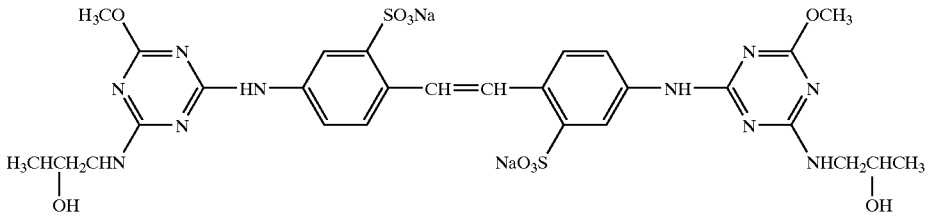

B-1

-continued

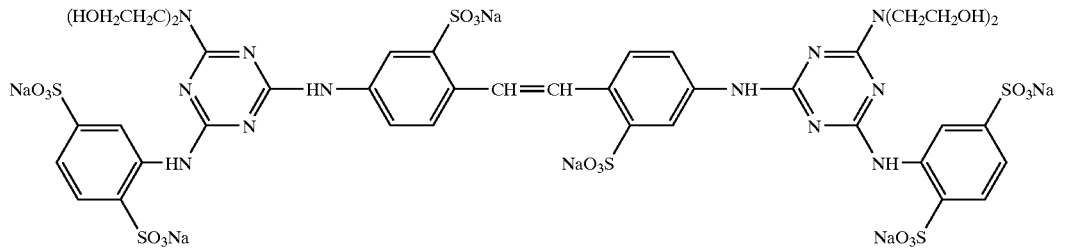

The replenishing solution thus prepared was diluted by four times and pH was adjusted to 12.50 to obtain a replenisher for the color developer.

| [Tnak solution for color developer] | |
|---|---|
| Water | 800 mL |
| Dimethylpolysiloxane surfactant (Silicone KF351A/Shin-etsu Chemical Industries) | 0.1 g |
| Polyethylene glycol (molecular weight 300) | 10.0 g |
| Fluorescent whitening agent A-1 | 1.0 g |
| Fluorescent whitening agent B-1 | 2.0 g |
| Ethylenediamine tetraacetic acid | 4.0 g |
| Tri(isopropanol)amine | 8.8 g |
| Sodium 4,5-dihydroxybenzene-1,3-disulfonate | 8.5 g |
| Potassium chloride | 10.0 g |
| Sodium sulfite | 0.1 g |
| Disodium N-hydroxy-N,N-di(sulfoethyl)amine | 8.5 g |
| 3-methyl-4-amino-N-ethyl-(β-ethanesulfonamidethyl)-aniline 3/2 sulfate monohydrate | 5.0 g |
| Potassium carbonate | 26.3 g |
| The total amount adjusted by adding water | 1000 mL |
| pH (25° C./adjusted with potassium hyrdroxide and sulfuric acid | 10.15 |

| | [Tank solution] | [Replenisher] |
|---|---|---|
| [Bleach-fixing solution] | | |
| Water | 800 mL | 800 mL |
| Ammonium thiosulfate (750 g/L) | 107.0 mL | 214.0 mL |
| m-carboxymethylbenzenesulfinic acid | 8.3 g | 16.5 g |
| Ethylenediamine tetraacetate iron (III) ammonium | 47.0 g | 94.0 g |
| Ethylenediamine tetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| The total amount adjusted by adding water | 1000 mL | 1000 mL |
| pH (25° C./adjusted with sulfuric acid and ammonia) | 6.5 | 6.5 |
| [Rinse solution] | | |
| Sodium chloroisocyanurate | 0.02 g | 0.02 g |
| Deionized water (conductivity 5 μs/cm or less) | 1000 mL | 1000 mL |
| pH | 6.5 | 6.5 |

(Evaluation of Transporting Property)

Transporting property was tested on thus prepared coated samples 1 to 10, utilizing the digital minilab 350, which was used for evaluating the photographic properties and in which the transportation was executed by paired transporting rollers and a belt conveyor. The test for the transporting property was executed by installing the aforementioned minilab in an environment of 25° C. and 10%RH, setting the prepared coated sample in a magazine, and transporting 400 sheets cut into a size of 127 mm×89 mm. Evaluation was made by the following criteria. Results are shown in Table 2.

TABLE 2

| Photosensitive material | | | | | |
|---|---|---|---|---|---|
| Coated sample | Surface resistance of rear surface (Ω) | Charge leak time (sec) | Colloidal silica addition | Transport property | Remarks |
| 001 | $1.9 \times 10^{15}$ | 1280 | not added | − | (comparative ex.) |
| 002 | $5.3 \times 10^{14}$ | 726 | not added | − | (comparative ex.) |
| 003 | $2.8 \times 10^{14}$ | 327 | not added | − | (comparative ex.) |
| 004 | $2.8 \times 10^{14}$ | 323 | added | − | (comparative ex.) |
| 005 | $7.8 \times 10^{13}$ | 190 | not added | ± | (comparative ex.) |
| 006 | $7.8 \times 10^{13}$ | 190 | added | + | (present invention) |
| 007 | $2.0 \times 10^{13}$ | 65 | added | ++ | (present invention) |
| 008 | $4.3 \times 10^{14}$ | 381 | added | ± | (comparative ex.) |
| 009 | $6.7 \times 10^{13}$ | 160 | added | + | (present invention) |
| 010 | $2.9 \times 10^{13}$ | 70 | added | ++ | (present invention) |

++: satisfactory without any transportation failure
+: transportation failure observed in 1 or 2 sheets, but practically acceptable
±: transportation failure observed in more than 2 sheets, usually in 10 or more sheets
−: transportation failure observed frequently and not practically acceptable.

As is apparent from the results shown in Table 2, it is confirmed that the transportation failure of the photosensitive material scarcely occurs in the image formation by the forming method recited in the present invention, in which a photosensitive material, having a surface resistance and/or a charge leakage of a rear surface within specified ranges and having a back layer containing colloidal silica, is cut into a sheet shape and is subjected to imagewise exposure and developing process while being transported by paired transport rollers and/or a belt conveyor.

Example 2

Coated samples 11 to 15 were prepared in the same manner as in Example 1 except that a fluorine type surfactant was contained as shown in Table 3 in the back layer of the substrate 6 prepared in Example 1, and the transporting property was evaluated. Results are shown in Table 3.

TABLE 3

| Photosensitive material | | | |
|---|---|---|---|
| Coated sample | Surfactant | Transport property | Remarks |
| 011 | FS-101 | ++ | (present invention) |
| 012 | FS-117 | ++ | (present invention) |
| 013 | FS-208 | ++ | (present invention) |
| 014 | FS-308 | ++ | (present invention) |
| 015 | FS-413 | ++ | (present invention) |

As is apparent from the results shown in Table 3, it is identified that the transporting property can be further improved by introducing a specific surfactant in the back layer.

Example 3

(Preparation of Emulsion C-H)

An emulsion high in cubic silver chloride content having a sphere-corresponding diameter of 0.55 μm and a variation coefficient of 10% was prepared by an ordinary method of mixing silver nitrate and sodium chloride by simultaneous addition to an agitated aqueous solution of gelatin. However, in a period where the addition of silver nitrate proceeds by 80% to 90%, potassium bromide (in an amount corresponding to 3 mol. % on the basis of 1 mole of silver halide to be formed) and $K_4[Ru(CN)_6]$ in an amount of $0.5\times10^{-6}$ moles per 1 mole of silver were added. Also at a point when the addition of silver nitrate proceeds by 90%, potassium iodide (0.3 mol. % on the basis of 1 mole of silver halide to be formed) was added. Also in a period where the addition of silver nitrate proceeds by 92% to 98%, $K_2[Ir(5\text{-methylthiazole})Cl_5]$ and $K_2[Ir(H_2O)Cl_5]$ were added, in respective amounts of $2\times10^{-7}$ moles and $4\times10^{-7}$ moles per 1 mole of silver. After a desalting process on the obtained emulsion, gelatin was added and re-dispersion was executed. To this emulsion, sodium thiosulfonate, the aforementioned sensitizing dye A and the aforementioned sensitizing dye B were added in respective amounts $3\times10^{-4}$ moles with respect to 1 mole of silver, and the emulsion was ripened so as to achieve optimum chemical sensitization employing sodium thiosulfate pentahydrate as a sulfur sensitizer and bis(1,4,5-trimethyl-1,2,4-triazorium-3-thiolate)aurate (I) tetrafluoroborate as a gold sensitizer. Then there were further added 1-phenyl-5-mercaptotetrazole and 1-(5-methylureidophenyl)-5-mercaptotetrazole in respective amounts of $4\times10^{-4}$ moles and $3\times10^{-4}$ moles per 1 mole of silver. The emulsion thus obtained was designated as an emulsion C-H.

(Preparation of Emulsion C-L)

An emulsion high in cubic silver chloride content having a sphere-corresponding diameter of 0.45 μm and a variation coefficient of 10% was prepared in the same manner as the emulsion C-H except for changing the addition rate of silver nitrate and sodium chloride. The emulsion thus obtained was designated as an emulsion C-L.

(Preparation of Emulsion H-H)

An emulsion high in cubic silver chloride content having a sphere-corresponding diameter of 0.35 μm and a variation coefficient of 10% was prepared by an ordinary method of mixing silver nitrate and sodium chloride by simultaneous addition to an agitated aqueous solution of gelatin. However, in a period where the addition of silver nitrate proceeds by 80% to 90%, $K_4[Ru(CN)_6]$ was added in an amount of $6\times10^{-7}$ moles per 1 mole of silver. Also in a period where the addition of silver nitrate proceeds by 80% to 100%, potassium bromide (in an amount corresponding to 4 mol. % on the basis of 1 mole of silver halide to be formed) was added. Also at a point when the addition of silver nitrate proceeds by 90%, potassium iodide (0.2 mol. % on the basis of 1 mole of silver halide to be formed) was added. Also in a period where the addition of silver nitrate proceeds by 92% to 95%, $K_2[Ir(5\text{-methylthiazole})Cl_5]$ was added in an amount of $6\times10^{-7}$ moles per 1 mole of silver. Also in a period where the addition of silver nitrate proceeds by 92% to 98%, $K_2[Ir(H_2O)Cl_5]$ was added in an amount of $3\times10^{-7}$ moles per 1 mole of silver. After a desalting process on the obtained emulsion, gelatin was added and re-dispersion was executed. To this emulsion, sodium thiosulfonate was added, and the emulsion was ripened so as to achieve optimum chemical sensitization employing sodium thiosulfate pentahydrate as a sulfur sensitizer and bis(1,4,5-trimethyl-1,2,4-triazorium-3-thiolate)aurate (I) tetrafluoroborate as a gold sensitizer. Then there were further added the aforementioned sensitizing dye D in an amount of $0.5\times10^{-3}$ moles per 1 mole of silver, 1-phenyl-5-mercaptotetrazole in an amount of $4.0\times10^{-4}$ moles per 1 mole of silver, 1-(5-methylureidophenyl)-5-mercaptotetrazole in an amount of $5\times10^{-4}$ moles per 1 mole of silver, and potassium bromide. The emulsion thus obtained was designated as an emulsion H-H.

(Preparation of Emulsion H-L)

An emulsion high in cubic silver chloride content having a sphere-corresponding diameter of 0.28 μm and a variation coefficient of 10% was prepared in the same manner as the emulsion H-H except for changing the addition rate of silver nitrate and sodium chloride. The emulsion thus obtained was designated as an emulsion H-L.

(Preparation of First Layer Coating Solution)

57 g of a yellow coupler (aforementioned ExY), 7 g of a color image stabilizer (aforementioned Cpd-1), 5 g of a color image stabilizer (aforementioned Cpd-2), 6 g of a color image stabilizer (aforementioned Cpd-3), and 2 g of a color image stabilizer (aforementioned Cpd-8) were dissolved in 22 g of a solvent (aforementioned Solv-1) and 80 ml of ethyl acetate, then an obtained solution was emulsified by a high-speed agitation emulsifier (dissolver) in 220 g of a 23.6 wt. % aqueous solution of gelatin, containing 4 g of sodium dodecylbenzenesulfonate, and water was added to obtain 900 g of emulsified dispersion A.

The aforementioned emulsified dispersion A and the emulsions C-L, C-H were mixed and dissolved to obtain a first layer coating solution of a formulation shown in the following. The coating amount of the emulsion is presented by an amount converted into a silver amount.

(Preparation of Coating Solutions for Second to Seventh Layers)

Coating solutions for the second to seventh layers were prepared in a method similar to that for the first layer coating solution. As the gelatin hardening agent for each layer, there were employed the aforementioned 1-oxy-3,5-dichloro-s-triazine sodium salt (H-1), (H-2) and (H-3). Amounts of addition were selected as 100 mg/m$^2$ in total. Also in each layer, Ab-1, Ab-2, Ab-3 and Ab-4 were added so as to respectively obtain total amounts of 14.0 mg/m$^2$, 62.0 mg/m$^2$, 5.0 mg/m$^2$ and 10.0 mg/m$^2$.

Also 1-(3-methylureidophenyl)-5-mercaptotetrazole was added in the second, the fourth, the sixth and the seventh layers with respective amounts of 0.2 mg/m$^2$, 0.3 mg/m$^2$, 0.6 mg/m$^2$ and 0.1 mg/m$^2$.

Also in the blue light-sensitive emulsion layer and in the green light-sensitive emulsion layer, 4-hydroxy-6-methyl-1,3,3a,7-tetrazaindene was added in respective amounts of $1\times10^{-4}$ moles and $2\times10^{-4}$ moles per 1 mole of silver halide.

In the red light-sensitive emulsion layer, a methacrylic acid-butyl acrylate copolymer latex (weight ratio 1:1, average molecular weight 200,000–400,000) was added in an amount of 0.05 g/m$^2$.

Also, disodium cathecol-3,5-disulfonate was added to the second, the fourth and the sixth layers with respective amounts of 6 mg/m$^2$, 6 mg/m$^2$ and 17 mg/m$^2$.

Also for preventing irradiation, there were added following dyes (parenthesized number indicates a coating amount).

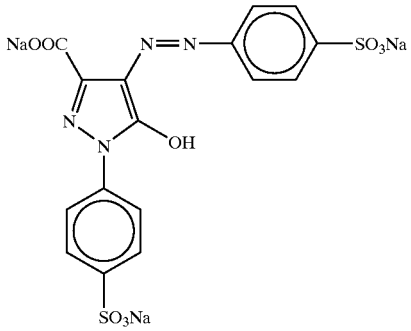

(2 mg/m$^2$)

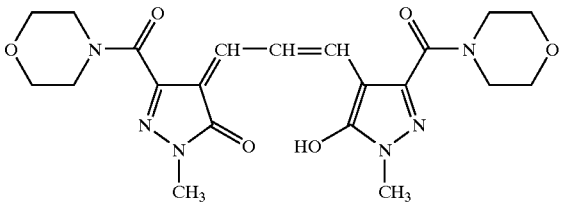

(2 mg/m$^2$)

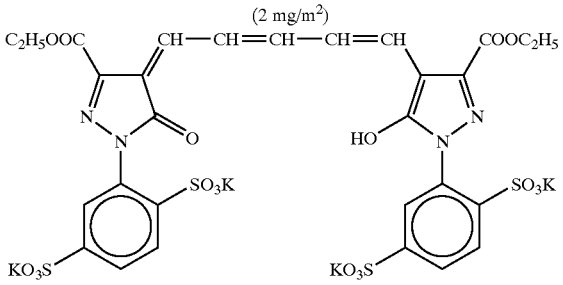

(3 mg/m$^2$)

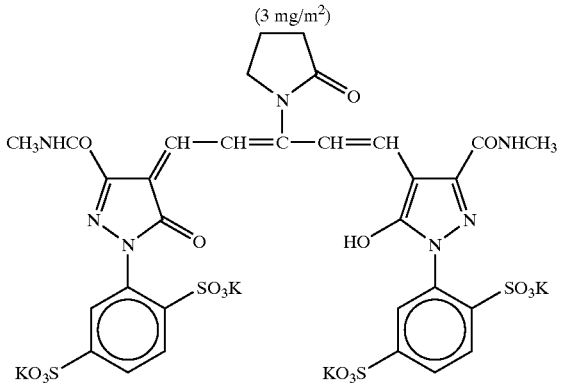

(7 mg/m$^2$)

(Preparation of Substrate)

On a base paper prepared from wood pulp, in which one surface was treated with corona discharge, a polyethylene layer of a thickness of 25 $\mu$m was provided by a melt extrusion method to form a non-glossy resin layer. After the other surface was treated with corona discharge, a polyethylene layer, in which $TiO_2$, zinc stearate, a blueing pigment and a fluorescent whitening agent were blended, was provided thereon by a melt extrusion method to form a glossy resin layer. Then, after the non-glossy resin layer was treated with corona discharge, a water-soluble polymer compound comprising a styrene/acrylate ester polymer obtained by emulsion polymerization in the presence of a non-reactive emulsifier and sodium polystyrenesulfonate was coated with a bar coater and dried to obtain a back layer. After the glossy resin layer was treated with corona discharge, a solution principally containing gelatin was coated and dried, whereby a substrate was prepared.

(Layer Configuration)

In the following there is shown a composition of each layer, in which each number represents a coating amount (g/m$^2$). Silver halide emulsion is indicated by a coating amount converted into a silver amount.

| | |
|---|---|
| First layer (blue light-sensitive emulsion layer) | |
| Silver chloride emulsion D (a 3:7 mixture (silver molar ratio) of a gold-sulfur sensitized emulsion C-H containing cubic large-sized silver chloride grains and a gold-sulfur sensitized emulsion C-L containing cubic small-sized silver chloride grains) | 0.24 |
| Gelatin | 1.31 |
| Yellow coupler (aforementioned ExY) | 0.57 |
| Color image stabilizer (aforementioned Cpd-1) | 0.06 |
| Color image stabilizer (aforementioned Cpd-2) | 0.05 |
| Color image stabilizer (aforementioned Cpd-3) | 0.06 |
| Color image stabilizer (aforementioned Cpd-8) | 0.03 |
| Solvent (aforementioned Solv-1) | 0.22 |
| Second layer (color mixing preventing layer) | |
| Gelatin | 1.20 |
| Color mixing preventing agent (aforementioned Cpd-4) | 0.11 |
| Color image stabilizer (aforementioned Cpd-5) | 0.018 |
| Color image stabilizer (aforementioned Cpd-6) | 0.13 |
| Color image stabilizer (aforementioned Cpd-7) | 0.06 |
| Solvent (aforementioned Solv-1) | 0.04 |
| Solvent (aforementioned Solv-2) | 0.13 |
| Solvent (aforementioned Solv-5) | 0.11 |
| Third layer (green light-sensitive emulsion lazyer) | |
| Silver chlorobromide emulsion E (a 1:3 mixture (silver molar ratio) of a gold-sulfur sensitized emulsion H-H containing cubic large-sized silver chloride grains and a gold-sulfur sensitized emulsion H-L containing cubic small-sized silver chloride grains) | 0.24 |
| Gelatin | 1.30 |
| Magenta coupler (aforementioned ExM) | 0.17 |
| Ultraviolet absorber (aforementioned UV-A) | 0.14 |
| Color image stabilizer (aforementioned Cpd-2) | 0.003 |
| Color image stabilizer (aforementioned Cpd-4) | 0.003 |
| Color image stabilizer (aforementioned Cpd-6) | 0.09 |
| Color image stabilizer (aforementioned Cpd-8) | 0.02 |
| Color image stabilizer (aforementioned Cpd-9) | 0.02 |
| Color image stabilizer (aforementioned Cpd-10) | 0.03 |
| Color image stabilizer (aforementioned Cpd-11) | 0.0004 |
| Solvent (aforementioned Solv-3) | 0.09 |
| Solvent (aforementioned Solv-4) | 0.17 |
| Solvent (aforementioned Solv-5) | 0.18 |
| Fourth layer (color mixing preventing layer) | |
| Gelatin | 0.68 |
| Color mixing preventing agent (aforementioned Cpd-4) | 0.06 |
| Color image stabilizer (aforementioned Cpd-5) | 0.011 |
| Color image stabilizer (aforementioned Cpd-6) | 0.09 |
| Color image stabilizer (aforementioned Cpd-7) | 0.06 |
| Solvent (aforementioned Solv-1) | 0.02 |
| Solvent (aforementioned Solv-2) | 0.07 |
| Solvent (aforementioned Solv-5) | 0.069 |
| Fifth layer (red light-sensitive emulsion layer) | |
| Silver chlorobromide emulsion C (a 5:5 mixture (silver molar ratio) of a gold-sulfur sensitized emulsion R-H containing cubic large-sized silver chloride grains and a gold-sulfur sensitized | 0.16 |

-continued

| | |
|---|---|
| emulsion R-L containing cubic small-sized silver chloride grains) | |
| Gelatin | 1.25 |
| Cyan coupler (aforementioned ExC-1) | 0.023 |
| Cyan coupler (aforementioned ExC-2) | 0.05 |
| Cyan coupler (aforementioned ExC-3) | 0.15 |
| Ultraviolet absorber (aforementioned UV-A) | 0.055 |
| Color image stabilizer (aforementioned Cpd-1) | 0.24 |
| Color image stabilizer (aforementioned Cpd-7) | 0.002 |
| Color image stabilizer (aforementioned Cpd-9) | 0.03 |
| Color image stabilizer (aforementioned Cpd-12) | 0.01 |
| Solvent (aforementioned Solv-8) | 0.06 |
| Sixth layer (ultraviolet absorving layer) | |
| Gelatin | 0.46 |
| Ultraviolet absorber (aforementioned UV-B) | 0.33 |
| Compound (aforementioned S1–4) | 0.0014 |
| Solvent (aforementioned Solv-7) | 0.21 |
| Seventh layer (protective layer) | |
| Gelatin | 1.00 |
| Acryl-modified polyvinyl alcohol copolymer (modification level: 17%) | 0.4 |
| Liquid paraffin | 0.02 |
| Fluorine type surfactant (compound A) | 0.009 |

The coating solutions thus prepared were coated and dried on the undercoat layer of the prepared substrate to obtain a coated sample 011.

Also coated samples 012 to 022 were prepared by replacing the fluorine type surfactant (compound A) in the seventh layer of the coated sample 011 with fluorine type surfactants shown in Table 4, in a molar amount same as the compound A.

(Evaluation of Photographic Properties)

The obtained coated sample was cut into a roll of a width of 127 mm, and an image formation was executed with a Digital Minilab Frontier 350 (manufactured by Fuji Photo Film Co., Ltd.) of which a processing unit was modified so as to execute the following developing process B, by fetching a film image from a negative film of an average density, converting such image into a digital signal, then scan exposing the coated sample in an exposure unit and executing a continuous processing (running test) until an replenishing amount reached 4 times of a capacity of a color developing tank. It was thus confirmed that satisfactory photographic properties could be obtained.

- Color developing process B -

| Process step | Temp. | Time | Replenish amount* | Tank capacity |
|---|---|---|---|---|
| Color development | 41.5° C. | 45 sec | 38 mL | 10 L |
| Bleach/fix | 40.0° C. | 45 sec | 28 mL | 10 L |
| Rinse (1) | 38.0° C. | 20 sec | — | 7 L |
| Rinse (2) | 38.0° C. | 20 sec | — | 7 L |
| Rinse (3) | 38.0° C. | 20 sec | — | 7 L |
| Rinse (4) | 38.0° C. | 20 sec | 95 mL | 7 L |
| Drying | 80° C. | 60 sec | | |

Note
*replenishment amount per 1 $m^2$ of photosensitive material

The rinsing was conducted in a 4-tank counter current system from (4) to (1).

Compositions of the developers were as follows.

[Replenishing solution for color developer]

| | |
|---|---|
| Fluorescent whitening agent A-1 | 7.5 g |
| Fluorescent whitening agent B-1 | 12.0 g |
| Dimethylpolysiloxane surfactant (Silicone KF351A/Shin-etsu Chemical Industries) | 0.35 g |
| Ethylenediamine tetraacetic acid | 15.0 g |
| Tri(isopropanol)amine | 30.0 g |
| Potassium hydroxide | 18.5 g |
| Sodium hydroxide | 24.0 g |
| Sodium sulfite | 0.62 g |
| Potassium bromide | 0.04 g |
| 4-amino-3-methyl-N-ethyl-N-(β-ethanesulfonamidethyl)-aniline 3/2 sulfate monohydrate | 62.0 g |
| Potassium carbonate | 100.0 g |
| pH | 13.0 |
| The total amount adjusted by adding water | 1 L |

The replenishing solution thus prepared was diluted by four times and pH was adjusted to 12.50 to obtain a replenisher for the color developer.

[Tank solution for color developer]

| | |
|---|---|
| Water | 800 mL |
| Dimethylpolysiloxane surfactant (Silicone KF351A/Shin-etsu Chemical Industries) | 0.1 g |
| Polyethylene glycol (molecular weight 300) | 10.0 g |
| Fluorescent whitening agent A-1 | 1.0 g |
| Fluorescent whitening agent B-1 | 2.0 g |
| Ethylenediamine tetraacetic acid | 4.0 g |
| Tri(isopropanol)amine | 8.8 g |
| Sodium 4,5-dihydroxybenzene-1,3-disulfonate | 8.5 g |
| Potassium chloride | 10.0 g |
| Sodium sulfite | 0.1 g |
| Disodium N-hydroxy-N,N-di(sulfoethyl)amine | 8.5 g |
| 3-methyl-4-amino-N-ethyl-(β-ethanesulfonamidethyl)-aniline 3/2 sulfate monohydrate | 5.0 g |
| Potassium carbonate | 26.3 g |
| The total amount adjusted by adding water | 1000 mL |
| pH (25° C./adjusted with potassium hydroxide and sulfuric acid) | 10.15 |

| | [Tank solution] | [Replenisher] |
|---|---|---|
| [Bleach-fixing solution] | | |
| Water | 800 mL | 800 mL |
| Ammonium thiosulfate (750 g/L) | 109.0 mL | 216.0 mL |
| m-carboxymethylbenzenesulfinic acid | 8.3 g | 16.5 g |
| Ethylenediamine tetraacetate iron (III) ammonium | 48.0 g | 96.0 g |
| Ethylenediamine tetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| The total amount adjusted by adding water | 1000 mL | 1000 mL |
| pH (25° C./adjusted with sulfuric acid and ammonia) | 6.5 | 6.5 |
| [Rinse solution] | | |
| Sodium chloroisocyanurate | 0.02 g | 0.02 g |
| Deionized water | 1000 mL | 1000 mL |

-continued

| | [Tank solution] | [Replenisher] |
|---|---|---|
| (conductivity 5 μs/cm or less) | | |
| pH | 6.5 | 6.5 |

(Evaluation of Stacking Property)

The obtained coated sample was subjected, in a continuous process utilizing the aforementioned Digital Minilab Frontier 350 (manufactured by Fuji Photo Film Co., Ltd.) with the modified processing unit, to image formation of more than 1,000 sheets of a size of 12.7 cm×8.9 cm in an environment of 15° C. and a humidity not exceeding 15%, and a stacking property of the samples was evaluated. Evaluation was made by the the following criteria. Results are shown in Table 4.

(Evaluation of Edge Stain)

The obtained coated sample was subjected, in an unexposed state, to a continuous processing utilizing the aforementioned Digital Minilab Frontier 350 (manufactured by Fuji Photo Film Co., Ltd.) with the modified processing unit, and a stain on end cross sections of the substrate of the coated sample (edge stain) was evaluated. The edge stain was evaluated by a density value obtained by superposing 20 sheets of a sample immediately after processing or a sample after a 5-days standing under conditions of a high temperature and a high humidity and measuring the yellow reflective density of an edge portion with a Macbeth densitometer. Results are shown in Table 4.

TABLE 4

| Photosensitive material | | Stacking | Edge stain | | |
|---|---|---|---|---|---|
| Sample No. | Surfactant | property | Immediately after processing | After standing | Remarks |
| 011 | compound A | ± | 0.213 | 0.453 | (comp. example) |
| 012 | compound B | ± | 0.215 | 0.442 | (comp. example) |
| 013 | compound C | + | 0.209 | 0.441 | (comp. example) |
| 014 | compound D | + | 0.208 | 0.431 | (comp. example) |
| 015 | FS-101 | ++ | 0.158 | 0.331 | (pres. invention) |
| 016 | FS-131 | ++ | 0.157 | 0.320 | (pres. invention) |
| 017 | FS-205 | ++ | 0.189 | 0.369 | (pres. invention) |
| 018 | FS-265 | ++ | 0.188 | 0.358 | (pres. invention) |
| 019 | FS-304 | ++ | 0.186 | 0.351 | (pres. invention) |
| 020 | FS-329 | ++ | 0.182 | 0.361 | (pres. invention) |
| 021 | FS-413 | ++ | 0.185 | 0.387 | (pres. invention) |
| 022 | FS-425 | ++ | 0.181 | 0.395 | (pres. invention) |

Compound A

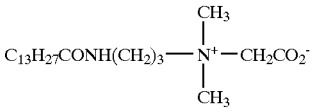

Compound B

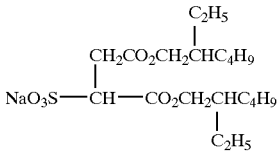

Compound C $CF_3—(CF_2)_7—SO_3Na$

Compound D $C_8F_{17}SO_2N(C_4H_9)CH_2CO_2K$

As is apparent from the results shown in Table 4, it is found that a silver halide photosensitive material comprising a specific fluorine type surfactant, processed in a low-replenishment process provides a satisfactory stacking property of the photosensitive material and suppresses aggravation of the edge stain. It is also identified that the above-mentioned effects are particularly conspicuous in a photosensitive material utilizing the surfactant represented by the general formula (I).

As explained in the foregoing, the present invention provides an image forming method capable of suppressing the failure in transporting a silver halide color photosensitive material, and an image forming method capable, ion a low-replenishment process on a silver halide color photosensitive material, of suppressing aggravation of stain (edge stain) of an end cut face (edge portion) after the processing and also improving the stacking property.

What is claimed is:

1. An image forming method comprising the steps of:

cutting a silver halide color photosensitive material, which has, on a reflective substrate, photographic layers comprising at least one of each of a blue light-sensitive silver halide emulsion layer containing a yellow dye forming coupler, a green light-sensitive silver halide emulsion layer containing a magenta dye forming coupler, a red light-sensitive silver halide emulsion layer containing a cyan dye forming coupler, and a non-photosensitive hydrophilic colloid layer, into sheet form;

subjecting the sheet to imagewise exposure under transportation with at least one of paired transporting rollers and a belt conveyor; and applying development processing that includes color development, bleach-fixing, and rinsing, to the sheet wherein said silver halide color photosensitive material comprises a back layer on a side of the reflective substrate opposite to the silver halide emulsion layers, said back layer contains colloidal silica, and a surface of said back layer has a surface resistance of $1.0\times10^{14}\Omega$ or less and a charge leak time of 200 seconds or less.

2. The image forming method according to claim 1, wherein said colloidal silica has an average particle diameter of 5 to 100 nm.

3. The image forming method according to claim 1, wherein said back layer includes at least one of a water-soluble polymer compound having a carboxyl group or a sulfonic group, a metal salt thereof and an aqueous dispersion of a hydrophilic organic polymer having at least one of a carboxyl group, a sulfonic group, a phosphoric acid group, an acyl group, and a hydroxyl group.

4. The image forming method according to claim 1, wherein said back layer includes at least one selected from fluorine type surfactants represented by the following general formulae (I) to (IV), and said colloidal silica General formula (I)

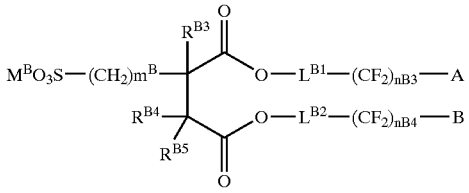

General Formula (II)

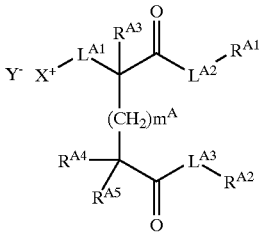

General formula (III)

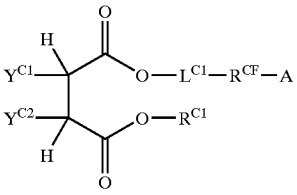

General formula (IV)

$[Rf^{D}—(L^{D})_{nD}]_{mD}—W$ wherein in general formula (I), $R^{B3}$, $R^{B4}$ and $R^{B5}$ each independently represent a hydrogen atom or a substituent group; A and B each independently represent a fluorine atom or a hydrogen atom; $n^{B3}$ and $n^{B4}$ each independently represent an integer from 4 to 8; $L^{B1}$ and $L^{B2}$ each independently represent a substituted or unsubstituted alkylene group, a substituted or unsubstituted alkyleneoxy group, or a divalent connecting group formed by a combination thereof; $m^{B}$ represents 0 or 1; and M represents a cation;

in general formula (II) $R^{A1}$ and $R^{A2}$ each independently represent a substituted or unsubstituted alkyl group; at least one of $R^{A1}$ and $R^{A2}$ represents an alkyl group substituted with a fluorine atom; $R^{A3}$, $R^{A4}$ and $R^{A5}$ each independently represent a hydrogen atom or a substituent group; $L^{A1}$, $L^{A2}$ and $L^{A3}$ each independently represent a single bond or a divalent connecting group; $X^{+}$ represents a cationic substituent; $Y^{-}$ represents a counter anion which may be omitted in a case in which a charge in the molecule becomes 0; and $m^{A}$ represents 0 or 1;

in general formula (III), $R^{C1}$ represents a substituted or unsubstituted alkyl group; $R^{CF}$ represents a perfluoroalkylene group; A represents a hydrogen atom or a fluorine atom; $L^{C1}$ represents a substituted or unsubstituted alkylene group, a substituted or unsubstituted alkyleneoxy group, or a divalent connecting group formed by a combination thereof; one of $Y^{C1}$ and $Y^{C2}$ represents a hydrogen atom and the other represents $—L^{C2}—SO_3M$; and M represents a cation; and in general formula (IV), $Rf^{D}$ represents a perfluoroalkyl group; $L^{D}$ represents an alkylene group; W represents a group having an anionic, cationic, betainic or nonionic polar group necessary for providing a surface-active property; $n^{D}$ represents 0 or 1; and $m^{D}$ represents an integer from 1 to 3.

5. The image forming method according to claim 1, wherein said back layer includes a fluorine type surfactant represented by the following general formula (I), and said colloidal silica General formula (I)

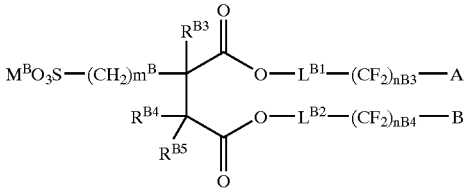

wherein, in general formula (I), $R^{B3}$, $R^{B4}$ and $R^{B5}$ each independently represent a hydrogen atom or a substituent group; A and B each independently represent a fluorine atom or a hydrogen atom; $n^{B3}$ and $n^{B4}$ each independently represent an integer from 4 to 8; $L^{B1}$ and $L^{B2}$ each independently represent a substituted or unsubstituted alkylene group, a substituted or unsubstituted alkyleneoxy group, or a divalent connecting group formed by a combination thereof; $m^{B}$ represents 0 or 1; and M represents a cation.

6. An image forming method comprising the steps of:

cutting a silver halide color photosensitive material, which has, on a reflective substrate, photographic layers comprising at least one of each of a blue light-sensitive silver halide emulsion layer containing a yellow dye forming coupler, a green light-sensitive silver halide emulsion layer containing a magenta dye forming coupler, a red light-sensitive silver halide emulsion layer containing a cyan dye forming coupler, and a non-photosensitive hydrophilic colloid layer, into sheet form for individual prints;

subjecting the sheet to imagewise exposure under transportation with at least one of paired transporting rollers and a belt conveyor; and applying development processing that includes color development, bleach-fixing, and rinsing, to the sheet wherein said silver halide color photosensitive material comprises a back layer on a side of the reflective substrate opposite to the silver halide emulsion layers, said back layer contains colloidal silica, and a surface of said back layer has a surface resistance of $1.0\times10^{14}\Omega$ or less and a charge leak time of 200 seconds or less.

7. The image forming method according to claim 6, wherein the sheet form has a size of 127 mm×89 mm.

* * * * *